US010626696B1

(12) United States Patent
Branton

(10) Patent No.: US 10,626,696 B1
(45) Date of Patent: Apr. 21, 2020

(54) FLUID-SEALING DOWNHOLE BRIDGE PLUGS

(71) Applicant: Christopher A. Branton, Bossier City, LA (US)

(72) Inventor: Christopher A. Branton, Bossier City, LA (US)

( * ) Notice: Subject to any disclaimer, the term of this patent is extended or adjusted under 35 U.S.C. 154(b) by 227 days.

(21) Appl. No.: 15/822,753

(22) Filed: Nov. 27, 2017

Related U.S. Application Data

(63) Continuation-in-part of application No. 15/466,952, filed on Mar. 23, 2017, now Pat. No. 10,309,189.

(51) Int. Cl.
*E21B 33/129* (2006.01)
*E21B 33/134* (2006.01)
*E21B 33/128* (2006.01)

(52) U.S. Cl.
CPC ..... *E21B 33/1293* (2013.01); *E21B 33/1285* (2013.01); *E21B 33/134* (2013.01)

(58) Field of Classification Search
CPC ..... E21B 33/1293; E21B 33/1204; E21B 33/128; E21B 33/134; E21B 23/01
See application file for complete search history.

(56) References Cited

U.S. PATENT DOCUMENTS 2,809,080 A 10/1957 Mittell, et al.
3,298,440 A 1/1967 Current
4,491,178 A 1/1985 Terrell et al.
7,290,603 B2 11/2007 Hiorth et al.
7,424,909 B2 9/2008 Roberts et al.
7,762,323 B2 7/2010 Frazier
7,980,300 B2 7/2011 Roberts et al.
8,016,295 B2 9/2011 Guest et al.
8,205,671 B1 6/2012 Branton
9,260,936 B1 2/2016 Branton
2009/0126925 A1 5/2009 Guest et al.
2013/0048271 A1* 2/2013 VanLue ..... E21B 33/128 166/118
2013/0192853 A1 8/2013 Themig

* cited by examiner

*Primary Examiner* — David J Bagnell
*Assistant Examiner* — Dany E Akakpo
(74) *Attorney, Agent, or Firm* — R. Keith Harrison

(57) ABSTRACT

Fluid-sealing downhole bridge plugs may include a pair of sealing rings which prevent flow of well fluid through the interface between a mandrel shaft of a mandrel and expansion elements of the downhole bridge plug. An illustrative embodiment of the fluid-sealing downhole bridge plugs includes a mandrel. At least one sealing element may be provided on the mandrel. A first backup ring may be provided on the mandrel on a first side of the at least one sealing element. A second backup ring may be provided on the mandrel on a second side of the at least one sealing element. A first gage ring may be provided on the mandrel in engaging relationship to the first backup ring. A second gage ring may be provided on the mandrel in engaging relationship to the second backup ring. A first ring space may be provided between the at least one sealing element and the first backup ring. A first seal ring may be provided in the first ring space. A second ring space may be provided between the at least one sealing element and the second backup ring. A second seal ring may be provided in the second ring space.

20 Claims, 38 Drawing Sheets

FLUID-SEALING DOWNHOLE BRIDGE PLUGS

CROSS-REFERENCE TO RELATED APPLICATIONS

This is a continuation-in-part of parent application Ser. No. 15/466,952, now U.S. Pat. No. 10,309,189, filed Mar. 23, 2017 and entitled DOWNHOLE BRIDGE PLUGS, REINFORCING RINGS AND REINFORCING RING FABRICATION METHODS, which parent application claims the benefit of U.S. provisional application No. 62/312,545, filed Mar. 24, 2016 and entitled DOWNHOLE BRIDGE PLUGS, REINFORCING RINGS AND REINFORCING RING FABRICATION METHODS, each of which provisional application and parent application is hereby incorporated by reference herein in its entirety.

FIELD

Illustrative embodiments of the disclosure generally relate to downhole bridge plugs for plugging a subterranean well. More particularly, illustrative embodiments of the present disclosure relate to fluid-sealing downhole bridge plugs having a pair of sealing rings which prevent flow of well fluid through the interface between a mandrel shaft of a mandrel and expansion elements of the downhole bridge plug.

BACKGROUND

The background description provided herein is solely for the purpose of generally presenting the context of the illustrative embodiments of the disclosure. Aspects of the background description are neither expressly nor impliedly admitted as prior art against the claimed subject matter.

In the production of fluids such as hydrocarbons from a subterranean well, it may be desirable to selectively seal or plug the well at various locations. For example, in hydrocarbon (oil and/or gas) production wells, it may be necessary or desirable to seal oft a lower hydrocarbon-producing formation during the extraction of hydrocarbons from an upper hydrocarbon-producing formation. In other applications, it may be necessary or desirable to isolate the bottom of the well from the wellhead. Downhole bridge plugs are extensively used in such applications to establish a removable seal in the well.

A conventional downhole bridge plug may include a central mandrel on which is provided at least one expandable sealing element. An annular cone and a ridged slip assembly may be provided on the mandrel on each side of the sealing element or elements. The bridge plug may be set in place between adjacent hydrocarbon-producing fractions in the well casing by initially running the bridge plug to the desired location in the casing on a tubing string or using an alternative method and then sliding the slip assemblies onto the respective cones using a hydraulic or other setting tool, causing the slip assemblies to expand against the interior of the casing as they travel on the cones. Simultaneously, the cones move inwardly toward each other and against the sealing element, causing the cones and the sealing element to expand outwardly against the well casing. Therefore, the slip assemblies, the cones and the sealing elements together form a fluid-tight seal to prevent movement of fluids from one fraction to another within the well. When it is desired to re-establish fluid communication between the fractions in the well, the downhole bridge plug may be removed from the well casing. A backup ring on the mandrel between each cone and the sealing element or elements may reinforce the sealing element or elements after expansion against the casing.

One type of downhole bridge plug, commonly known as a drillable bridge plug, can be removed from the well casing by drilling or milling the bridge plug rather than by retrieving the plug from the casing. In this process, a milling cutter or drill bit is extended through the casing and rotated to grind the plug into fragments until the plug no longer seals the well casing. Drillable bridge plugs may be constructed of a drillable metal, engineering-grade plastic or composite material that can be drilled or ground into fragments by the milling cutter or drill bit.

One drawback of conventional downhole bridge plugs is that the slip assemblies may inadequately reinforce the cones against the sealing element or elements in the casing after the plug expansion process. This may allow the cones and the sealing element or elements to slip on the mandrel during application of pressure to the plug. A common drawback of conventional drillable bridge plugs is that during milling or drilling and grinding of the plug, the mandrel has a tendency to rotate or spin with the cutter or drill bit while the sealing elements, cones and/or other outer sealing components of the plug remain stationary against the interior surface of the well casing. This effect may reduce drilling efficiency and prolong the time which is necessary to remove the plug from the well bore.

Accordingly, fluid-sealing downhole bridge plugs having a pair of slip assemblies characterized by enhanced grip strength, slip assemblies characterized by enhanced grip strength and methods of fabricating slip assemblies with enhanced grip strength may be desirable for some applications.

SUMMARY

Illustrative embodiments of the disclosure are generally directed to fluid-sealing downhole bridge plugs having a pair of sealing rings which prevent flow of well fluid through the interface between a mandrel shaft of a mandrel and expansion elements of the downhole bridge plug. An illustrative embodiment of the fluid-sealing downhole bridge plugs includes a mandrel. At least one sealing element may be provided on the mandrel. A first backup ring may be provided on the mandrel on a first side of the at least one sealing element. A second backup ring may be provided on the mandrel on a second side of the at least one sealing element. A first gage ring may be provided on the mandrel in engaging relationship to the first backup ring. A second gage ring may be provided on the mandrel in engaging relationship to the second backup ring. A first ring space may be provided between the at least one sealing element and the first backup ring. A first seal ring may be provided in the first ring space. A second ring space may be provided between the at least one sealing element and the second backup ring. A second seal ring may be provided in the second ring space.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description. As used herein, relative terms such as "upper" and "lower" are intended to be used in an illustrative and not a limiting sense. In some applications, therefore, those elements which are identified as "upper" may be located beneath those elements which are identified as "lower" in the following detailed description. As used herein, the terms "upper" and "proximal" are intended to denote the end of a component which is closer to the well surface and the terms "lower" and "distal" are intended to denote the end of a component which is farther from the well surface.

Figure 1:
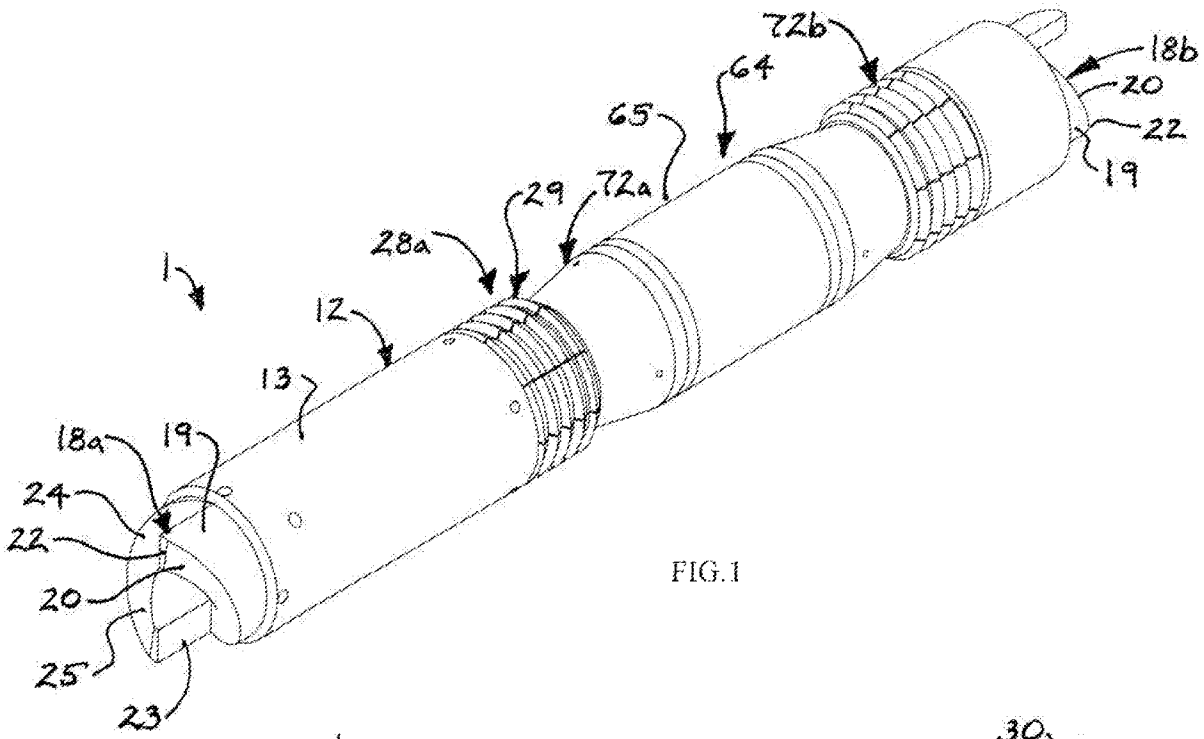
FIG. 1 is a side perspective view of an illustrative embodiment of the downhole bridge plugs.
Figure 2:
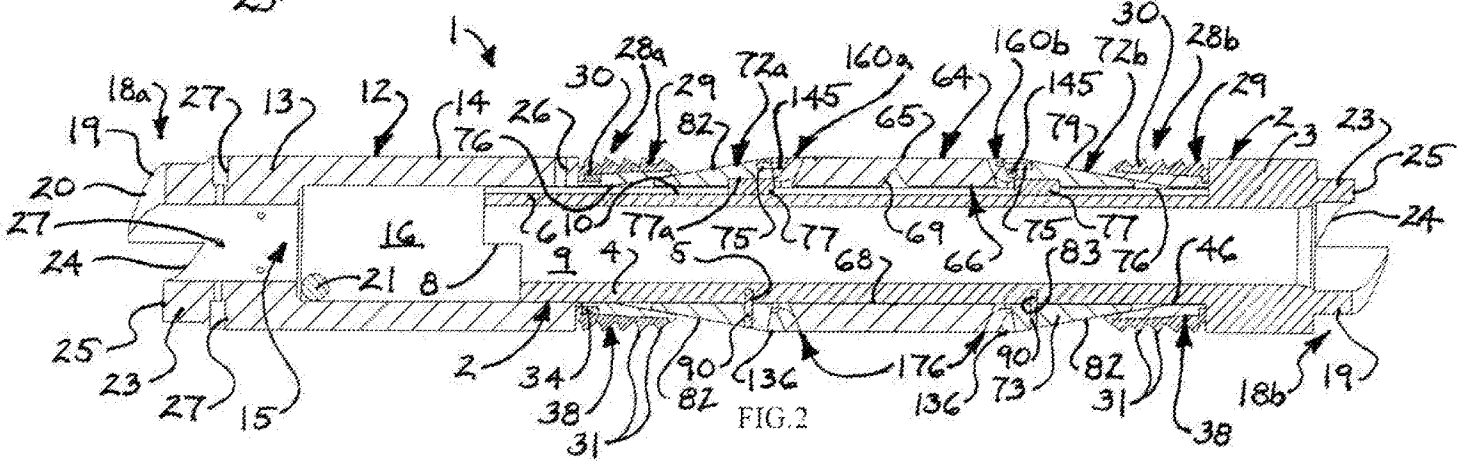
FIG. 2 is a longitudinal sectional view of an illustrative embodiment of the downhole bridge plugs, with the plug shown in a pre-expanded, well casing-disengaging configuration.
Figure 3A:
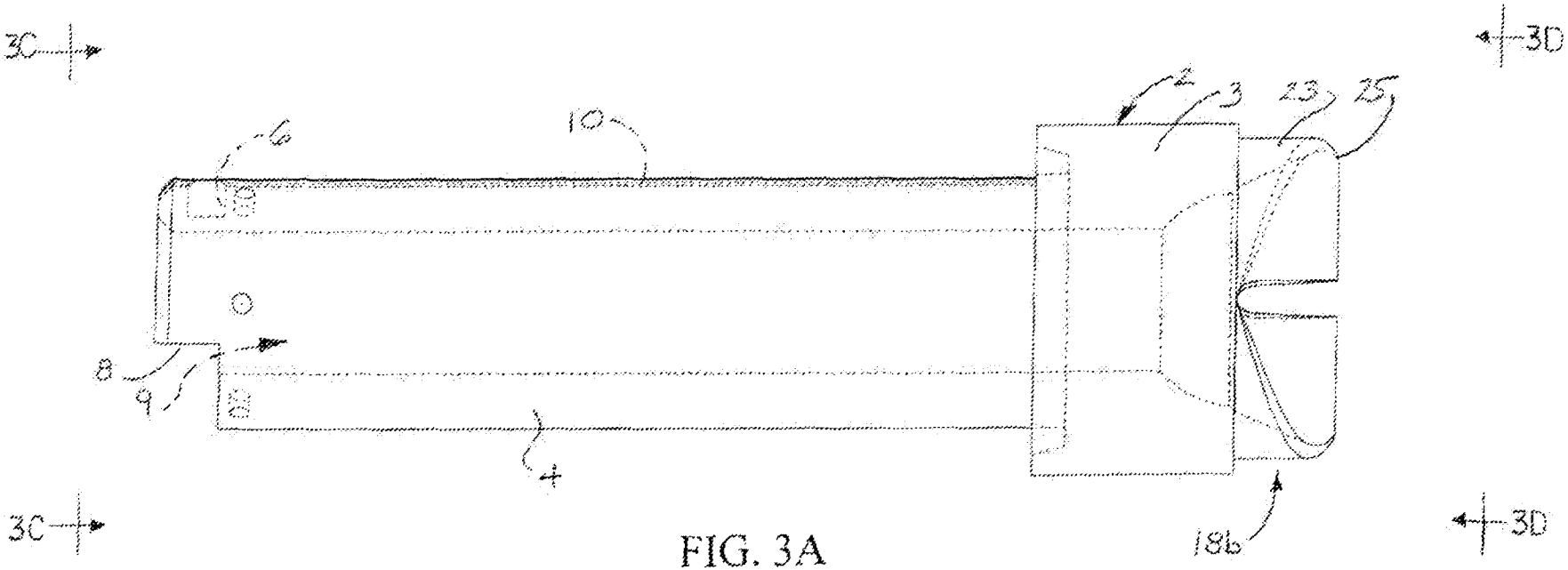
FIG. 3A is a side view of a typical mandrel of an illustrative embodiment of the downhole bridge plugs.
Figure 3B:
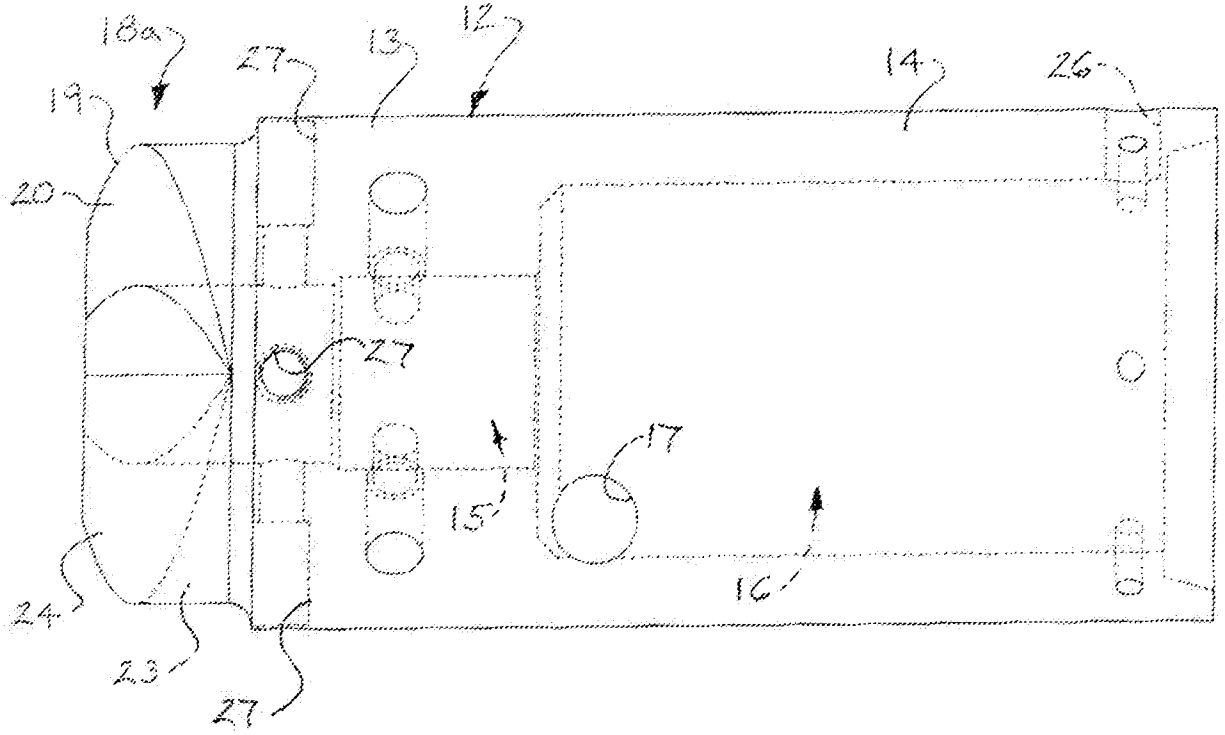
FIG. 3B is a side view of a typical mandrel cap or bottom sub of an illustrative embodiment of the downhole bridge plugs.
Figure 3D:
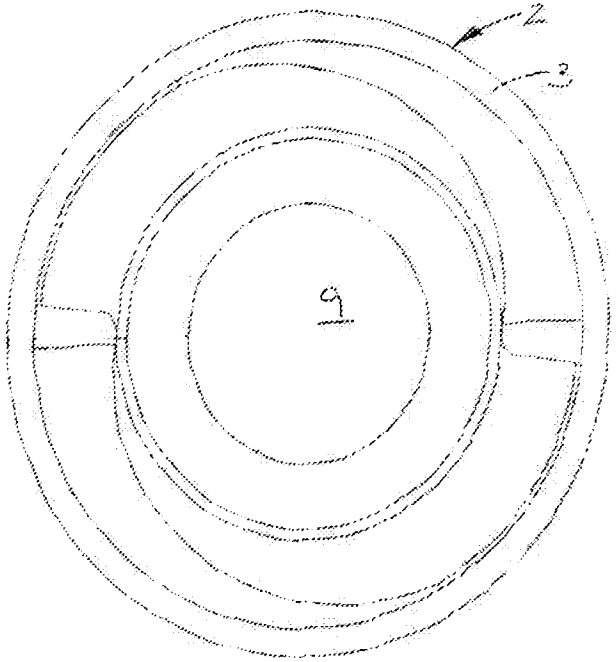
FIG. 3D is a rear view of the mandrel, taken along section lines 3D-3D in FIG. 3B.
Figure 3C:
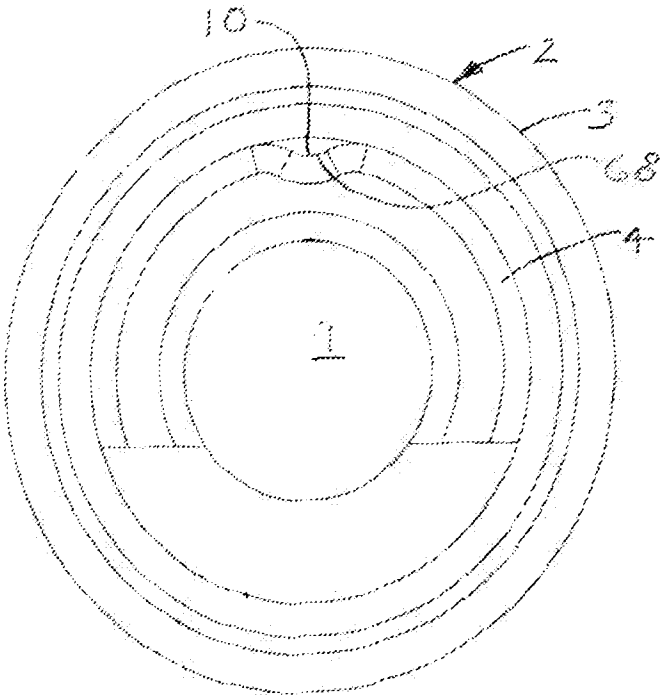
FIG. 3C is a front view of the mandrel, taken along viewing lines 3C-3C in FIG. 3A.

Referring initially to FIGS. 1-11, 19A-19C and 21-26 of the drawings, an illustrative embodiment of the downhole bridge plug is generally indicated by reference numeral 1. As illustrated in FIG. 2, the downhole bridge plug 1 may include a mandrel 2 which may include any suitable type of rigid drillable material including but not limited to metal, composite material and/or engineering-grade plastic. The mandrel 2 may have a mandrel base 3 which may be generally cylindrical in shape. A mandrel shaft 4, which may be generally elongated and cylindrical with a longitudinal mandrel shaft bore 9, may extend from the mandrel base 3. As illustrated in FIGS. 3A and 3C, a mandrel shaft groove 10 may extend into the exterior surface of the mandrel shaft 4, in parallel relationship to the longitudinal axis of the mandrel shaft 4, for purposes which will be hereinafter described. In some embodiments, the mandrel shaft groove 10 may be elongated and generally U-shaped in cross-section. The mandrel shaft groove 10 may extend along at least a portion of the length of the mandrel shaft 4. In typical application of the downhole bridge plug 1, which will be hereinafter described, a running-in tool 100 (FIGS. 19A-19C) may operably engage the mandrel 2 for purposes which will be hereinafter described. As illustrated in FIG. 2, in some embodiments, a pair of spaced-apart cone pin openings 5 may extend into the mandrel shaft 4 for purposes which will be hereinafter described.

As further illustrated in FIG. 2, a mandrel cap 12 may engage the mandrel shaft 4 of the mandrel 2. The mandrel cap 12 may include a mandrel cap base 13 which may be generally cylindrical. A mandrel cap wall 14 may extend from the mandrel cap base 13. A mandrel cap bore 15 may extend through the mandrel cap base 13. The mandrel cap wall 14 may form a mandrel cap interior 16 which communicates with the mandrel cap bore 15 of the mandrel cap base 13. In the assembled downhole bridge plug 1, the mandrel cap interior 16 may accommodate the mandrel shaft 4 of the mandrel 2. Accordingly, the mandrel cap 12 may be positional with respect to the mandrel 2 between a pre-expanded configuration illustrated in FIGS. 2 and 19A and an expanded configuration illustrated in FIG. 19C for purposes which will be hereinafter described.

Figure 19A:
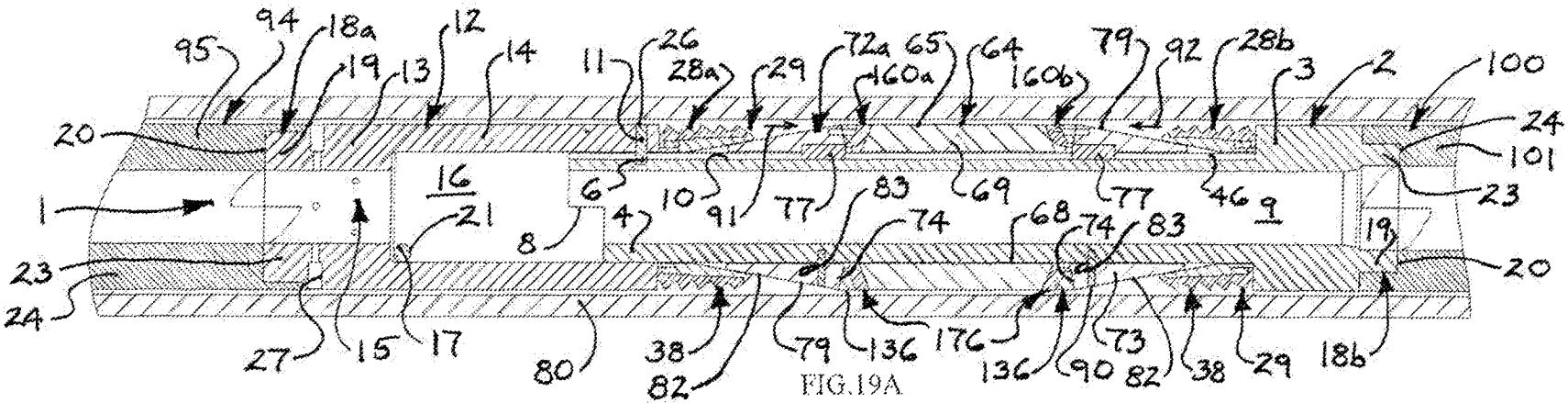
FIG. 19A is a longitudinal sectional view of the downhole bridge plug disposed in a well casing, with the lower cone, sealing element and upper cone disengaging the well casing in the pre-expanded configuration of the downhole bridge plug.
Figure 19B:
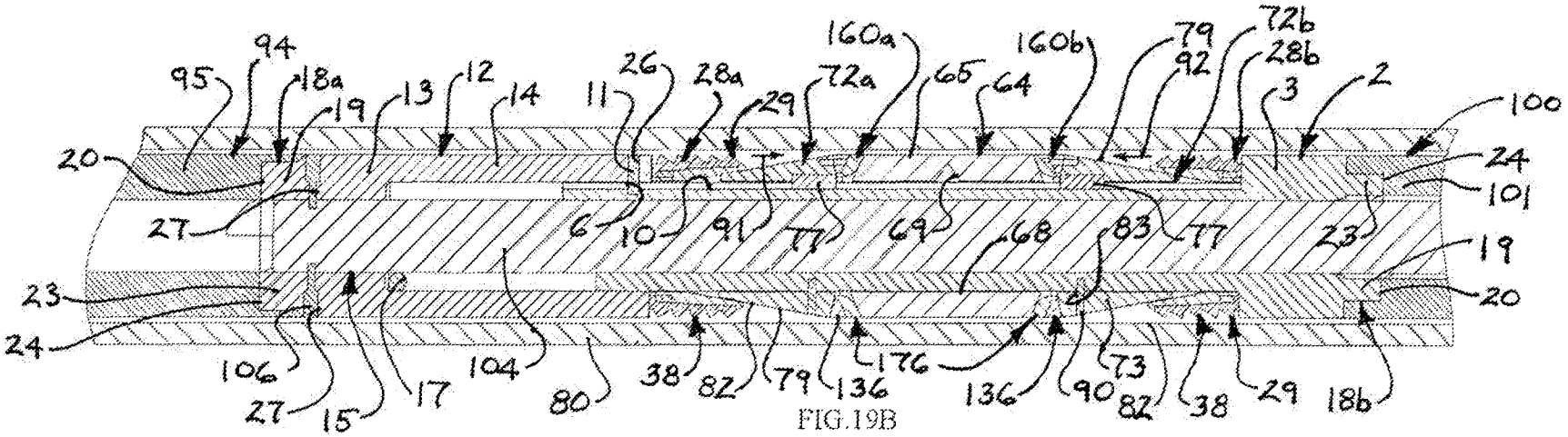
FIG. 19B is a longitudinal sectional view of the downhole bridge plug with a setting shaft deployed in place and coupled to the mandrel cap preparatory to deployment of the downhole bridge plug in the expanded configuration against the well casing.

As illustrated in FIGS. 19A and 19B, in some embodiments, at least one mandrel cap coupling pin 11 may normally couple the mandrel cap 12 to the mandrel shaft 4 of the mandrel 2. The mandrel cap coupling pin 11 may normally secure the mandrel cap 12 in the pre-expanded configuration with respect to the mandrel 2. Accordingly, the intact mandrel cap coupling pin 11 may normally extend through a mandrel cap pin opening 26 in the mandrel cap wall 14 of the mandrel cap 12 and through a registering mandrel pin opening 6 in the mandrel shaft 4 of the mandrel 2. Responsive to actuation of the running-in tool 100, as will be hereinafter described, the mandrel coupling pin 11 may be sheared as the mandrel shaft 4 is displaced in the mandrel cap interior 16 of the mandrel cap 12 from the pre-expanded configuration of FIG. 19A to the expanded configuration of FIG. 19C, for purposes which will be hereinafter described.

As illustrated in FIG. 2, in some embodiments, an anti-rotation pin slot 8 may be provided in the distal or extending end of the mandrel shaft 4 of the mandrel 2. An anti-rotation pin opening 17 may be provided in the mandrel cap wall 14 at the distal or extending end of the mandrel cap interior 16. An anti-rotation pin 21 may extend through the anti-rotation pin opening 17. The purpose of the anti-rotation pin slot 8, the anti-rotation pin opening 17 and the anti-rotation pin 21 will be hereinafter described.

The mandrel cap 12 may be configured for coupling to a lower tubing string 94 (FIGS. 19A-19C) according to any suitable technique which is known by those skilled in the art. As illustrated in FIGS. 1 and 2, in some embodiments, a mandrel cap lock 18*a* may extend from the mandrel cap 12. The mandrel cap lock 18*a* may include a curved or semi-circular major cam lock flange 19 having a curved major flange surface 20 which slopes away from the end of the mandrel cap base 13. A major flange tab 22 (FIG. 1) may extend from the major flange surface 20 at the extending or distal end of the major cam lock flange 19. A curved or semicircular minor cam lock flange 23 may extend from the mandrel base 3 in generally adjacent and diametrically-opposed relationship to the major cam lock flange 19. The minor cam lock flange 23 may have a generally curved minor flange surface 24. A minor flange tab 25 may extend from the minor flange surface 24 at the extending or distal end of the minor cam lock flange 23. As further illustrated in FIGS. 1 and 2, the major cam lock flange 19 may protrude beyond the minor cam lock flange 23.

A tubing string lock 95 (FIGS. 19A-19C) which is companion or complementary in design to the mandrel cap lock 18*a* may be provided on the lower tubing string 94. Accordingly, the mandrel cap 12 may be selectively coupled to the lower tubing string 94 by interlocking engagement of the mandrel cap lock 18*a* with the companion or complementary tubing string lock 95 on the lower tubing string 94. Alternative techniques known by those skilled in the art, including but not limited to threads, couplings and/or pins, may be used in addition to or instead of the mandrel cap lock 18*a* and the tubing string lock 95 to facilitate coupling of the mandrel cap 12 with the lower tubing string 94.

Figure 19C:
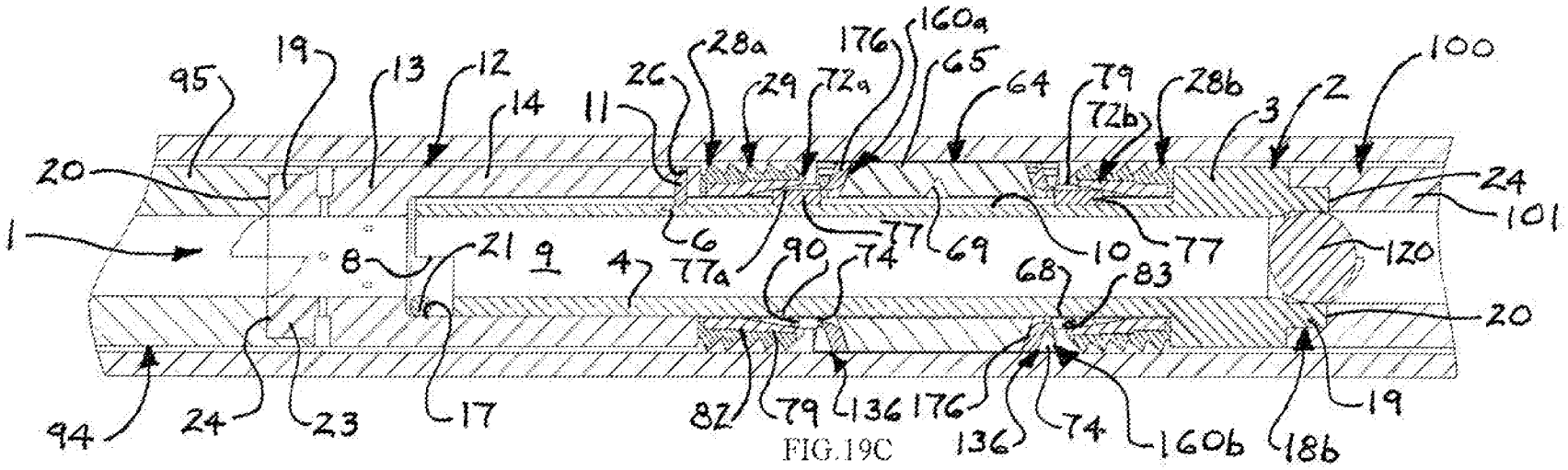
FIG. 19C is a longitudinal sectional view of the downhole bridge plug deployed in the expanded configuration and the lower cone, sealing element and upper cone engaging the well casing.

The mandrel 2 may be configured for coupling to the running-in tool 100 according to any suitable technique which is known by those skilled in the art. As illustrated in FIG. 2, in some embodiments, a tool lock 18*b* may extend from the mandrel base 3. The tool lock 18*b* may have a design which is the same as or similar to that of the mandrel cap lock 18*a*, with like numerals designating like components. A running-in tool lock 101 (FIGS. 19A-19C) which is companion or complementary in design to the tool lock 18*b* may be provided on the running-in tool 100. Accordingly, as illustrated in FIGS. 19A-19C, in typical application of the downhole bridge plug 1, which will be hereinafter described, the running-in tool 100 may be selectively coupled to the mandrel 2 by interlocking engagement of the running in tool lock 101 on the running-in tool 100 with the companion or complementary tool lock 18*b* on the mandrel base 3. The running-in tool 100 may be coupled to an upper tubing string (not illustrated) to facilitate placement and deployment of the assembly 1 in a well casing 80 in use of the assembly 1, as will be hereinafter described. Alternative techniques known by those skilled in the art, including but not limited to threads, couplings and/or pins, may be used in addition to or instead of the tool lock 18*b* and the running-in tool lock 101 to facilitate coupling of the mandrel 2 with the running-in tool 100.

A distal or lower pressure-applying element, such as an annular lower slip assembly 28*a* having a reinforcing ring 29, may be provided on the mandrel shaft 4 of the mandrel 2 adjacent to the mandrel cap 12. A proximal or upper pressure-applying element, such as an annular upper slip assembly 28*b*, also having a reinforcing ring 29, may be provided on the mandrel shaft 4 of the mandrel 2 generally adjacent to the mandrel base 3. An annular proximal or lower cone 72*a* may be provided on the mandrel shaft 4 in engagement with the lower slip assembly 28*a*. An annular distal or upper cone 72*b* may be provided on the mandrel shaft 4 in engagement with the upper slip assembly 28*b*. A lower backup ring 160*a* may be provided on the mandrel shaft 4 in engagement with the lower cone 72*a*. An upper backup ring 160*b* may be provided on the mandrel shaft 4 in engagement with the upper cone 72*b*. In some embodiments, each of the lower backup ring 160*a* and the upper backup ring 160*b* may have a structure which is the same as or similar to that described in U.S. patent application Ser. No. 14/794,890, filed Jul. 9, 2015 and entitled DOWNHOLE BRIDGE PLUG OR PACKER ASSEMBLIES, which patent application is incorporated by reference herein in its entirety.

Figure 22:
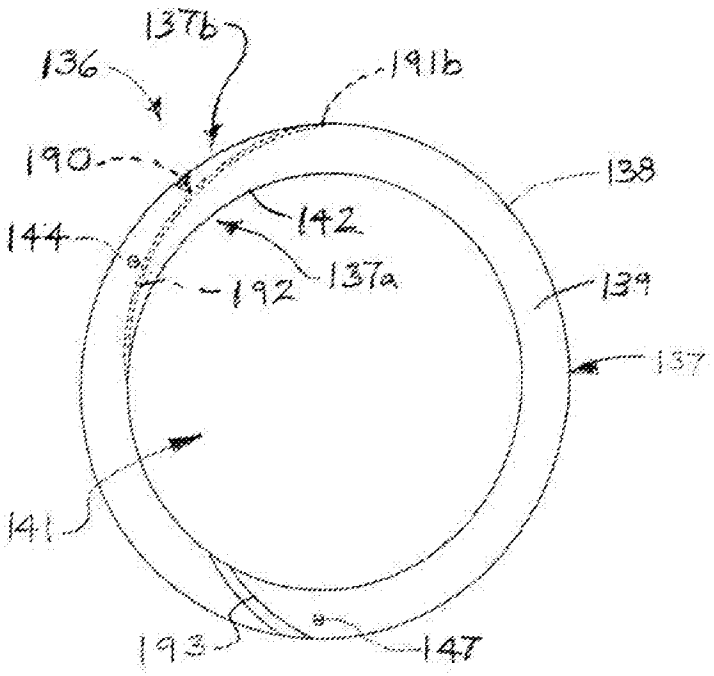
FIG. 22 is an outer surface view of the outer backup ring portion.
Figure 21:
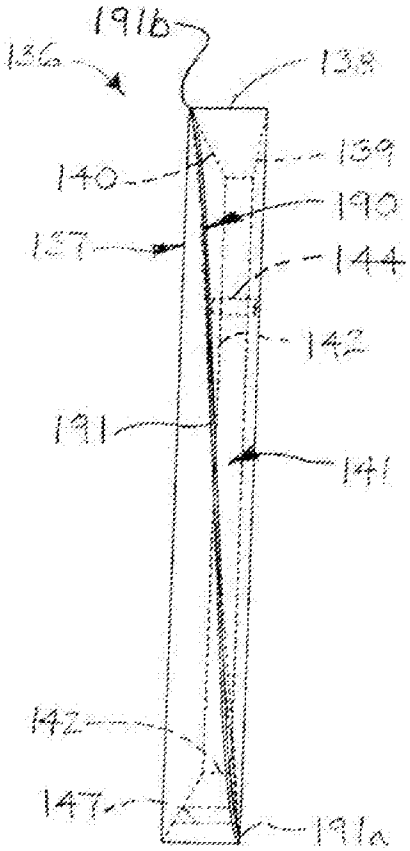
FIG. 21 is a side view of a typical outer backup ring portion of a backup ring suitable for implementation of the downhole bridge plug.
Figure 24:
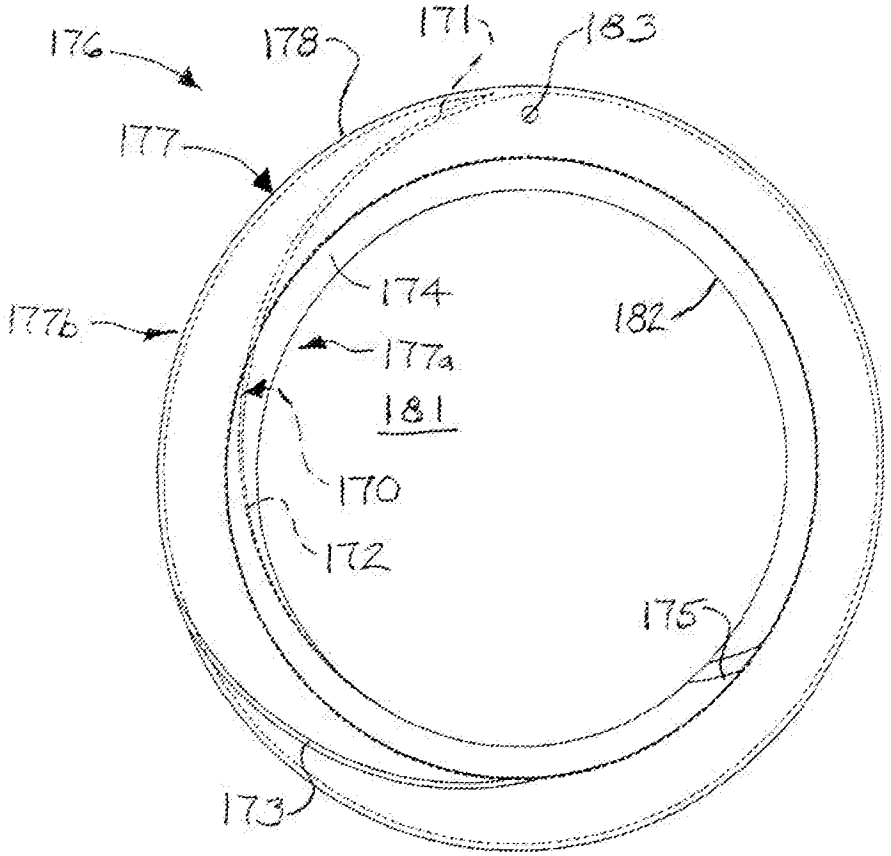
FIG. 24 is an outer surface view of the outer backup ring portion.
Figure 23:
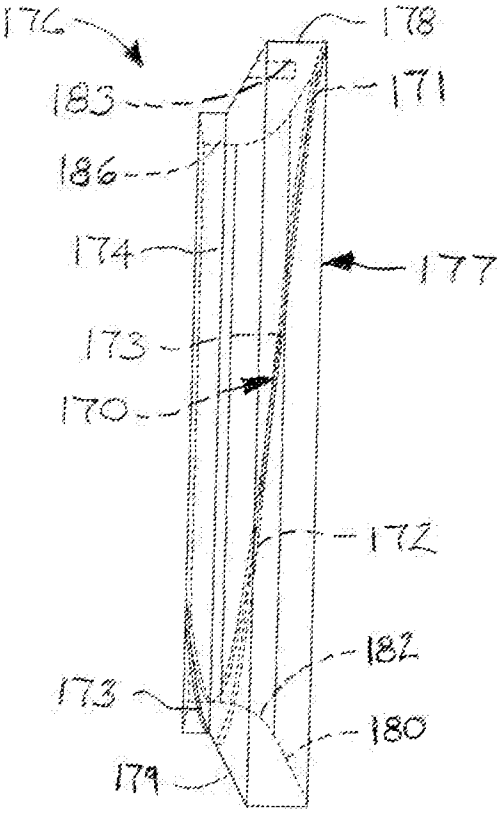
FIG. 23 is a side view of a typical inner backup ring portion of the backup ring.
Figure 25:
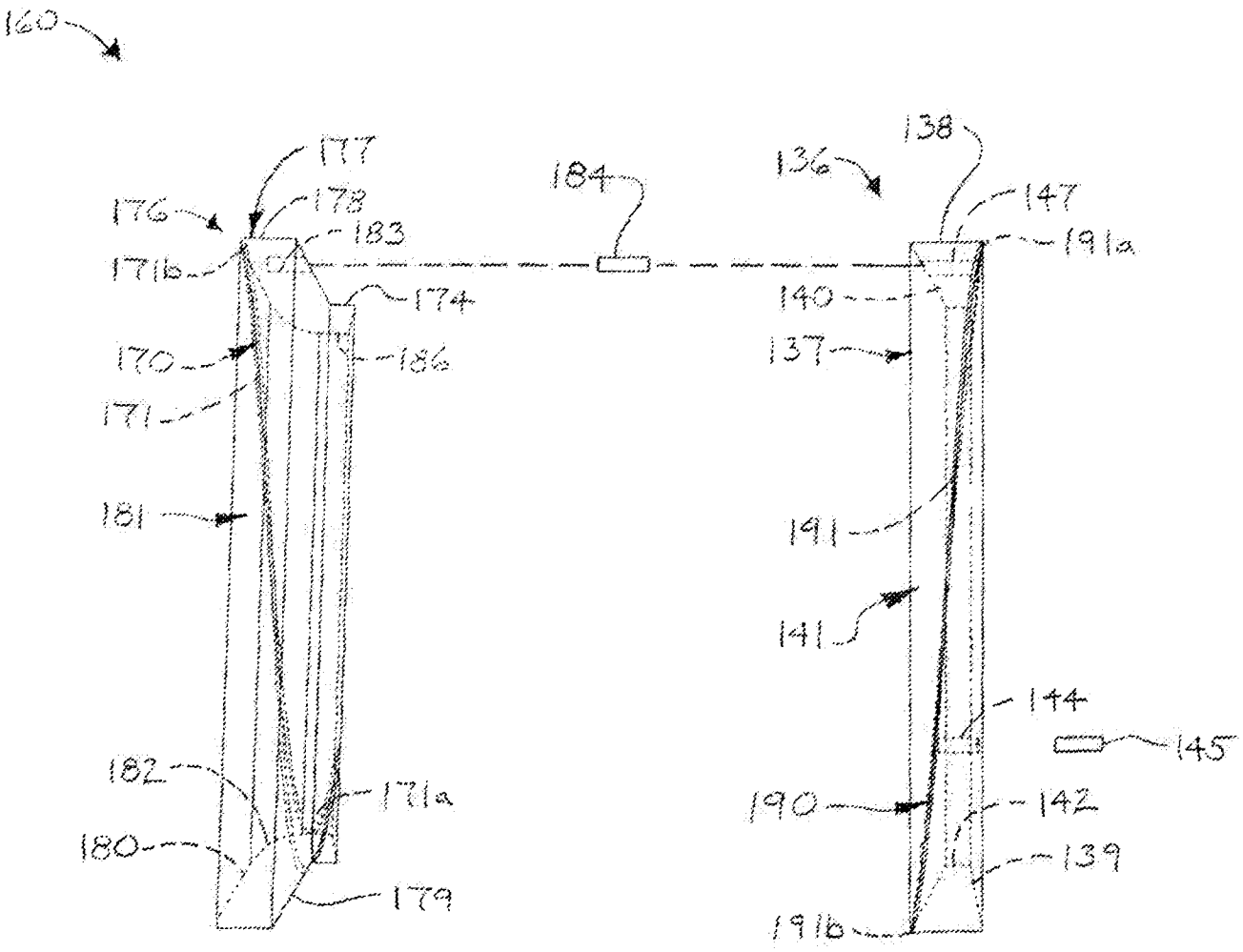
FIG. 25 is an exploded side view of the backup ring, more particularly illustrating typical pinning of the outer backup ring portion to the inner backup ring portion in assembly of the backup ring.

Referring next to FIGS. 21-26 of the drawings, a typical design for each of the lower backup ring 160*a* and the upper backup ring 160*b* (FIG. 2) is indicated by reference numeral 160 in FIG. 25. Each of the upper backup ring 160*a* and the lower backup ring 160*b* may include an outer backup ring portion 136 (FIGS. 21 and 22) and an inner backup ring portion 176 (FIGS. 23 and 24). The outer backup ring portion 136 may include an annular outer backup ring portion body 137 which may include rubber or other elastomeric material and through which extends a ring opening 141. In some embodiments, the outer backup ring portion body 137 may have a continuous unitary or one-piece construction and may include PEEK (polyether ether ketone), for example and without limitation. The outer backup ring portion body 137 may have an annular exterior engaging ring surface 138 and an annular ring opening edge 142 which encircles and faces the ring opening 141. As illustrated in FIG. 21, a beveled outer ring surface 139 and a beveled inner ring surface 140 may extend or taper inwardly toward each other from the exterior engaging ring surface 138 to the ring opening edge 142. In the assembled downhole bridge plug 1, the outer ring surface 139 of the upper backup ring 160*a* faces outwardly and is engaged by the corresponding upper cone 72*b*, whereas the outer ring surface 139 of the lower backup ring 160*b* faces outwardly and is engaged by the lower cone 72*a*. The inner ring surface 140 of the outer backup ring portion 136 of the upper backup ring 160*a* and the inner ring surface 140 of the outer backup ring portion 136 of the lower backup ring 160*b* face inwardly and engage the corresponding inner backup ring portion 176, as illustrated in FIG. 25.

As illustrated in FIG. 22, a single spiraled, multi-segmented ring groove 190 is provided in the outer backup ring portion body 137 of the outer backup ring portion 136 of each backup ring 160. As illustrated in FIG. 22, the ring groove 190 may divide the outer backup ring portion body 137 into an inner ring section 137*a* and an outer ring section 137*b*. Accordingly, responsive to outward pressure applied to the inner ring section 137*a*, the inner ring section 137*a* and the outer ring section 137*b* may be partially circumferentially expandable outwardly for purposes which will be hereinafter described. As used herein, "partially circumferentially outwardly" means that the inner ring section 137*a* and the outer ring section 137*b* may be expandable outwardly along a portion of the arc or curvature of the outer backup ring portion body 137, such as 180 degrees, for example and without limitation. The depth of the spiraled ring groove 190 may extend from the engaging ring surface 138 through part of the thickness of the outer backup ring portion body 137 to the inner ring surface 140. As illustrated in FIG. 21, the spiraled ring groove 190 may include an elongated main groove segment 191 which may be generally straight or axial in side view of the outer backup ring body 136 and extends along a portion of the circumference of the engaging ring surface 138; a generally curved inner surface groove segment 192 (FIG. 22) the length of which extends from the main groove segment 191 along a portion of the inner ring surface 140 to the ring opening edge 142; and a generally curved or straight outer surface groove segment 193 (FIG. 22) the length of which extends from the main groove segment 191 along a portion of the outer ring surface 139 to the ring opening edge 142. The main groove segment 191 may have an outer main groove segment end 191*a* (FIG. 21) at the outer ring surface 139 and an inner main groove segment end 191*b* (FIG. 22) at the inner ring surface 140. In some embodiments, from the outer main groove segment end 191*a* to the inner main groove segment end 191*b*, the main groove segment 191 may traverse about 180 degrees of the circumference of the engaging ring surface 138.

The inner surface groove segment 192 (FIG. 22) of the spiraled ring groove 190 may extend lengthwise from the engaging ring surface 138 to the ring opening edge 142. As particularly illustrated in FIG. 22, the inner surface groove segment 192 may be generally tangential with respect to both the engaging ring surface 138 and with respect to the ring opening edge 142. At the engaging ring surface 138, the inner surface groove segment 192 may communicate with the inner main groove segment end 191*b* of the main groove segment 191.

As further illustrated in FIG. 22, the outer surface groove segment 193 of the spiraled ring groove 190 may extend lengthwise from the engaging ring surface 138 to the ring opening edge 142. At the engaging ring surface 138, the outer surface groove segment 193 may communicate with the outer main groove segment end 191*a* (FIG. 21) of the main groove segment 191. Therefore, the main groove segment 191, the inner surface groove segment 192 and the outer surface groove segment 193 of the spiraled ring groove 190 may be contiguous with each other. As illustrated in FIG. 22, the spiraled ring groove 190 divides a portion of the outer backup ring portion body 137 into the inner ring section 137*a* and the circumferentially expandable outer ring section 137*b*. Accordingly, application of outwardly-directed pressure to the inner ring section 137*a* of the outer backup ring portion body 137 facilitates uniform outward circumferential expansion of the expandable outer ring section 137*b* from the inner ring section 137*a*, for purposes which will be hereinafter described.

At least one retainer pin opening 144 may extend into the outer ring surface 139 of the outer backup ring portion body 137. As illustrated in FIG. 25, a shear-able ring retainer pin 145 may be seated in the retainer pin opening 144 and in a corresponding registering pin opening 75 (FIG. 4B) in the corresponding adjacent lower cone 72*a* or upper cone 72*b*. The ring retainer pin 145 may normally retain the upper backup ring 160*a* and the lower backup ring 160*b* in the pre-expanded configuration during installation of the downhole bridge plug 1 in the well casing 52 and prior to expansion of the downhole bridge plug 1.

As illustrated in FIG. 25, at least one outer coupling retainer pin opening 147 may extend through the outer backup ring body portion 137 from the outer ring surface 139 to the inner ring surface 140 of the outer backup ring portion 136. As illustrated in FIG. 22, the outer coupling retainer pin opening 147 may be disposed about 120 degrees relative to the retainer pin opening 144. As further illustrated in FIG. 25, a coupling retainer pin 184 may be inserted in and may extend through the outer coupling retainer pin opening 147. The coupling retainer pin 184 may couple the outer backup ring portion 136 to the inner backup ring portion 176 of each backup ring 160, typically as will be hereinafter described. The coupling retainer pin 184 may prevent premature expansion of the corresponding upper backup ring 160*a* and lower backup ring 160*b* as well as maintain proper orientation of the outer backup ring portion 136 and the inner backup ring portion 176 relative to each other in the upper backup ring 160*a* and the lower backup ring 160*b*.

In some embodiments, at least one fluid emission channel (not illustrated) may extend into the engaging ring surface 138 of the outer backup ring portion body 137. The fluid emission channel may traverse the width of the outer backup ring portion body 137 from the outer ring surface 139 to the inner ring surface 140. The fluid emission channel may facilitate emission of fluids from the outer backup ring portion body 137 upon expansion of the downhole bridge plug 1.

As illustrated in FIGS. 23 and 24, the inner backup ring portion 176 of each backup ring 160 may include an annular inner backup ring portion body 177 which may include rubber and/or other elastomeric material. In some embodiments, the inner backup ring portion body 177 may have a continuous unitary or one-piece construction and may include PEEK (polyether ether ketone), for example and without limitation. A ring opening 181 that registers with the ring opening 141 (FIGS. 21 and 22) of the outer backup ring portion 136 extends through the inner backup ring portion body 177. The inner backup ring portion body 177 may have an annular exterior engaging ring surface 178 and an annular interior ring opening edge 182 which faces the ring opening 181. A beveled inner backup ring surface 180 (FIG. 23) may extend or taper from the exterior engaging ring surface 178 to the ring opening edge 182 in the ring opening 181. A beveled annular outer ring surface 179 may extend or taper from the engaging ring surface 178. An annular ring lip 174 may protrude from the outer ring surface 179. A beveled annular ring opening surface 186 may extend from the ring opening edge 182 through the ring lip 174 and faces the ring opening 181. In the assembled downhole bridge plug 1, the outer ring surface 179 of the inner backup ring portion 176 faces outwardly and is engaged by the inner ring surface 140 of the outer backup ring portion 136, as illustrated in FIG. 25, whereas the inner backup ring surface 180 of the inner backup ring portion 176 faces inwardly and engages the sealing element 64 (FIG. 2).

A single spiraled ring groove 170 extends along the inner backup ring portion body 177 of the inner backup ring portion 176. As illustrated in FIG. 24, the spiraled ring groove 170 may divide the backup ring body 177 into an inner ring section 177*a* and an outer ring section 177. Accordingly, responsive to outward pressure applied to the inner ring section 177*a*, the inner ring section 177*a* and the outer ring section 177*b* may be partially circumferentially expandable outwardly for purposes which will be hereinafter described. As used herein. "partially circumferentially outwardly" means that the inner ring section 177*a* and the outer ring section 177*b* may be expandable outwardly along a portion of the arc or curvature of the backup ring body 177, such as 180 degrees, for example and without limitation. The spiraled ring groove 170 may include a main groove segment 171 which extends along the engaging ring surface 178, an inner surface groove segment 172 which extends from the main groove segment 171 along the inner backup ring surface 180, an interior groove segment 175 (FIG. 24) which extends from the inner surface groove segment 172 along the ring opening surface 186 and an outer surface groove segment 173 which extends along the outer ring surface 179 from the interior groove segment 175 back to the main groove segment 171. As illustrated in FIG. 23, the main groove segment 171 of the spiraled ring groove 170 may be generally straight or axial in side view of the inner backup ring portion 176 and extends along a portion of the circumference of the engaging ring surface 178.

The inner surface groove segment 172 of the spiraled ring groove 170 may be generally curved and extends lengthwise from the main groove segment 171 along a portion of the inner backup ring surface 180 to the ring opening surface 186. As particularly illustrated in FIG. 24, the inner surface groove segment 172 may be generally tangential with respect to both the engaging ring surface 178 and the ring opening edge 182.

The outer surface groove segment 173 of the spiraled ring groove 170 may be generally curved and extends lengthwise from the inner surface groove segment 172 along a portion of the outer ring surface 179 and may terminate at the ring lip 174.

Figure 16:
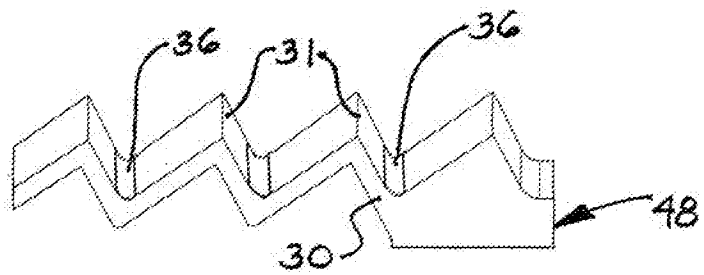
FIG. 16 is a side perspective view of the ring section.
Figure 14:
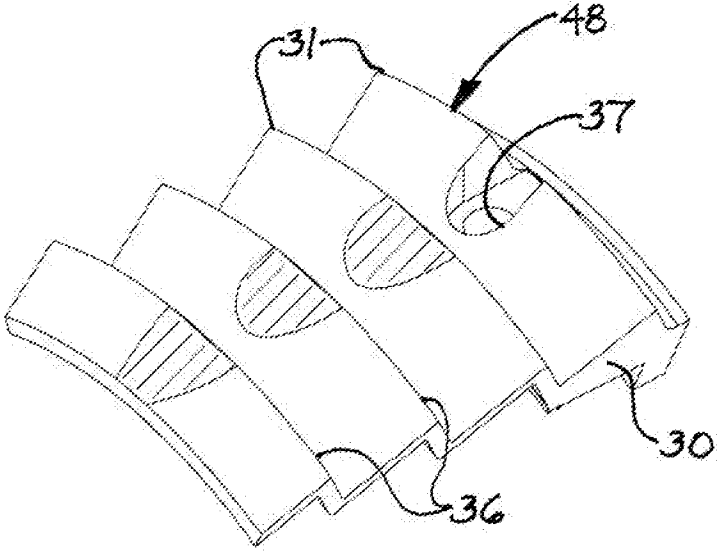
FIG. 14 is an outer perspective view of a typical ring section of the multi-sectioned reinforcing ring.

The interior groove segment 175 of the spiraled ring groove 170 may extend lengthwise from the outer surface groove segment 173 along the ring opening surface 186 from the inner surface groove segment 172 in the inner backup ring surface 180 to the outer surface groove segment 173 at the ring lip 174. In some embodiments, the main groove segment 171, the inner surface groove segment 172, the outer surface groove segment 173 and the interior groove segment 175 of the spiraled ring groove 170 may be contiguous with each other and may traverse about 180 degrees of the circumference of the inner backup ring portion body 177. Accordingly, as illustrated in FIG. 24, the spiraled ring groove 170 divides a portion of the inner backup ring portion body 177 into the inner ring section 177*a* and the expandable outer ring section 177*b*. Therefore, application of outwardly-directed pressure to the backup ring body 177 facilitates uniform outward circumferential expansion of the expandable outer ring section 177*b* from the inner ring section 177*a* against the well casing 152 (FIG. 16) to seal adjacent fractions from each other, as was heretofore described.

As illustrated in FIGS. 23 and 24, at least one inner coupling retainer pin opening 183 may extend into the beveled outer ring surface 179 of the inner backup ring portion body 177. As illustrated in FIG. 24, the inner coupling retainer pin opening 183 may be disposed generally at or near the junction where the inner surface groove segment 172 of the spiraled ring groove 170 meets the engaging ring surface 178 of the inner backup ring portion body 177.

Figure 26:
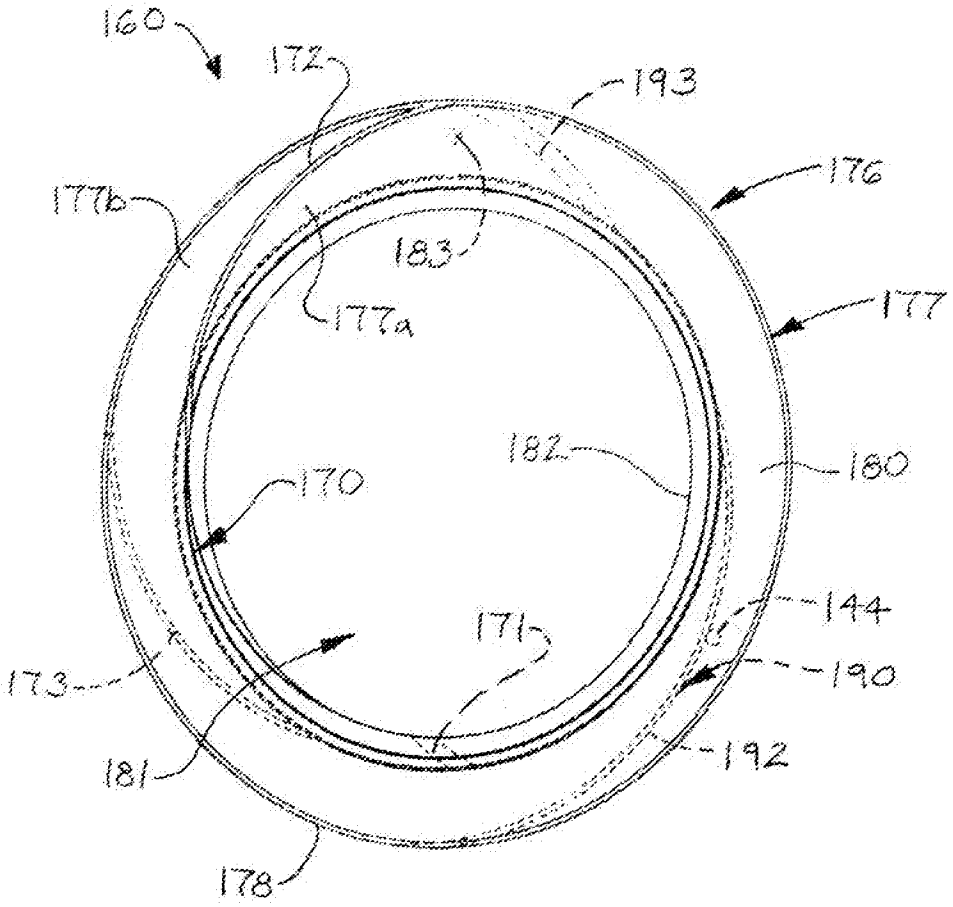
FIG. 26 is an inner surface view of the backup ring.
Figure 27:
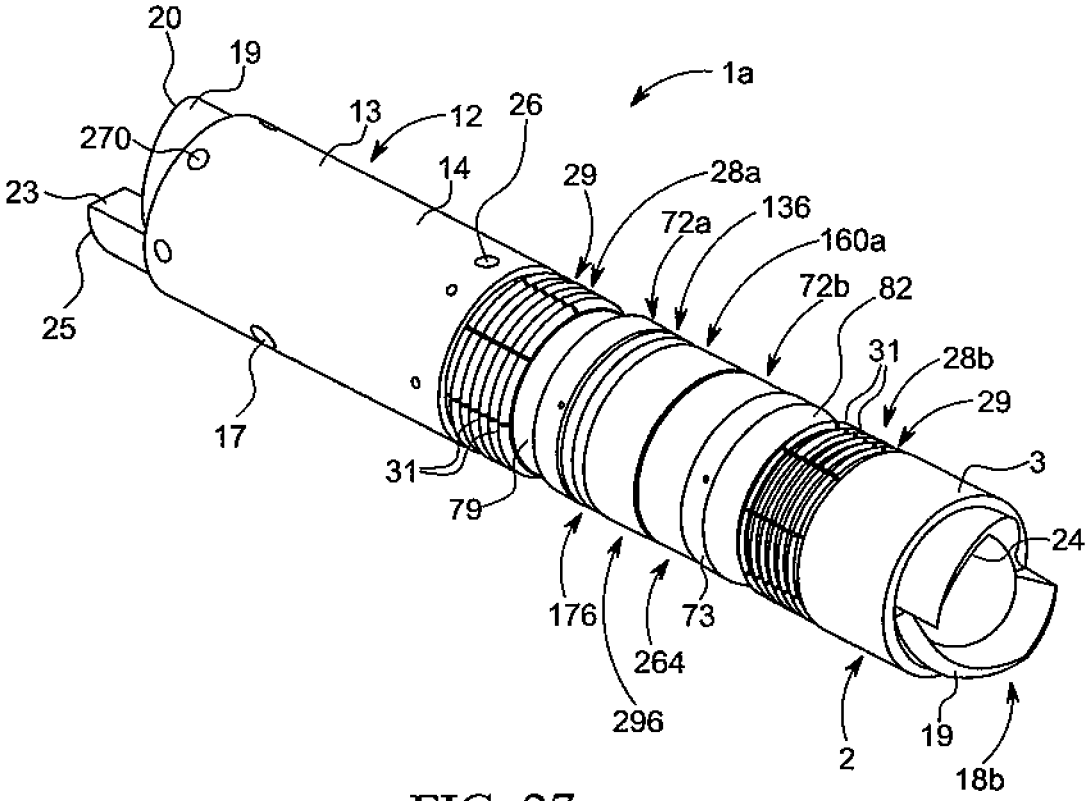
FIG. 27 is a perspective view of an alternative illustrative embodiment of the downhole bridge plugs.

As illustrated in FIG. 25, each backup ring 160 may be assembled by initially orienting the outer backup ring portion 136 and the inner backup ring portion 176 such that the beveled outer ring surface 179 on the inner backup ring portion 176 faces the complementary inner ring surface 140 on the outer backup ring portion 136. The outer backup ring portion 136 and/or the inner backup ring portion 176 is rotated until the outer coupling retainer pin opening 147 in the outer backup ring portion 136 aligns or registers with the companion inner coupling retainer pin opening 183 in the inner backup ring portion 176. The ring lip 174 on the outer backup ring portion 176 is inserted through the ring opening 141 of the outer backup ring portion 136 as the beveled outer ring surface 179 on the inner backup ring portion 176 engages the companion beveled inner ring surface 140 on the outer backup ring portion 136. Accordingly, as illustrated in FIG. 26, the spiraled ring groove 170 in the inner backup ring portion 176 traverses approximately a first half of the backup ring 160, whereas the spiraled ring groove 190 in the outer backup ring portion 136 traverses approximately a second half of the backup ring 160. Therefore, in the assembled lower backup ring 160*a* and upper backup ring 160*b*, the outer backup ring portion 136 may be oriented about 180 degrees relative to the inner backup ring portion 176 such that the spiral ring groove 190 of the outer backup ring portion 136 does not overlap the spiral ring groove 170 of the inner backup ring portion 176, as further illustrated in FIG. 26. The coupling retainer pin 184 maintains the outer backup ring portion 136 in position relative to the inner backup ring portion 176.

Figure 5:
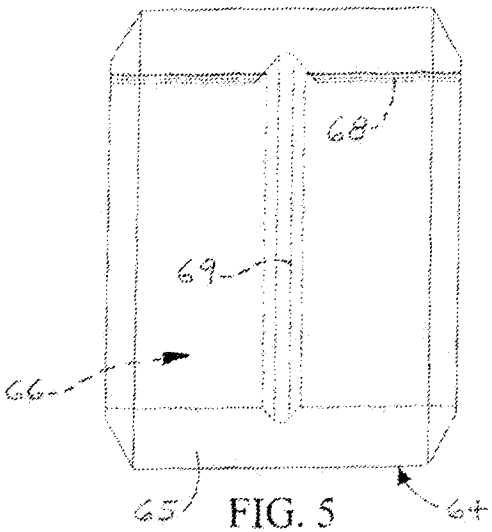
FIG. 5 is a side view of a typical sealing element of the downhole bridge plugs.
Figure 6:
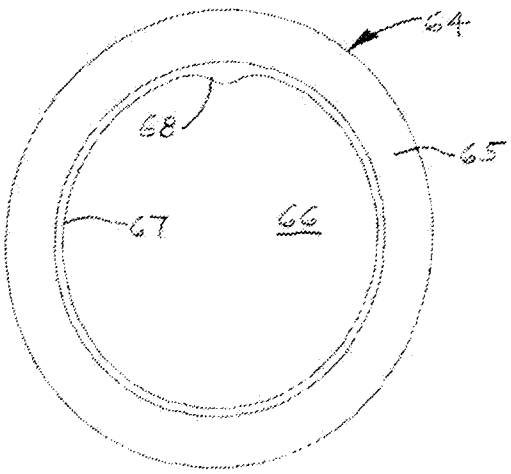
FIG. 6 is an end view of the sealing element.

As illustrated in FIG. 2, an annular sealing element 64, which will be hereinafter described, may be provided on the mandrel shaft 4 between the lower backup ring 160*a* and the upper backup ring 160*b*. In some embodiments, the sealing element 64 may include rubber and/or other elastomeric material. As illustrated in FIGS. 5 and 6, in some embodiments, the sealing element 64 may include a generally cylindrical sealing element wall 65 which defines a longitudinal sealing element bore 66. A sealing element interior surface 67 of the sealing element wall 65 may face the sealing element bore 66. A longitudinal sealing element ridge 68 may protrude from the sealing element interior surface 67 into the sealing element bore 66. The longitudinal sealing element ridge 68 may traverse at least a portion of the length of the sealing element 64. The longitudinal sealing element ridge 68 may have a cross-sectional size and shape which are generally complementary to the cross-sectional size and shape of the mandrel shaft groove 10 (FIG. 3) in the mandrel shaft 4 of the mandrel 2. Accordingly, as illustrated in FIG. 2, when the sealing element 64 is placed on the mandrel shaft 4, the sealing element ridge 68 inserts into the companion mandrel shaft groove 10 (FIGS. 3A and 3C) to prevent rotation of the sealing element 64 relative to the mandrel 2 for purposes which will be hereinafter described. As illustrated in FIG. 5, in some embodiments, a circumferential sealing element notch 69 may extend into the sealing element interior surface 67. The sealing element ridge 68 may include a pin, bump, key or any other type of protuberance which extends from, engages or extends into the sealing element interior surface 67 and inserts into the mandrel shaft groove 10.

Figure 4A:
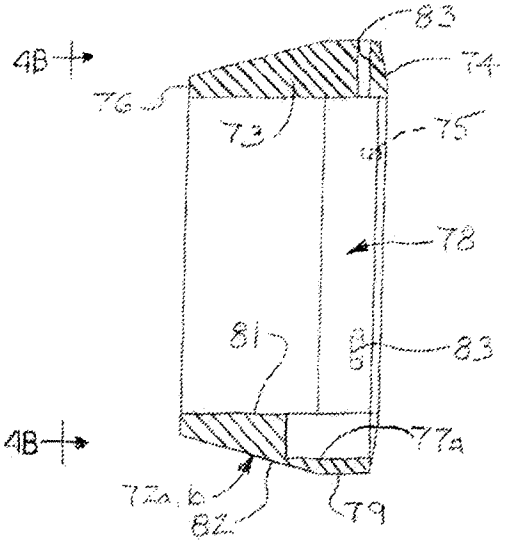
FIG. 4A is a longitudinal sectional view of a typical cone element for a slip assembly of an illustrative embodiment of the downhole bridge plugs.
Figure 4B:
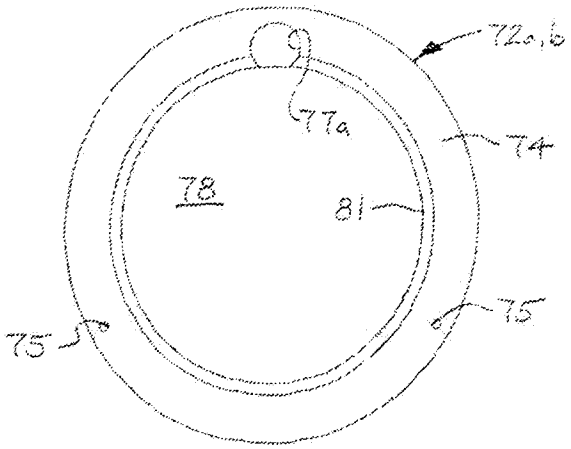
FIG. 4B is an end view, taken along viewing lines 4B-4B in FIG. 4A, of the cone element for the slip assembly.

A typical design for each of the lower cone 72*a* and the upper cone 72*b* is indicated by reference numeral 72*a, b* in FIGS. 4A and 4B. The lower cone 72*a* and the upper cone 72*b* may have the same or similar design. The cones 72*a*, 72*b* may include a generally conical cone wall 73. The cone wall 73 may define a longitudinal cone bore 78. The cone wall 73 may have a tapered inner cone wall surface 74, a straight outer cone wall surface 76, and a straight cone wall surface 79 and a tapered cone wall surface 82 which extend from the inner cone wall surface 74 to the outer cone wall surface 76. An annular straight interior cone wall surface 81 may extend from the inner cone wall surface 74 to the outer cone wall surface 76 in facing relation to the cone bore 78. A longitudinal cone pin opening 77*a* may extend into the interior cone wall surface 81 of the cone wall 73 in facing and communicating relationship to the cone bore 78. The cone pin opening 77*a* may traverse at least a portion of the length of the cone 72*a*, 72*b*. As illustrated in FIG. 4A, in some embodiments, at least one radial cone pin opening 83 may extend through the cone wall 73 for purposes which will be hereinafter described.

As illustrated in FIG. 2, when each of the lower cone 72*a* and the upper cone 72*b* is placed on the mandrel shaft 4, a cone pin 77 may insert into and may be glued and/or otherwise secured in the cone pin opening 77*a* in the corresponding lower cone 72*a* or upper cone 72*b*, and the cone pin 77 may insert into the companion mandrel shaft groove 10 (FIGS. 3A and 3C) in the exterior surface of the mandrel shaft 4 of the mandrel 2 to prevent rotation of the lower cone 72*a* and the upper cone 72*b* relative to the mandrel 2, for purposes which will be hereinafter described. As further illustrated in FIG. 2, the inner cone wall surface 74 of the lower cone 72*a* may engage the outer backup ring portion 136 of the adjacent lower backup ring 160*a*. Likewise, the inner cone wall surface 74 of the upper cone 72*b* may engage the outer backup ring portion 136 of the adjacent upper backup ring 160*b*. As illustrated in FIGS. 4A and 4B, in some embodiments, multiple pin openings 75 may extend into the inner cone wall surface 74 of each of the lower cone 72*a* and the upper cone 72*b*. Registering pin openings (not illustrated) may extend into the facing outer surface in the outer backup ring portion 136 of the lower backup ring 160*a* and upper backup ring 160*b*, respectively. A ring retainer pin 145 (FIG. 2) may insert into the pin opening 75 (FIGS. 4A and 4B) in the corresponding lower cone 72*a* and the upper cone 72*b* and the interfacing retainer pin opening 144 (FIGS. 21 and 25) in the outer ring surface 139 of the outer backup ring portion 136 of the corresponding lower backup ring 160*a* and upper backup ring 160*b* to secure the lower backup ring 160*a* to the lower cone 72*a* and the upper backup ring 160*b* to the upper cone 72*b*. As illustrated in FIGS. 2 and 19A, in some embodiments, a cone pin 90 may be extended through the cone pin opening 83 (FIG. 4A) in the cone wall 73 of each of the lower cone 72*a* and the upper cone 72*b* and into the corresponding registering cone pin opening 5 (FIG. 3) in the mandrel shaft 4 of the mandrel 2 to secure the lower cone 72*a* and the upper cone 72*b* on the mandrel shaft 4. The cone pin 77 may include a pin, bump, key or any other type of protuberance which extends from, engages or extends into the corresponding lower cone 72*a* or upper cone 72*b* and inserts into the mandrel shaft groove 10.

Figure 9:
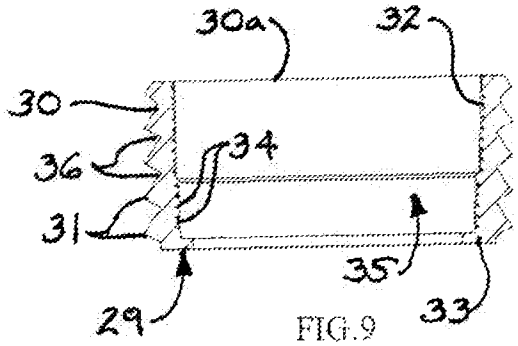
FIG. 9 is a cross-sectional view of the reinforcing ring.
Figure 7:
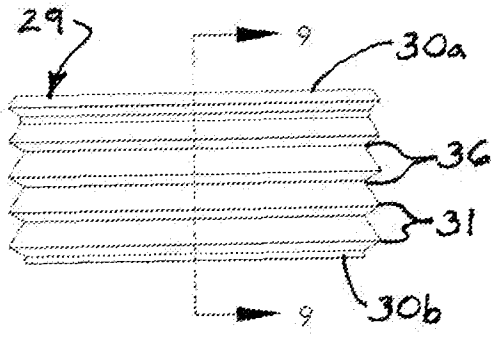
FIG. 7 is a side view of a typical reinforcing ring of each slip assembly.
Figure 8:
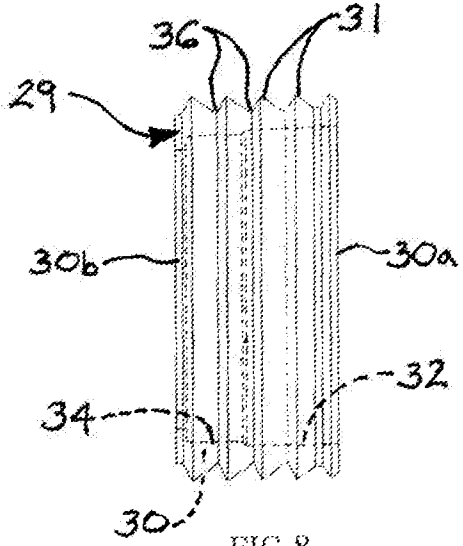
FIG. 8 is a side view of the reinforcing ring with interior components of the reinforcing ring illustrated in phantom.
Figure 11:
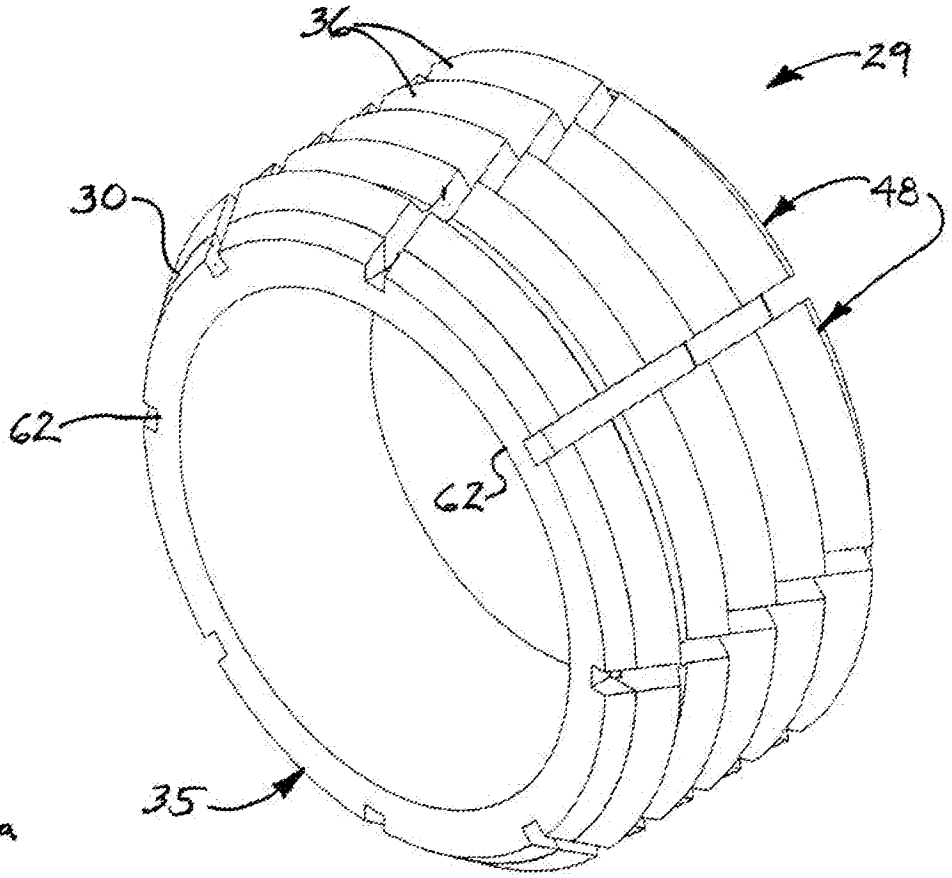
FIG. 11 is a perspective view of the reinforcing ring and ring insert.
Figure 10:
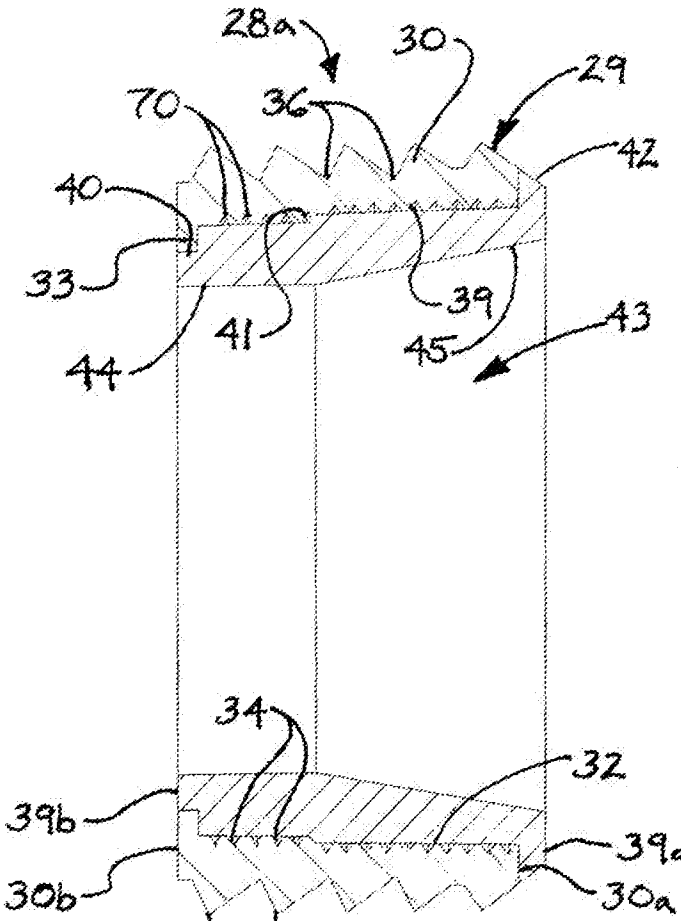
FIG. 10 is a cross-sectional view of the reinforcing ring of the slip assembly with a typical ring insert seated in and threadably attached to the reinforcing ring.

As illustrated in FIGS. 7-9, the reinforcing ring 29 of each of the lower slip assembly 28*a* and the upper slip assembly 28*b* may include an annular reinforcing ring wall 30 which may be generally cylindrical and forms a reinforcing ring bore 35 (FIG. 9). In some embodiments, the reinforcing ring wall 30 may be a continuous, one-piece construction, as illustrated in FIGS. 7 and 8. In other embodiments, the reinforcing ring wall 30 may be divided into multiple adjacent ring sections 48, connected by at least one frangible connection 62, as illustrated in FIG. 11 and will be hereinafter further described. As illustrated in FIG. 10, the reinforcing ring wall 30 may have an inner reinforcing ring wall end 30*a* and an outer reinforcing ring wall end 30*b*. Multiple adjacent, spaced-apart, concentric ring ridges 31 may protrude from an exterior surface of the reinforcing ring wall 30. Concentric ring grooves 36 may be defined between the adjacent ring ridges 31. An annular ring shoulder 32 may be provided in an interior surface of the reinforcing ring wall 30 at the inner reinforcing ring wall end 30*a*. An annular ring flange 33 may protrude from the interior surface of the reinforcing ring wall 30 at the outer reinforcing ring wall end 30*b*. Ring threads 34 (FIG. 9) may protrude from the interior surface of the reinforcing ring wall 30 adjacent to the ring flange 33.

As illustrated in FIG. 10, a ring insert 38 may be inserted in the ring bore 35 of the reinforcing ring 29. In some embodiments, the ring insert 38 may include a ring insert wall 39 having an inner ring insert wall end 39*a* and an outer ring insert wall end 39*b*. The ring insert wall 39 may have a straight insert wall portion 44 which extends from the outer ring insert wall end 39*b* and a tapered wall portion 45 which extends from the straight wall portion 44 to the inner ring insert wall end 39*a*. The ring insert wall 39 may form a ring insert interior 43. An annular ring insert flange 42 may protrude outwardly from the inner ring insert wall end 39*a* of the ring insert wall 39. The ring insert flange 42 may engage the inner reinforcing ring wall end 30*a* of the reinforcing ring wall 30 in meshing relation to the ring shoulder 32 of the reinforcing ring 29. An annular flange receiving groove 40 may be provided in the outer reinforcing ring wall end 39*b* of the ring insert wall 39. The flange receiving groove 40 may receive the companion ring flange 33 on the reinforcing ring 29. The reinforcing ring 29 may threadably engage the ring insert 38 at the ring threads 34 (FIG. 9). A lip receiving groove 41 may be provided in the outer surface of the ring insert wall 39 adjacent to the flange receiving groove 40. Ring insert threads 70 may be provided in the lip receiving groove 41 and along the exterior length of the ring insert wall 39. As illustrated in FIG. 10, the ring insert threads 70 may mesh with companion ring threads 34 provided in the interior surface of the ring wall 30 of each reinforcing ring 29 to secure the reinforcing ring 29 on the ring insert 38. In some embodiments, the ring insert threads 70 may be provided along substantially the entire exterior length of the ring insert wall 39 and the ring threads 34 may be provided along substantially the entire length of the ring wall 30 of the reinforcing ring 29. In some embodiments, a bonding resin (not illustrated) may be applied to the ring threads 34 and the ring insert threads 70 and cured to achieve a strong bond between the reinforcing ring 29 on the ring insert 38. In some embodiments, the ring insert 38 may include a composite material and/or other non-metallic drillable material which is consistent with the functional requirements of the slip assemblies 28*a*, 28*b*.

Figure 13:
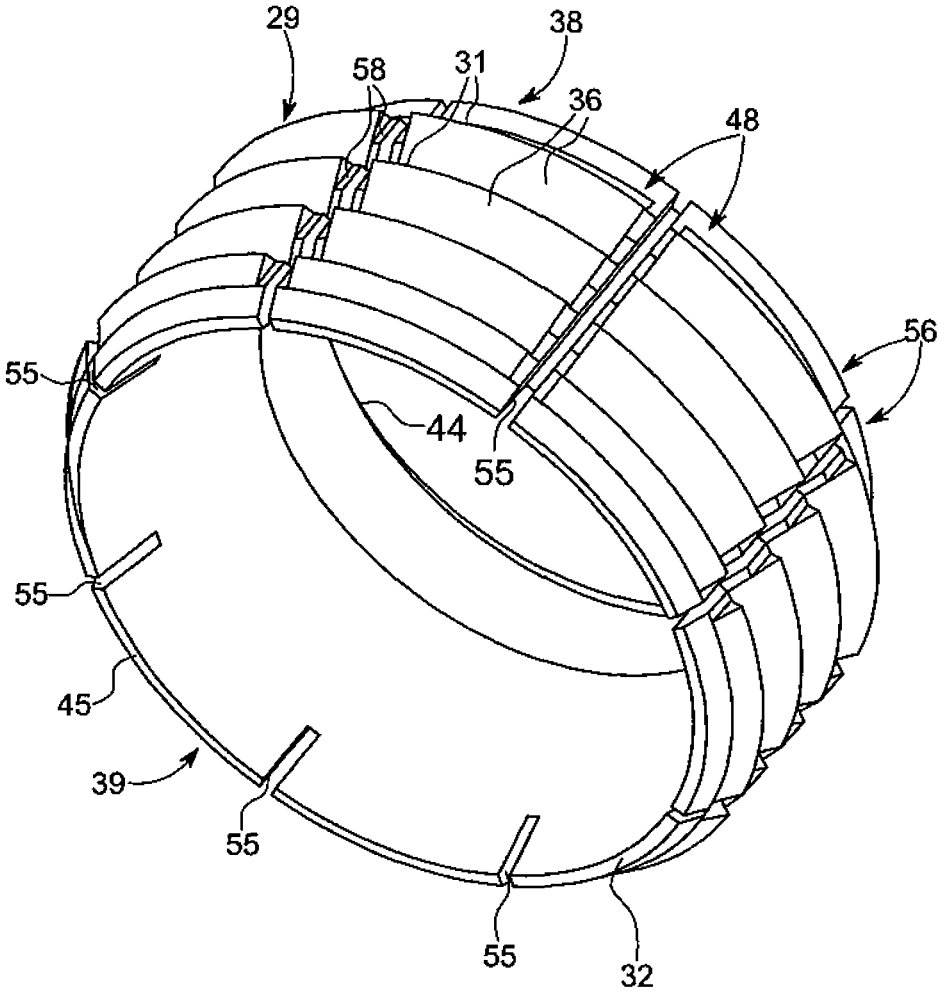
FIG. 13 is a perspective view of the multi-sectioned reinforcing ring with a molded ring insert and multiple ring sections on the ring insert in typical fabrication of the molded ring insert.
Figure 15:
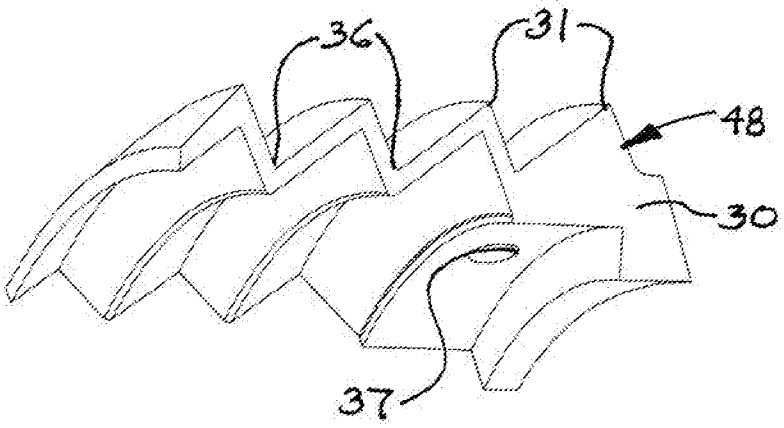
FIG. 15 is an inner perspective view of the ring section.

The reinforcing ring 29 may be fabricated using a conventional injection-molding process, which will be hereinafter described. The reinforcing ring 29 may include any suitable type of rigid drillable material including but not limited to metal, composite material and/or engineering-grade plastic. For example and without limitation, in some embodiments, the reinforcing ring 29 may include cast iron. After it is cured, the sectioned reinforcing ring 29 may be removed from the mold (not illustrated). As illustrated in FIGS. 11 and 13, the sectioned reinforcing ring 29 may include multiple, adjacent ring sections 48, each of which corresponds to a radial portion of the reinforcing ring 29. Each ring section 48 may include multiple ring ridges 31 and intervening ring grooves 36 between the ring ridges 31.

In typical application, the downhole bridge plug 1 may be used as a permanent packer, a retrievable packer or a drillable plug, for example and without limitation. The upper slip assembly 28*b* may be placed on the mandrel shall 4 of the mandrel 2, typically by extending the mandrel shaft 4 through the ring insert interior 43 (FIG. 10) of the ring insert 38, until the outer ring wall end 30*b* on the ring wall 30 of the reinforcing ring 29 engages the mandrel base 3 of the mandrel 2. The upper cone 72*b* may then be placed on the mandrel shalt 4. The cone pin 77 (FIG. 2) may be inserted in the cone pin opening 77*a* (FIG. 4A) in the upper cone 72*b* and in the mandrel shaft groove 10 (FIGS. 3A and 3C) to prevent rotation of the upper cone 72*b* on the mandrel 2. The outer backup ring portion 136 of the upper backup ring 160*b* may then be placed on the mandrel shaft 4, and the ring retainer pins 145 may be inserted in the respective pin openings 75 (FIG. 4B) in the inner cone wall surface 74 of the upper cone 72*b* and the respective registering retainer pin openings 144 (FIG. 21) in the outer ring surface 139 of the outer backup ring portion 136. The inner backup ring portion 176 of the upper backup ring 160*b* may be placed on the mandrel shaft 4 against the outer backup ring portion 136.

Next, the sealing element 64 may be placed on the mandrel 2 by inserting the mandrel shaft 4 of the mandrel 2 through the sealing element bore 66 (FIG. 6) until the sealing element 64 engages the inner backup ring portion 176 of the upper backup ring 160*b*. As illustrated in FIG. 2, the sealing element ridge 68 provided on the sealing element 64 may simultaneously be inserted into and slid along the mandrel shaft groove 10 (FIGS. 3A and 3C) provided in the mandrel shaft 4 of the mandrel 2. The inner backup ring portion 176 of the lower backup ring 160*a* may next be placed on and slid along the mandrel shaft 4 against the sealing element 64, and the outer backup ring portion 136 of the lower backup ring 160*a* may be placed on and slid along the mandrel shaft 4 against the inner backup ring portion 176.

The lower cone 72*a* may be placed on the mandrel shaft 4 of the mandrel 2. The lower cone 72*a* may be slid along the mandrel shaft 4 until the inner cone wall surface 74 of the cone wall 73 engages the outer backup ring portion 136 of the lower backup ring 160*a*. The ring retainer pins 145 may be inserted in the respective pin openings 75 (FIG. 48) in the inner cone wall surface 74 of the lower cone 72*a* and the respective registering retainer pin openings 144 (FIG. 25) in the outer backup ring portion 136. The cone pin 90 may be extended through the cone pin opening 83 (FIG. 4A) in the cone wall 73 of each of the lower cone 72*a* and the upper cone 72*b* and into the corresponding registering cone pin opening 5 (FIG. 2) in the mandrel shaft 4 of the mandrel 2.

The lower slip assembly 28*a* may be placed on the mandrel shaft 4, typically by extending the mandrel shaft 4 through the ring insert interior 43 (FIG. 10) of the ring insert 38, and sliding the lower slip assembly 28*a* along the mandrel shaft 4 until the ring insert 38 receives and engages the tapered cone wall surface 82 of the cone wall 73 of the lower cone 72*a*. The mandrel cap 12 may then be pinned to the mandrel shaft 4 of the mandrel 2 by inserting the mandrel coupling pin or pins 11 (FIGS. 19A-19C) through the respective mandrel cap pin opening or openings 26 in the mandrel cap wall 14 of the mandrel cap 12 and the registering mandrel pin opening or openings 6 in the mandrel shaft 4 of the mandrel 2.

The running-in tool 100 (FIGS. 19A-19C) may be coupled to the mandrel base 3 of the mandrel 2 typically by interlocking the running-in tool lock 101 on the running-in tool 100 with the companion tool lock 18*b* on the mandrel base 3. In like manner, the lower tubing string 94 may be coupled to the mandrel cap 12 typically by interlocking the tubing string lock 95 on the lower tubing string 94 with the companion mandrel cap lock 18*a* on the mandrel cap 12. An upper tubing string (not illustrated) may be coupled to the running-in tool 100 typically by threading, pinning and/or other suitable technique known by those skilled in the art.

As illustrated in FIGS. 19A-19C, in typical application, the downhole bridge plug 1 may be placed in a well casing 80 which extends into a subterranean fluid-producing well (not illustrated) such as an oil and/or gas well, for example and without limitation, between two adjacent production fractions in the well to seal the fractions from each other and prevent flow of fluid between the fractions. Accordingly, the upper tubing string may be inserted in the well casing 80 with the running-in tool 100 and the mandrel 2 coupled thereto, the mandrel cap 12 coupled to the mandrel shaft 4 of the mandrel 2 typically via the mandrel coupling pin or pins 11 and the lower tubing string 94 coupled to the mandrel cap 12. In some applications, the well casing 80 may be oriented in a vertical position in the well in which case the lower slip assembly 28*a*, the lower cone 72*a* and the lower backup ring 160*a* may be oriented beneath the sealing element 64 and the upper slip assembly 28*b*, the upper cone 72*b* and the upper backup ring 160*b* may be oriented above the sealing element 64. In other applications, the well casing 80 may be oriented in a horizontal or diagonal position.

Deployment of the downhole bridge plug 1 from the pre-expanded to the expanded configuration may be as follows. As illustrated in FIG. 199B, a setting shaft 104 may be inserted through the mandrel shaft bore 9 of the mandrel shaft 4 and through the mandrel cap interior 16 and into the mandrel cap bore 15 of the mandrel cap 12. One or more shaft pins 106 may be extended through one or more shaft pin openings 27 in the mandrel cap bore 13 of the mandrel cap 12 and into one or more respective registering shaft pin openings (not numbered) in the setting shaft 104. A hydraulic setting tool (not illustrated), which may be conventional, may next be operated to pull the setting shaft 104, which in turn pulls the mandrel cap 12 along the mandrel shaft 4 such that the mandrel cap 12 impinges against the lower slip assembly 28*a* as the mandrel coupling pin or pins 11 is/are sheared. This action pushes the lower slip assembly 28*a* onto the lower cone 72*a*, as indicated by the arrow 91 in FIG. 19A. Simultaneously, the running-in tool 100 may push the upper slip assembly 28*b* onto the upper cone 72*b*, as indicated by the arrow 92 in FIG. 19A. Therefore, the lower cone 72*a* pushes or expands the lower slip assembly 28*a* outwardly until the ring ridges 31 on the reinforcing ring 29 of the lower slip assembly 28*a* and the lower backup ring 160*a* engage the interior surface of the well casing 80. In like manner, the upper cone 72*b* pushes or expands the upper slip assembly 28*b* outwardly until the ring ridges 31 on the reinforcing ring 29 of the upper slip assembly 28*b* and the upper backup ring 160*b* engage the interior surface of the well casing 80. The sealing element 64 is compressed between the lower backup ring 160*a* and the upper backup ring 160*b* and expands circumferentially outwardly to engage the interior surface of the well casing 80. In some applications, the frangible connection 62 (FIG. 11) between adjacent ring sections 48 of each reinforcing ring 29 may break as the ring sections 48 are wedged away from each other on the respective lower cone 72*a* and upper cone 72*b*. As each cone pin 90 is sheared, as illustrated in FIG. 19C, the lower cone 72*a* and the upper cone 72*b* travel along the mandrel 2 against the lower backup ring 160*a* and the upper backup ring 160*b*, respectively. This action compresses the sealing element 64, the lower backup ring 160*a* and the upper backup ring 160*b* between the lower slip assembly 28*a* and the upper slip assembly 28*b*. Consequently, the sealing element 64 circumferentially expands outwardly and engages the interior surface of the well casing 80, forming a fluid-tight seal between the downhole bridge plug 1 and the well casing 80. The lower slip assembly 28*a*, the lower backup ring 160*a*, the upper backup ring 160*b* and the upper slip assembly 28*b* may expand outwardly and engage the interior surface of the well casing 80, reinforcing and preventing movement of the sealing element 64 as pressure is subsequently placed on the downhole bridge plug 1 during well operations. The lower cone 72*a* applies outward pressure against the beveled outer backup ring surface 139 (FIG. 25) on the outer backup ring portion 136 of the lower backup ring 160*a*, and the upper cone 72*b* likewise applies outward pressure against the beveled outer backup ring surface 139 on the outer backup ring portion 136 of the upper backup ring 160*b*. Consequently, the inner ring section 137*a* (FIG. 22) and the outer ring section 137*b* of the outer backup ring portion 136 expand partially circumferentially outwardly to engage the interior surface of the well casing 80, as illustrated in FIG. 19C. In like manner, the sealing element 64 applies outward pressure against the beveled inner backup ring surface 180 (FIG. 25) on the inner backup ring portion 176 of each of the lower backup ring 160*a* and the upper backup ring 160*b*. Consequently, the inner ring section 177*a* (FIG. 24) and the outer ring section 177*b* of the inner backup ring portion 176 expand partially circumferentially outwardly to engage the interior surface of the well casing 80. The reinforcing ring 29 of each of the lower slip assembly 28*a* and the upper slip assembly 28*b* engages the well casing 80 with a grip strength greater than that which can be attained using conventional slip assembly designs. As further illustrated in FIG. 19C, a ball 120 may be dropped down the tubing string and onto a ball seat (not numbered) in the mandrel base 3 of the mandrel 2 to seal the portion of the well casing 80 below or distal to the downhole bridge plug 1. Fracking and/or other operations may then be carried out on the reservoir sections which are above or proximal to the downhole bridge plug 1.

In some applications, when removal of the downhole bridge plug 1 from the well casing 80 is desired, a drill bit or milling cutter (not illustrated) may be inserted through the well casing 80 and operated to grind the downhole bridge plug 1 into fragments according to the knowledge of those skilled in the art. It will be appreciated by those skilled in the art that during drilling or cutting of the downhole bridge plug 1, the mandrel 2 is locked in place with the sealing element 64 and each of the lower backup ring 160*s*, the upper backup ring 160*b*, the lower cone 72*a* and the upper cone 72*b*, since the sealing element ridge 68 (FIG. 6) on the sealing element 64 and the cone pin 77 (FIG. 2) in the cone pin opening 77*a* of each of the lower cone 72*a* and the upper cone 72*b* protrude into the mandrel shaft groove 10 (FIG. 3A) in the mandrel shaft 4 of the mandrel 2. As illustrated in FIG. 19C, in the expanded configuration of the downhole bridge plug 1, the anti-rotation pin slot 8 in the distal or extending end of the mandrel shaft 4 receives the anti-rotation pin 21 in the anti-rotation pin opening 17 of the mandrel cap wall 14. This expedient prevents rotation of the mandrel 2 and the mandrel cap 12 relative to each other during cutting of the downhole bridge plug 1. Therefore, because the mandrel 2 does not spin with the milling cutter or drill bit, speed and efficiency in cutting and removal of the downhole bridge plug 1 from the well casing 80 is enhanced. In some applications, the downhole bridge plug 1 may be used with a permanent packer or a retrievable packer.

It will be appreciated by those skilled in the art that the typically one-piece solid construction between the mandrel base 3 and the mandrel shaft 4 of the mandrel 2 enhances the structural strength and integrity of the downhole bridge plug 1. Thus, the mandrel base 3 applies the typically downward pressure against the upper slip assembly 28*b* as the setting shaft 104 applies the mandrel cap 12 with the typically upward pressure against the lower slip assembly 28*a* with sufficient force to ensure maximum longitudinal compression, radial expansion and exertion of the sealing element 64 against the interior surface of the well casing 80. Therefore, an optimum fluid-tight seal against the well casing 80 is ensured throughout deployment of the downhole bridge plug 1.

Figure 12:
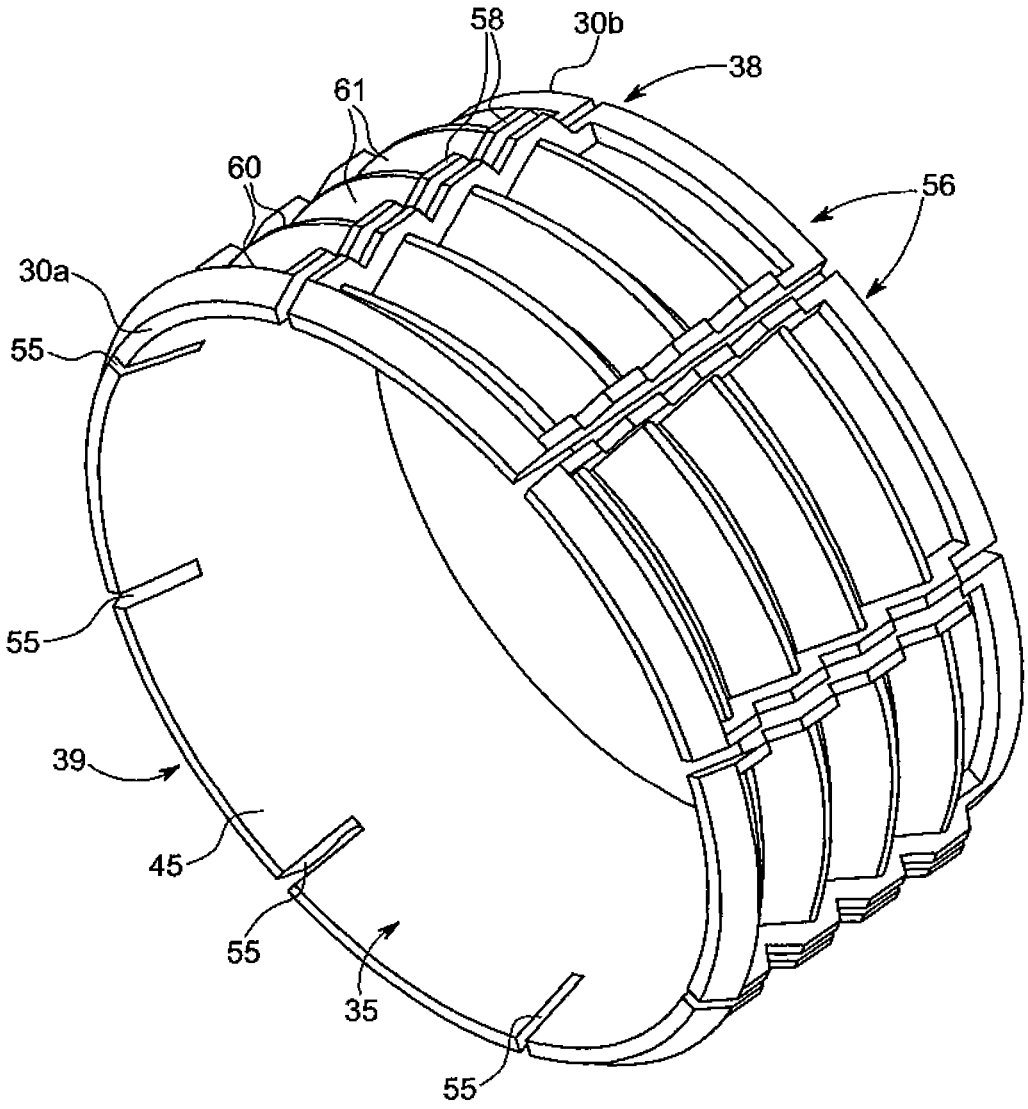
FIG. 12 is a perspective view of a typical molded ring insert of a multi-sectioned reinforcing ring.

Referring next to FIGS. 11-18B of the drawings, in some embodiments, the reinforcing ring 29 of each of the lower slip assembly 28*a* and the upper slip assembly 28*b* may be multi-sectional and may be fabricated using an injection molding process. As illustrated in FIG. 12, multiple wall slots 55 may be provided in the tapered wall portion 45 of the ring insert wall 39. The wall slots 55 may partially divide the mold body wall 52 into multiple adjacent mold sections 56. A pair of spaced-apart insert partitions 58 may extend along opposite edges of each ring section 56. Insert cavities 116 (FIG. 17) may be formed by and between the adjacent insert partitions 58. Multiple, adjacent insert ring ridges 60 may extend between the insert partitions 58 in the insert cavity 116 of each insert section 56. Insert ring grooves 61 may extend between the adjacent insert ring ridges 60.

As illustrated in FIGS. 11 and 14-16, the sectioned reinforcing ring 29 may include multiple, adjacent ring sections 48, each of which corresponds to a radial portion of the reinforcing ring 29. Each ring section 48 may include a ring wall 30 having multiple ring ridges 31 and intervening ring grooves 36 between the ring ridges 31.

The sectioned reinforcing ring 29 may be fabricated by initially fabricating the ring sections 48 typically by injection molding. The ring sections 48 may then be placed in an injection mold (not illustrated) for fabrication of the ring insert 38. In some embodiments, the ring sections 48 may be attached to the injection mold by extending 6 fasteners (not illustrated) through respective fastener openings 37 (FIG. 14) in the respective ring sections 48 and threading the fasteners into respective fastener openings (not illustrated) in the mold.

Figure 17:
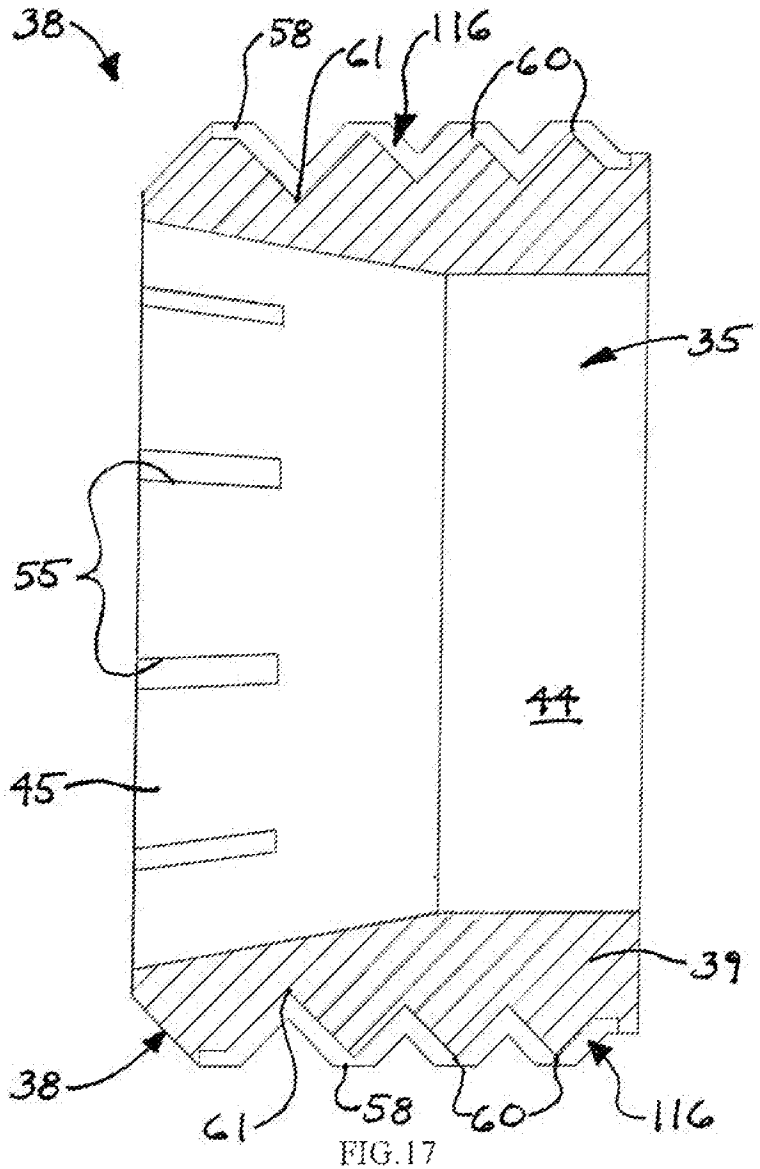
FIG. 17 is a longitudinal sectional view of the molded ring insert.
Figure 18A:
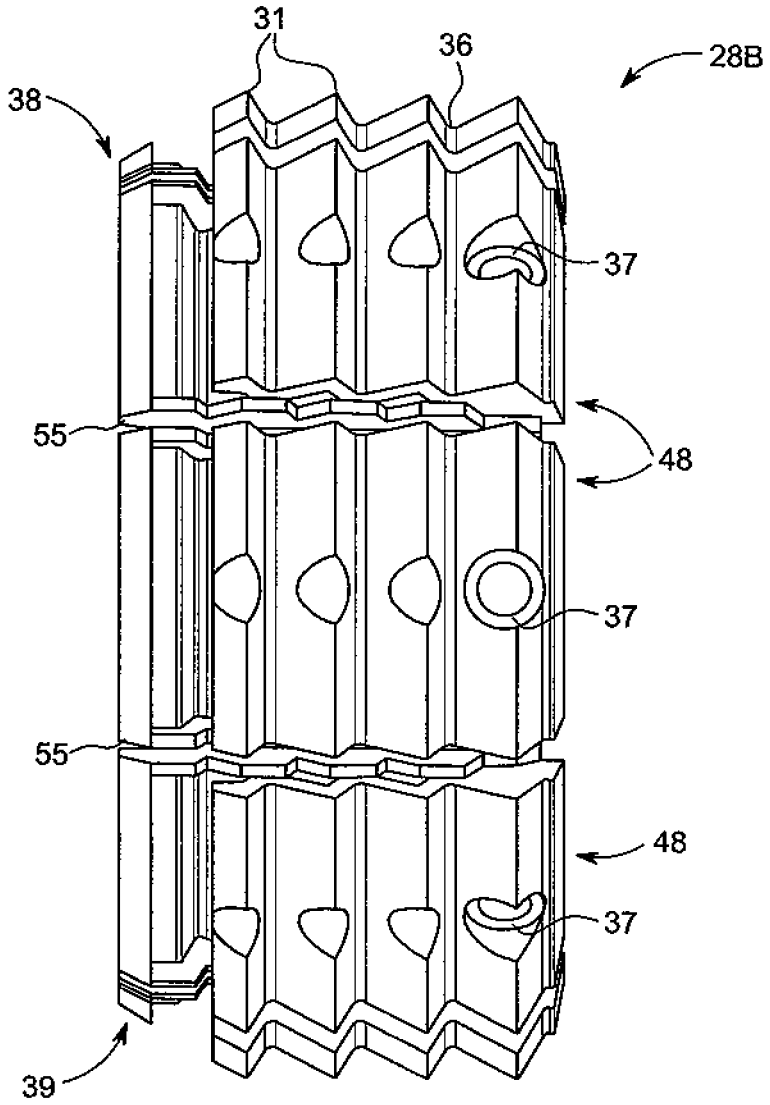
FIG. 18A is an exploded side view of the multi-sectioned reinforcing ring with the molded ring insert and ring sections on the ring insert.
Figure 18B:
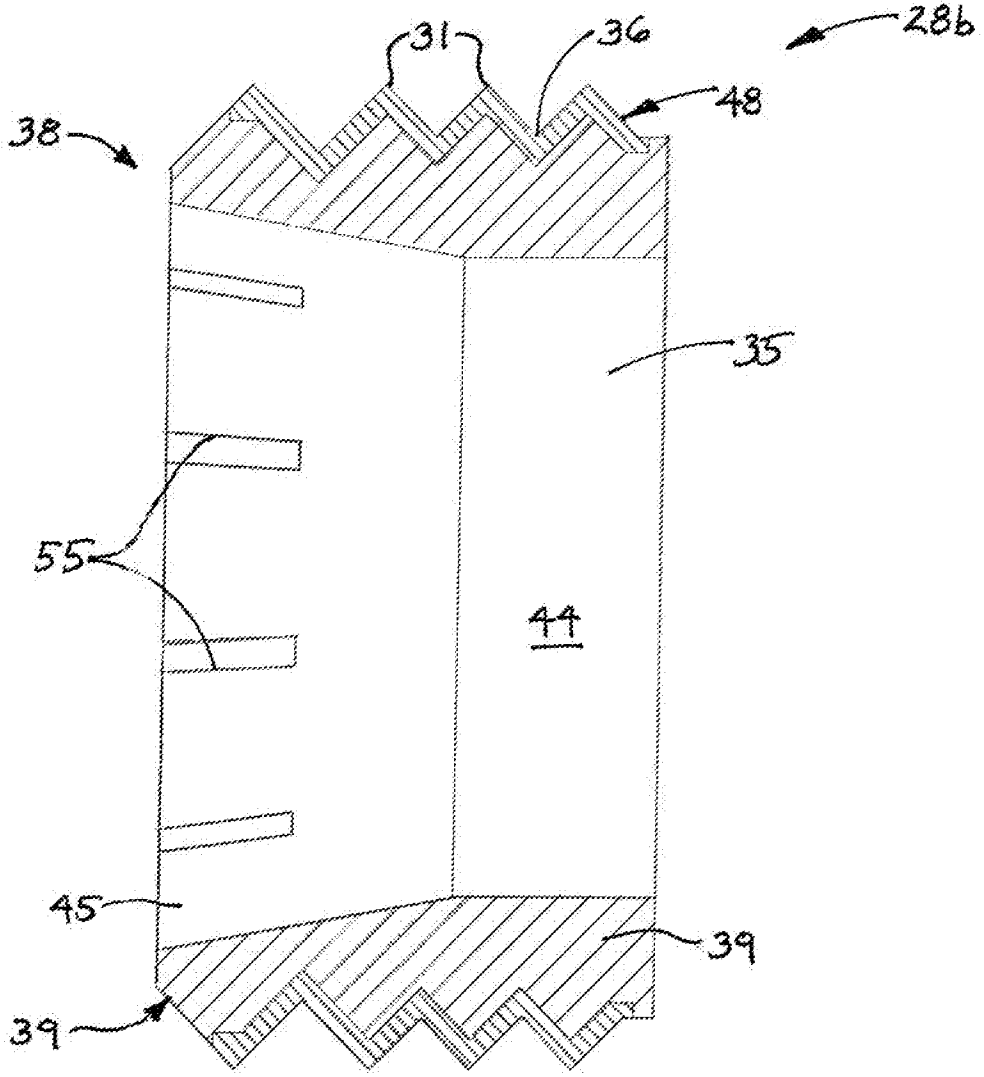
FIG. 18B is a sectional view of the multi-sectioned reinforcing ring.

A liquid molding material (not illustrated) which will form the ring insert 38 may next be injected into the mold. The liquid molding material may include any suitable type of rigid drillable material including but not limited to metal, composite material and/or engineering-grade plastic. The liquid molding material flows within and around the ring sections 48. As illustrated in FIGS. 13 and 17, the liquid molding material cures and forms the ring insert 38. After the sectioned reinforcing ring 29 is removed from the mold, the wall slots 55 may be cut into the tapered wall portion 45 in the ring insert wall 39 of the ring insert 38. The sectioned reinforcing rings 29 of the lower slip assembly 28*a* and the upper slip assembly 28*b* may then be assembled in the downhole bridge plug 1, typically as was heretofore described.

Application of the downhole bridge plug 1 having the lower slip assembly 28*a* and the upper slip assembly 28*b* may be as was heretofore described with respect to the downhole bridge plug 1 in FIGS. 19A-19C. The ring sections 48 may enhance outward radial expansion of each reinforcing ring 29 against the interior surface of the well casing 80 upon actuation of the running-in tool 100 and the mandrel cap 12 and radial expansion of the sealing element 64 against the well casing 80.

Figure 20:
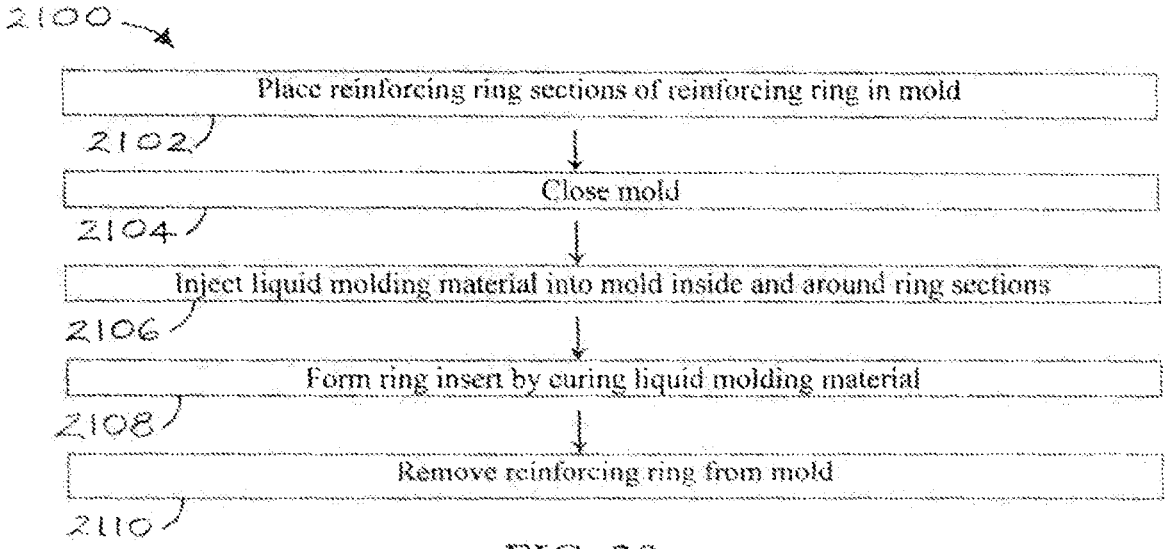
FIG. 20 is a flow diagram of an illustrative embodiment of the reinforcing ring fabrication methods.

Referring next to FIG. 20 of the drawings, a flow diagram 2100 of an illustrative embodiment of the reinforcing ring fabrication methods is illustrated. Multiple reinforcing ring sections of a reinforcing ring may initially be fabricated using conventional injection molding and/or other techniques. At block 2102, the multiple reinforcing ring sections of the reinforcing ring may be placed in a mold. At block 2104, the mold may be closed. At block 2106, a liquid molding material may be injected into the mold inside and around the ring sections. The liquid molding material may include metal, composite material and/or engineering-grade plastic, for example and without limitation. At block 2108, a ring insert may be formed by curing the liquid molding material. At block 2110, the reinforcing ring may be removed from the mold.

Referring next to FIGS. 27-30 of the drawings, an alternative illustrative embodiment of the downhole bridge plugs is generally indicated by reference numeral 1*a*, where like reference numerals designate like elements to those of the downhole bridge plug 1 that was heretofore described with respect to FIGS. 1-26. The downhole bridge plug 1*a* may include an upper sealing element 264 which is provided on the mandrel shaft 204 of the mandrel 202. The upper sealing element 264 may directly engage the upper cone 72*b*. Accordingly, the upper backup ring (not illustrated) may be omitted from between the upper sealing element 264 and the upper cone 72*b*. A lower sealing element 296 may be provided on the mandrel shaft 204 in engagement with the upper sealing element 264. The upper backup ring 160*a* may be interposed between the lower cone 72*a* and the lower sealing element 296.

Figure 29:
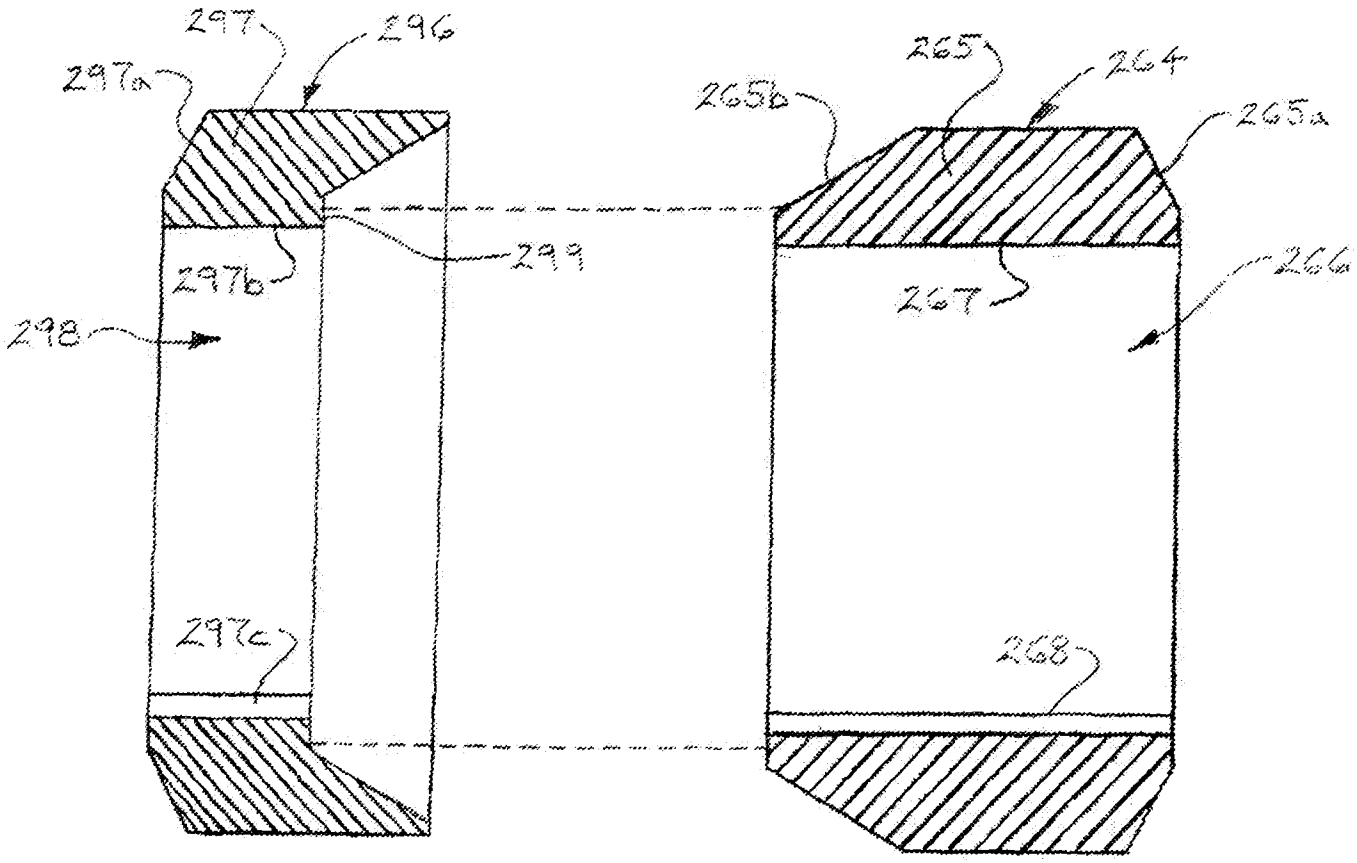
FIG. 29 is an exploded sectional view illustrating mating of a typical sealing element and backup ring suitable for implementation of the downhole bridge plug illustrated in FIG. 27.

As illustrated in FIG. 29, the upper sealing element 264 may include an upper sealing element wall 265 which may be generally elongated and cylindrical. The upper sealing element wall 265 may have a proximal wall bevel 265*a* and a distal wall bevel 265*b*. The upper sealing element wall 265 may form an upper sealing element bore 266 which traverses the length of the upper sealing element 264. The upper sealing element bore 266 may be suitably sized to accommodate the mandrel shaft 4 of the mandrel 2. The upper sealing element bore 266 may have a sealing element bore surface 267. A longitudinal sealing element ridge 268 may protrude from the sealing element bore surface 267. The sealing element ridge 268 may traverse at least a portion of the length of the upper sealing element 264. In assembly of the downhole bridge plug 1*a*, the sealing element ridge 268 may insert into the companion mandrel shaft groove 10 (FIG. (FIG. 3C) in the mandrel shaft 4 of the mandrel 2, as was heretofore described with respect to the downhole bridge plug 1.

As further illustrated in FIG. 29, the lower sealing element 296 of the downhole bridge plug 1 may include a lower sealing element wall 297 which may be generally cylindrical or annular. A lower sealing element seat 299 and a beveled sealing element wall bevel 297*a* may be provided in opposite ends of the lower sealing element wall 297. The lower sealing element seat 299 may be suitably sized and configured to receive and accommodate the distal wall bevel 265*b* of the upper sealing element 264 in engaging relationship thereto in assembly of the downhole bridge plug 1. The sealing element wall bevel 297*a* may be suitably sized and angled to engage the inner backup ring portion 176 of the lower backup ring 160*a* in the assembled downhole bridge plug 1.

The lower sealing element wall 297 of the lower sealing element 296 may form a lower sealing element bore 298 which traverses the length of the lower sealing element 296. The lower sealing element bore 298 may be suitably sized to accommodate the mandrel shaft 4 of the mandrel 2. The lower sealing element bore 298 may have a sealing element bore surface 297*b*. A longitudinal sealing element ridge 297*c* may protrude from the sealing element bore surface 297*b*. The sealing element ridge 297*c* may traverse at least a portion of the length of the lower sealing element 296. In assembly of the downhole bridge plug 1*a*, the sealing element ridge 297*c* may insert into the companion mandrel shaft groove 10 (FIG. (FIG. 3C) in the mandrel shaft 4 of the mandrel 2, as was heretofore described with respect to the downhole bridge plug 1.

Figure 28:
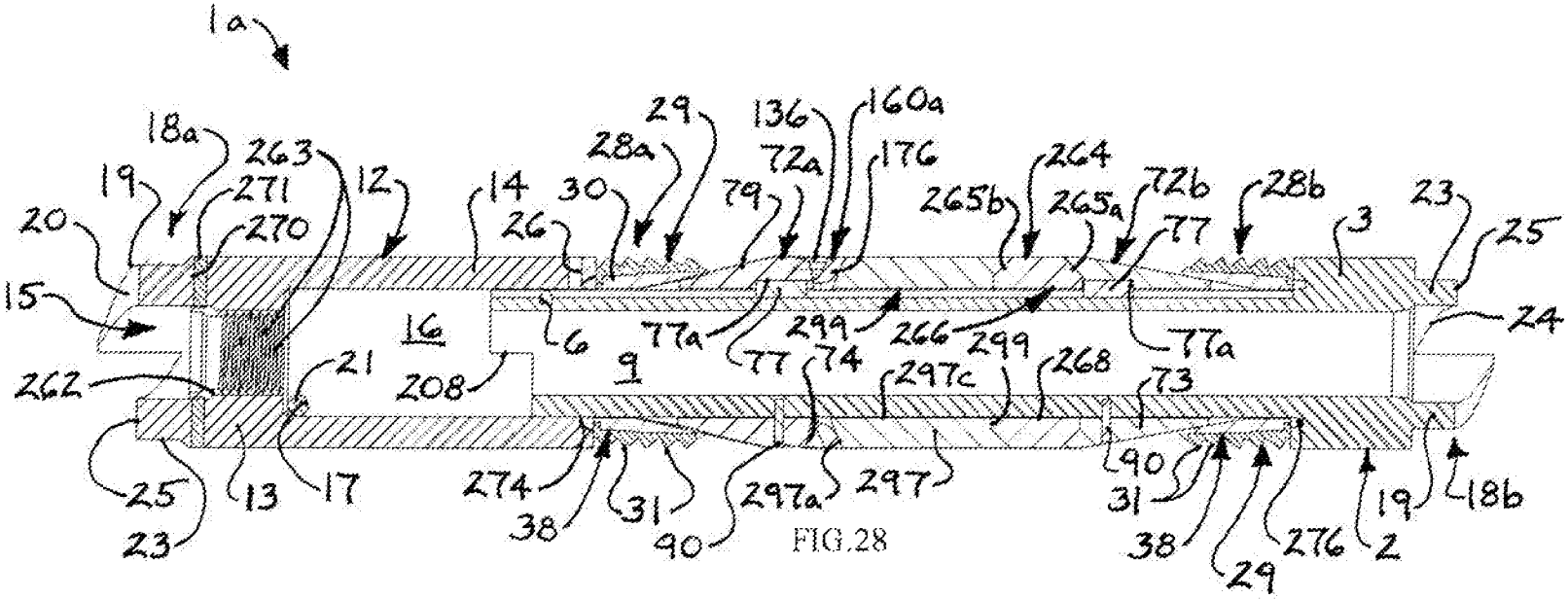
FIG. 28 is a longitudinal sectional view of the downhole bridge plug illustrated in FIG. 27.
Figure 30:
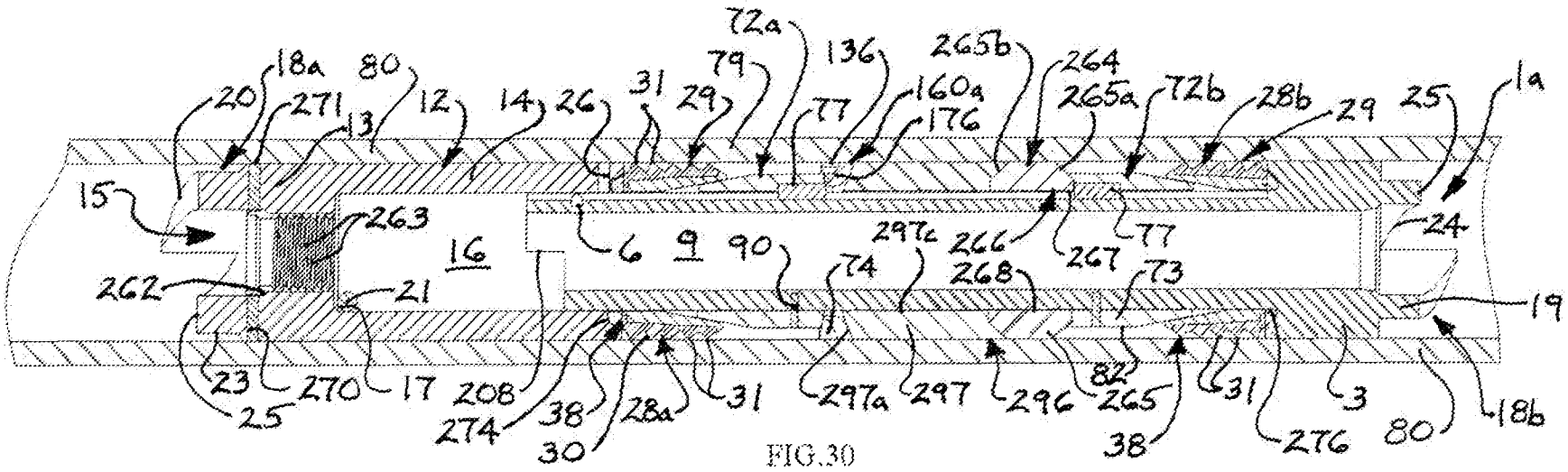
FIG. 30 is a longitudinal sectional view of the downhole bridge plug illustrated in FIG. 27, deployed in the expanded configuration and the lower cone, sealing element and upper cone engaging the well casing.

As illustrated in FIGS. 28 and 30, in some embodiments, a threaded shear insert 262 may be seated in the mandrel cap bore 15 adjacent to the mandrel cap interior 16 of the mandrel cap 12. The threaded shear insert 262 may be secured in the mandrel cap interior 16 via pins, threads, welding and/or other attachment technique known by those skilled in the art. For example and without limitation, in some embodiments, at least one radial insert retainer pin opening 270 may extend through the mandrel cap base 13 of the mandrel cap 12. An insert retainer pin 271 may extend through the insert retainer pin opening 270. The insert retainer pin 271 may be seated in a corresponding pin cavity (not numbered) provided in the threaded shear insert 262. The threaded shear insert 262 may have interior shear insert threads 263. In setting of the downhole bridge plug 1, a setting shaft (not illustrated) may be inserted through the mandrel shaft bore 9 of the mandrel shaft 4 and the mandrel cap interior 16 of the mandrel cap 12, as was heretofore described with respect to the setting shaft 104 in FIG. 19B. The setting shaft 104 may be threadably engaged with the shear insert threads 263 in the threaded shear insert 262 to deploy the downhole bridge plug 1*a* from the pre-expanded configuration to the expanded configuration, as was heretofobre described with respect to FIGS. 19A-19C. The setting shaft 104 may be subsequently removed from the mandrel shaft bore 9 and mandrel cap interior 16 by reverse or downward movement of the setting shaft 104, thus typically facilitating shearing of the insert retainer pin or pins 271 and detachment of the threaded shear insert 262 from the mandrel cap bore 15 of the mandrel cap 12.

In typical application of the downhole bridge plug 1*a*, the upper slip assembly 28*b* and the upper cone 72*b* may be sequentially placed on the mandrel shaft 4 of the mandrel 2. Next, the upper sealing element 264 may be placed on the mandrel 2 by inserting the mandrel shaft 4 of the mandrel 2 through the sealing element bore 266 (FIG. 6) until the proximal wall bevel 265*a* on the upper sealing element 264 engages the inner backup ring portion 176 of the upper backup ring 160*b*. As illustrated in FIG. 28, the sealing element ridge 268 provided on the upper sealing element 264 may simultaneously be inserted into and slid along the mandrel shaft groove 10 (FIGS. 3A and 3C) provided in the mandrel shaft 4 of the mandrel 2.

The lower sealing element 296 may next be placed on the mandrel 2 by inserting the mandrel shaft 4 of the mandrel 2 through the lower sealing element bore 298 (FIG. 29) until the lower sealing element seat 299 in the lower sealing element 296 receives and engages the complementary-shaped distal wall bevel 265*b* on the upper sealing element 264. As illustrated in FIG. 28, the sealing element ridge 297*c* provided on the lower sealing element 296 may simultaneously be inserted into and slid along the mandrel shaft groove 10 (FIGS. 3A and 3C) provided in the mandrel shaft 4 of the mandrel 2.

The inner backup ring portion 176 of the lower backup ring 160*a* may next be placed on and slid along the mandrel shaft 4 against the sealing element wall bevel 297*a* on the lower sealing element 296, and the outer backup ring portion 136 of the lower backup ring 160*a* may be placed on and slid along the mandrel shaft 4 against the inner backup ring portion 176.

The lower cone 72*a* may be placed on the mandrel shaft 4 of the mandrel 2. The lower cone 72*a* may be slid along the mandrel shaft 4 until the inner cone wall surface 74 of the cone wall 73 engages the outer backup ring portion 136 of the lower backup ring 160*a*. In some embodiments, ring retainer pins 145 may be inserted in the respective pin openings 75 (FIG. 4B) in the inner cone wall surface 74 of the lower cone 72*a* and the respective registering retainer pin openings 144 (FIG. 25) in the outer backup ring portion 136. A cone pin 90 may be extended through the cone pin opening 83 (FIG. 4A) in the cone wall 73 of each of the lower cone 72*a* and the upper cone 72*b* and into the corresponding registering cone pin opening 5 (FIG. 2) in the mandrel shaft 4 of the mandrel 2.

The lower slip assembly 28*a* may be placed on the mandrel shaft 4, typically by extending the mandrel shaft 4 through the ring insert interior 43 (FIG. 10) of the ring insert 38, and sliding the lower slip assembly 28*a* along the mandrel shaft 4 until the ring insert 38 receives and engages the tapered cone wall surface 82 of the cone wall 73 of the lower cone 72*a*. The mandrel cap 12 may then be pinned to the mandrel shaft 4 of the mandrel 2 by inserting the mandrel coupling pin or pins 11 (FIGS. 19A-19C) through the respective mandrel cap pin opening or openings 26 in the mandrel cap wall 14 of the mandrel cap 12 and the registering mandrel pin opening or openings 6 in the mandrel shaft 4 of the mandrel 2.

Application of the downhole bridge plug 1*a* may be as was heretofore described with respect to the downhole bridge plug 1 in FIGS. 19A-19C. Upon deployment of the downhole bridge plug 1*a* from the pre-expanded configuration (FIG. 28) to the expanded configuration (FIG. 30), the lower slip assembly 28*a* traverses the lower cone 72*a* and engages the lower backup ring 160*a*, which in turn engages the lower sealing element 296. The lower slip assembly 28*a* and the lower backup ring 160*a* expand outwardly to engage the well casing 80, as was heretofore described. Simultaneously, the upper slip assembly 28*b* traverses the upper cone 72*b* and engages the upper sealing element 264, and the upper slip assembly 28*b* expands outwardly to engage the well casing 80. The upper sealing element 264 and the lower sealing element 296 are compressed between the upper cone 72*b* and the lower backup ring 160*a*, expanding outwardly to engage the well casing 80. In some applications, after use, a drill bit or milling cutter (not illustrated) may be inserted through the well casing 80 and operated to grind the downhole bridge plug 1*a* into fragments to remove the downhole bridge plug 1*a* from the well casing 80, as was heretofore described.

As illustrated in FIG. 28, an annular lower cone receptacle 274 may be provided in the end surface of the mandrel cap wall 14 of the mandrel cap 12 which faces the lower slip assembly 28*a*. An upper cone receptacle 276 may in like manner be provided in the end surface of the mandrel base 3 of the mandrel 2 which faces the upper slip assembly 28*b*. The lower cone receptacle 274 and the upper cone receptacle 276 may be configured to receive and accommodate the lower cone 72*a* and the upper cone 72*b*, respectively, in the expanded configuration of the downhole bridge plug 1*a*.

Figure 28A:
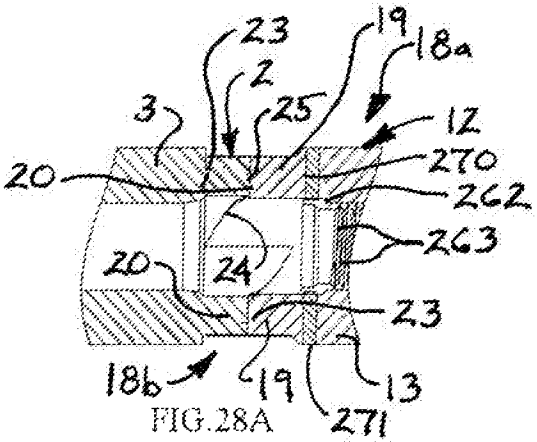
FIG. 28A is a sectional view illustrating typical interlocking of a pair of downhole bridge plugs to prevent rotation of the downhole bridge plugs during drilling and removal of the plugs from a wellbore.

As illustrated in FIG. 28A, during their removal from the well casing 80, the downhole bridge plugs 1*a* may sequentially drop in the well casing 80 as each downhole bridge plug 1*a* is drilled or cut and consequently disengages the interior surface of the well casing 80. Accordingly, the partially-removed downhole bridge plug 1*a* which is being cut may drop in the well casing 80 such that the mandrel cap lock 18*a* on the mandrel cap 12 of the partially-cut downhole bridge plug 1*a* engages and interlocks with the companion tool lock 18*b* on the mandrel 2 of the next succeeding, typically lower downhole bridge plug 1*a*. Thus, the downhole bridge plugs 1*a* will not rotate relative to each other as cutting continues to remove the downhole bridge plugs 1*a* from the well casing 80. This feature may also characterize the downhole bridge plugs 1 which were heretofore described with respect to FIGS. 1-26 in their removal from the well casing 80.

Figure 31:
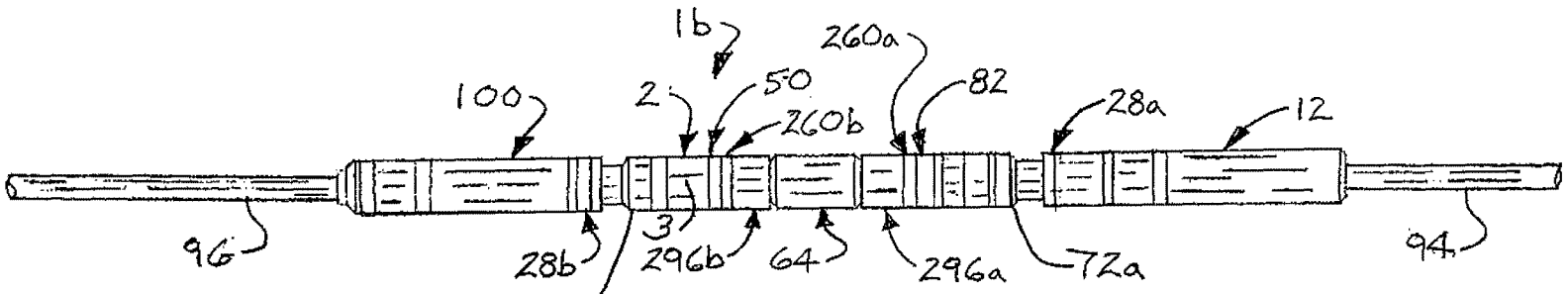
FIG. 31 is a side view of an illustrative embodiment of the fluid-sealing downhole bridge plugs.
Figure 32:
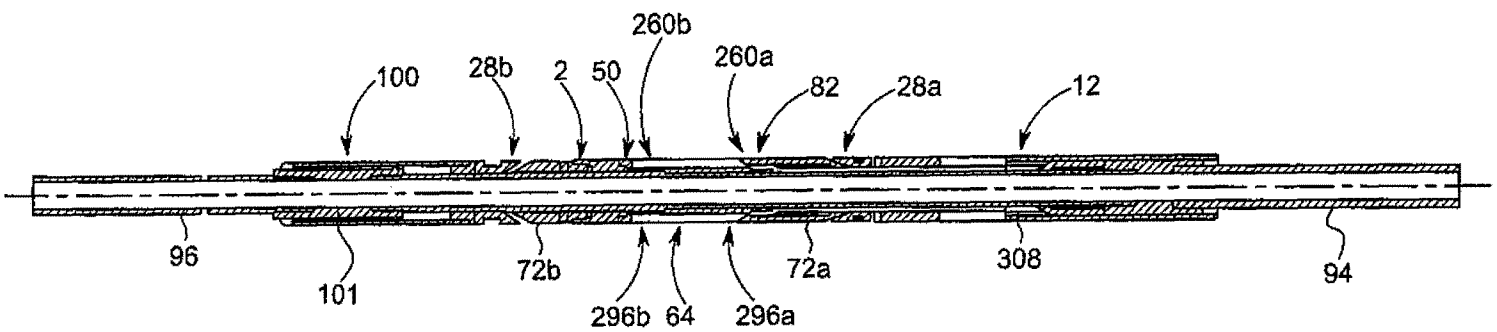
FIG. 32 is a typical longitudinal sectional view of the illustrative fluid-sealing downhole bridge plug illustrated in FIG. 31.
Figure 41:
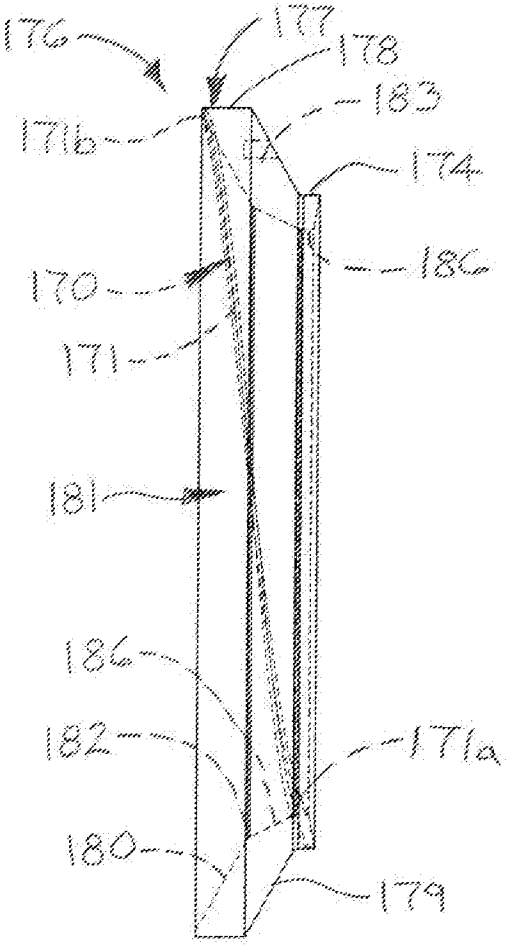
FIG. 41 is a side view of the inner backup ring portion illustrated in FIG. 39.
Figure 42:
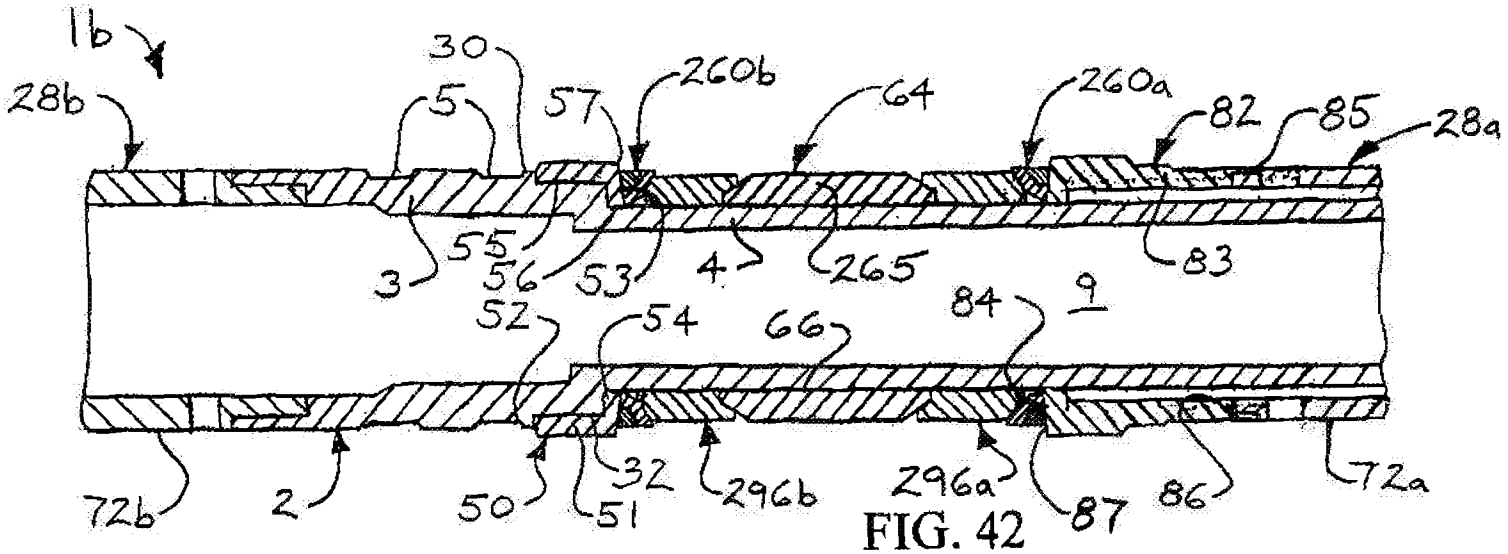
FIG. 42 is a longitudinal sectional view of a portion of the fluid-sealing downhole bridge plug illustrated in FIGS. 31 and 32, with a mandrel, an upper gage ring and a lower gage ring on the mandrel and an upper backup ring, a lower backup ring, an upper sealing element, a lower sealing element and a middle sealing element on the mandrel between the upper gage ring and the lower gage ring.
Figure 43:
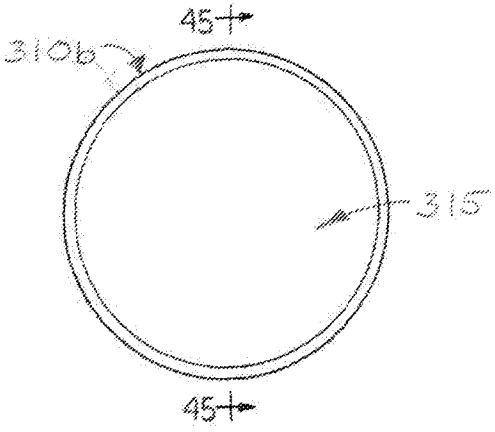
FIG. 43 is an inner view of a typical upper seal ring of the fluid-sealing downhole bridge plugs.
Figure 44:
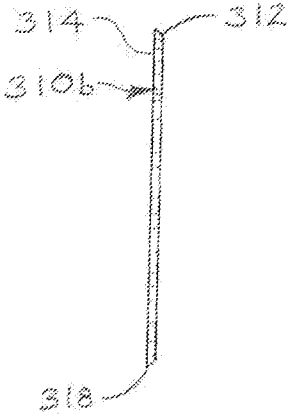
FIG. 44 is a side view of the upper seal ring illustrated in FIG. 43.
Figure 45:
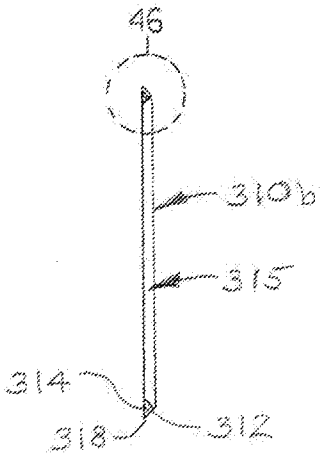
FIG. 45 is a sectional view, taken along section lines 45-45 in FIG. 43, of the upper seal ring.
Figure 46:
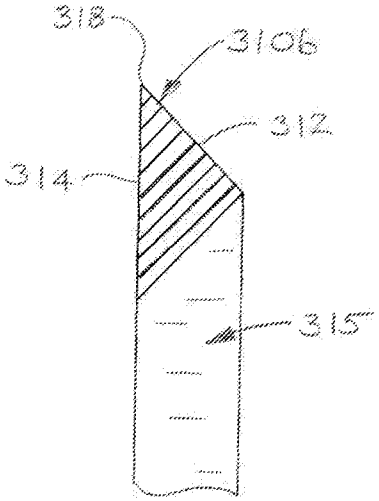
FIG. 46 is an enlarged sectional view of the upper seal ring, taken along section line 46 in FIG. 45.

Referring next to FIGS. 31-60 of the drawings, an illustrative embodiment of fluid-sealing downhole bridge plugs, hereinafter downhole bridge plug, is generally indicated by reference numeral 1*b*, where like reference numerals designate like elements to those of the downhole bridge plug 1 that was heretofore described with respect to FIGS. 1-26, unless otherwise noted. As illustrated in FIGS. 31 and 32, the fluid-sealing downhole bridge plug 1*b* may be assembled on a lower tubing string 94 and an upper tubing string 96. A running tool 100 may be coupled to the upper tubing string 96 according to the knowledge of those skilled in the art. An upper slip assembly 28*b* having an upper cone 72*b* may be engaged by the running tool 100. A mandrel 2 may include a mandrel base 3 which is engaged by the upper cone 72*b* of the upper slip assembly 28*b*, as illustrated in FIG. 42. An elongated mandrel shaft 4 may extend from the mandrel base 3.

As further illustrated in FIG. 42, an upper gage ring 50 may be disposed on the mandrel 2. The upper gage ring 50 may include a cylindrical upper gage ring wall 51 which accommodates the mandrel base 3. The upper gage ring wall 51 may have an upper gage ring wall end 52 and a lower gage ring wall end 53. The upper gage ring wall 51 may define a ring bore 55 which traverses most of the length of the upper gage ring wall 51. A gage ring lip 54 may protrude inwardly from the upper gage ring wall 51 at the lower gage ring wall end 53. A ring opening 56 which communicates with the ring bore 55 may be defined by the gage ring lip 54. The ring opening 56 may accommodate the mandrel shaft 4. The gage ring lip 54 may have a beveled exterior lip surface 57 which angles outwardly from the upper gage ring wall 51 toward the ring opening 56. An upper backup ring 260*b* may be provided on the mandrel shaft 4 in engagement with the upper gage ring 50.

As further illustrated in FIGS. 31 and 32, a mandrel cap 12 may be coupled to the lower tubing string 94 according to the knowledge of those skilled in the art. The mandrel cap 12 may receive the mandrel shaft 4 of the mandrel 2. A lower slip assembly 28*a* having a lower cone 72*a* may be provided on the mandrel shaft 4 and engaged by the mandrel cap 12.

Figure 38:
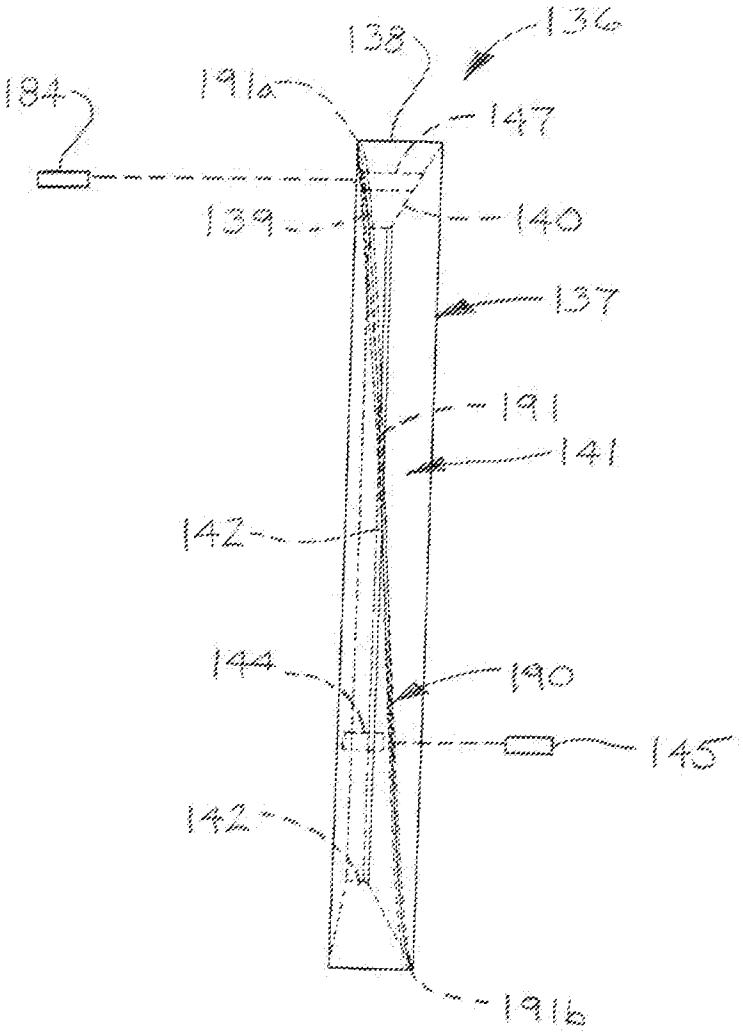
FIG. 38 is an exploded side view of the outer backup ring portion illustrated in FIG. 36.
Figure 37:
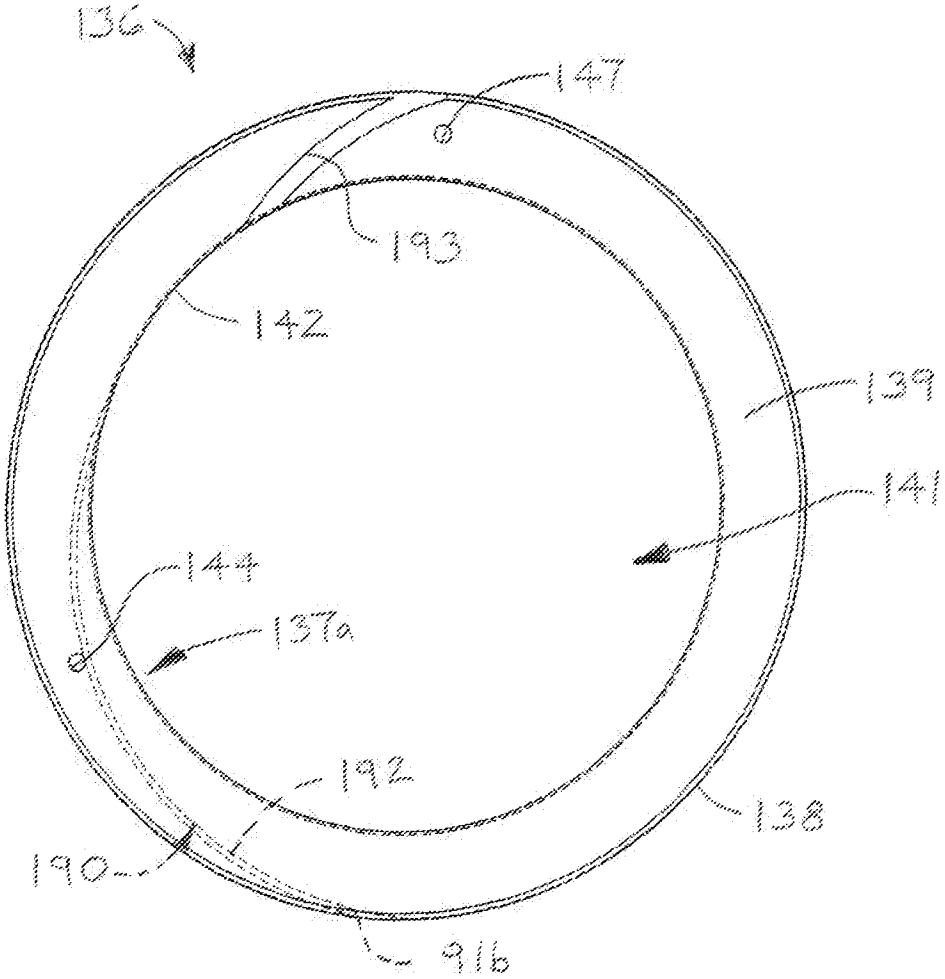
FIG. 37 is an outer view of the outer backup ring portion illustrated in FIG. 36.
Figure 39:
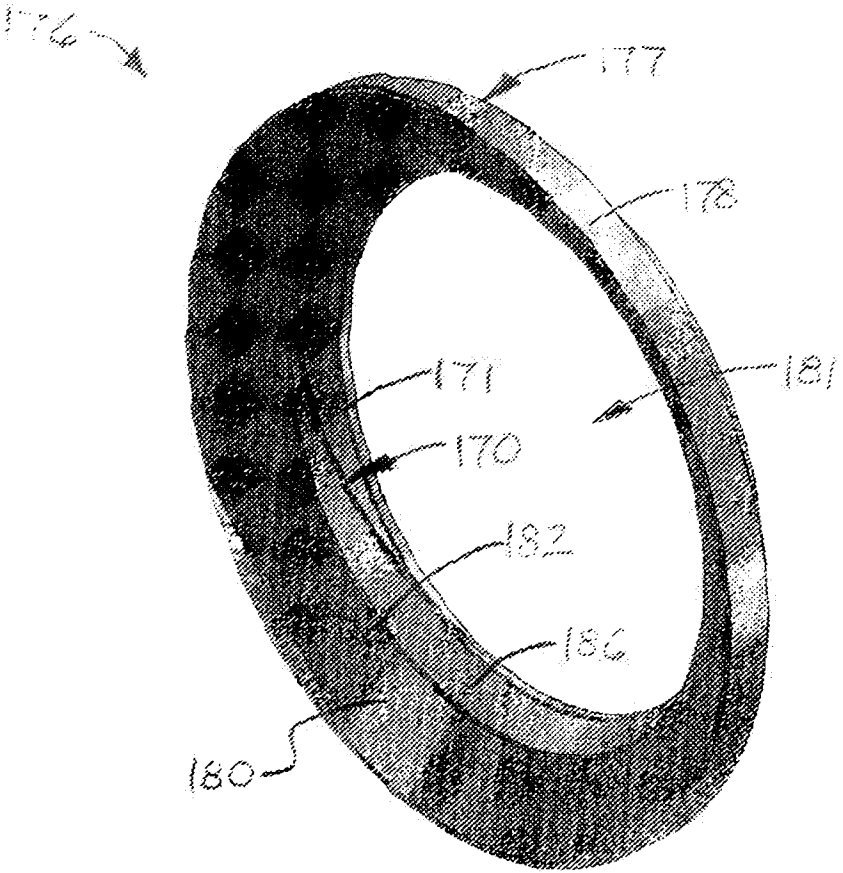
FIG. 39 is an inner perspective view of a typical inner backup ring portion of the backup ring illustrated in FIG. 33.
Figure 40:
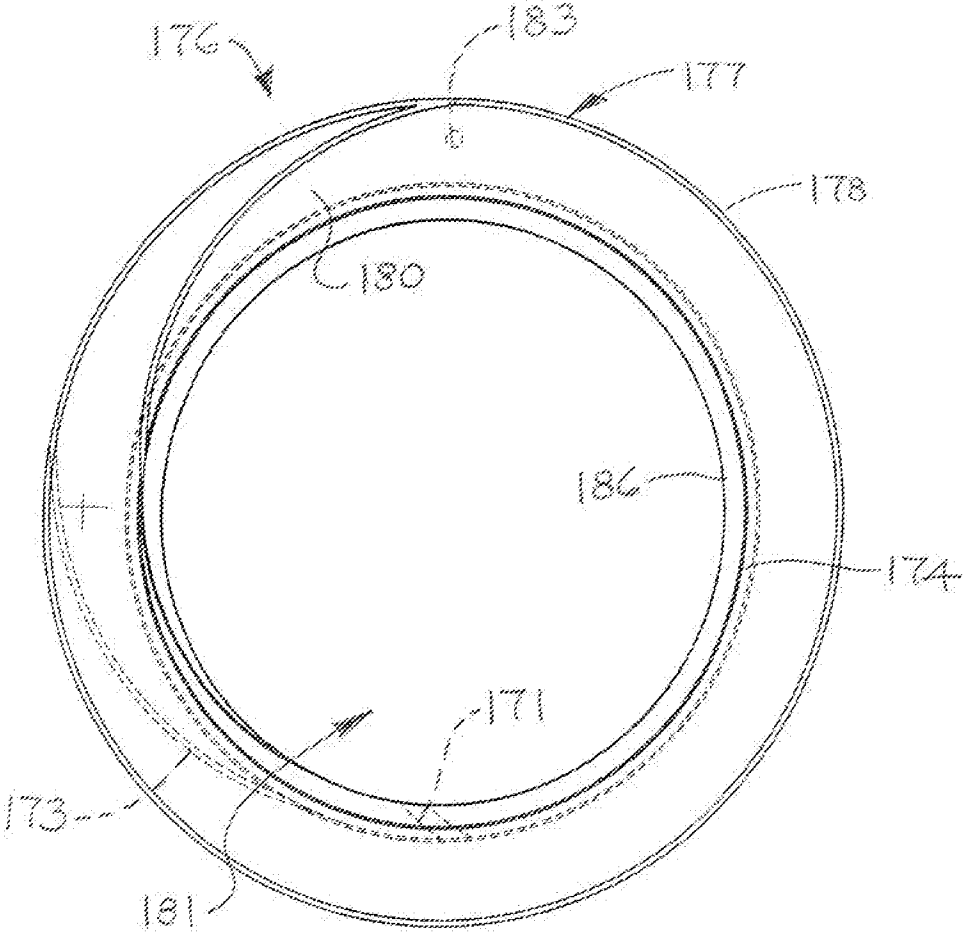
FIG. 40 is an inner view of the inner backup ring portion illustrated in FIG. 39.

As further illustrated in FIG. 42, a lower gage ring 82 may be provided on the mandrel shaft 4 of the mandrel 2. The lower gage ring 82 may include a generally cylindrical lower gage ring wall 83. The lower gage ring wall 83 may have an upper ring wall end 84 and a lower ring wall end 85. As illustrated in FIGS. 38-40, a ring bore 86 may longitudinally traverse the lower gage ring wall 83 from the upper ring wall end 84 to the lower ring wall end 85. The upper ring wall end 84 of the lower gage ring wall 83 may have a beveled ring surface 87 which angles outwardly from the outer surface of the lower gage ring wall 83 toward the ring bore 86. A lower backup ring 260*a* may be provided on the mandrel shaft 4 in engagement with the beveled ring surface 87 on the lower gage ring wall 83 of the lower gage ring 82.

A lower sealing element 296*a* may be provided on the mandrel shaft 4 in engagement with the lower backup ring 260*a*. A middle sealing element 64 may be provided on the mandrel shaft 4 in engagement with the lower sealing element 296*a*. An upper sealing element 296*b* may be provided on the mandrel shaft 4 in engagement with the middle sealing element 64 and the upper backup ring 260*b*. The middle sealing element 64 may have a design which is the same as or similar to that of the middle sealing element 64 which was heretofore described with respect to FIGS. 5 and 6. Each of the lower sealing element 296*a* and the upper sealing element 296*b* may have a design which is the same as or similar to that of the lower sealing element 296 which was heretofore described with respect to FIG. 29. As illustrated in FIGS. 57-60, an inner sealing element bevel 320 may extend between the sealing element wall bevel 297*a* and the sealing element bore surface 297*b* of each of the lower sealing element 296*a* and the upper sealing element 296*b*.

Figure 33:
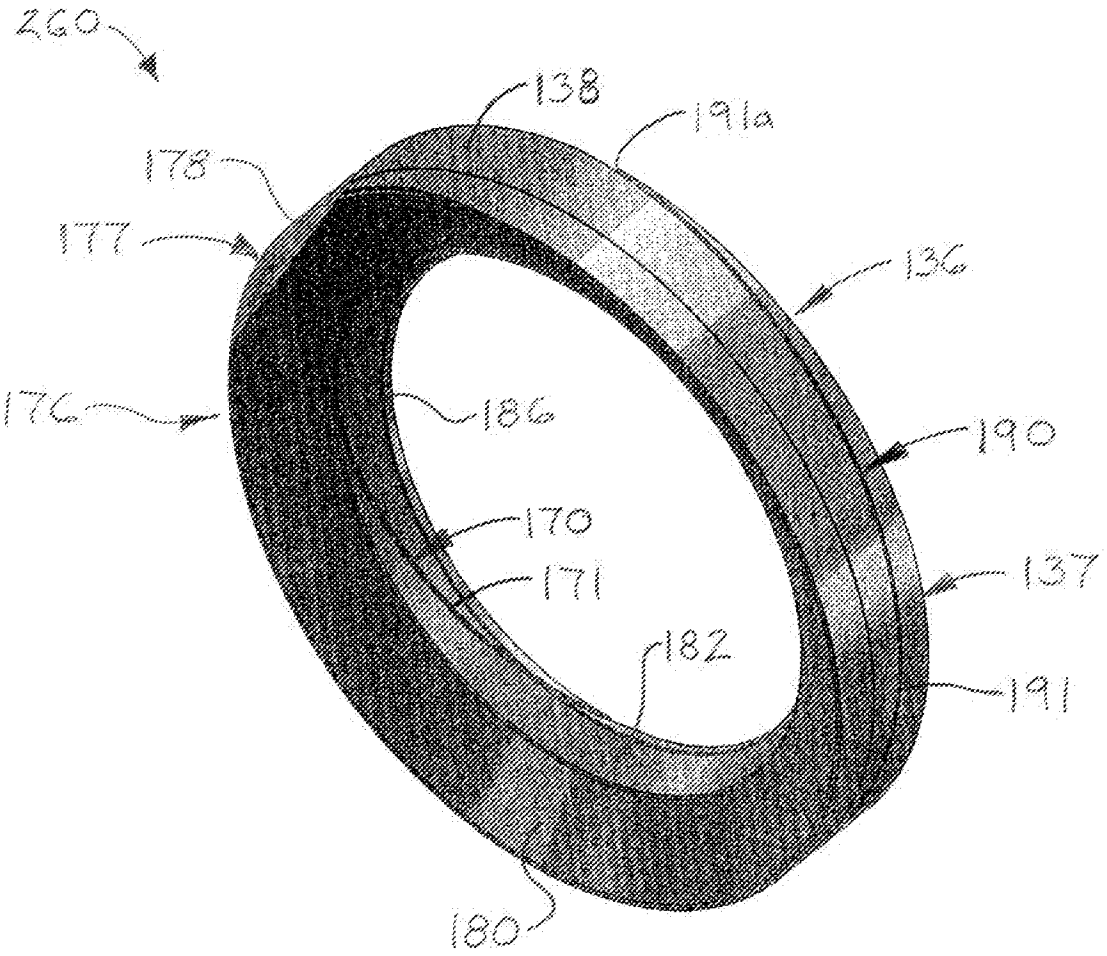
FIG. 33 is an inner perspective view of a typical backup ring of the illustrative fluid-sealing downhole bridge plug illustrated in FIG. 31.
Figure 35:
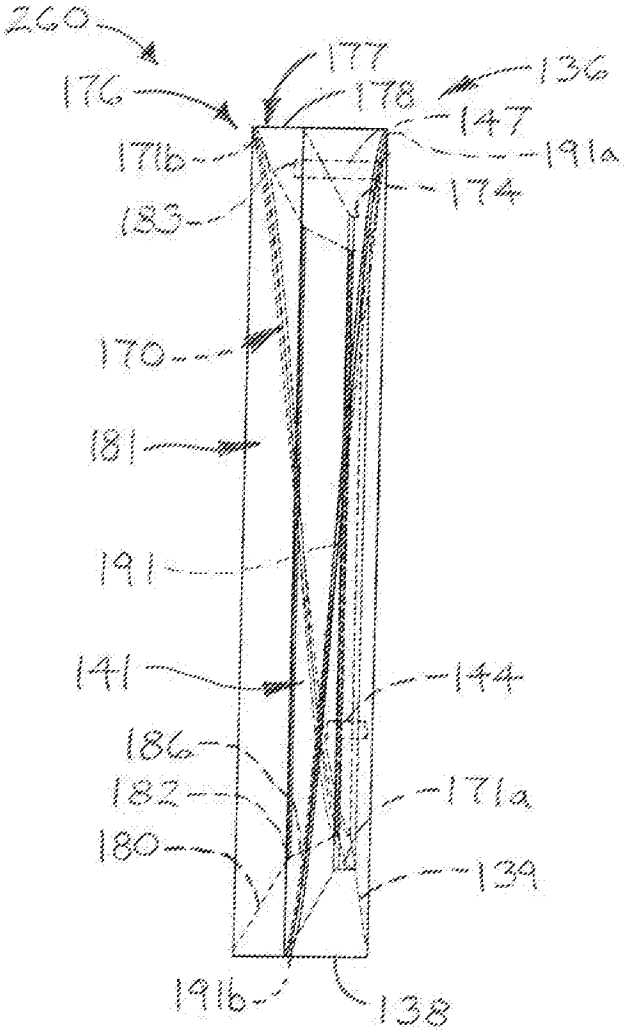
FIG. 35 is a side view of the backup ring illustrated in FIG. 33.
Figure 34:
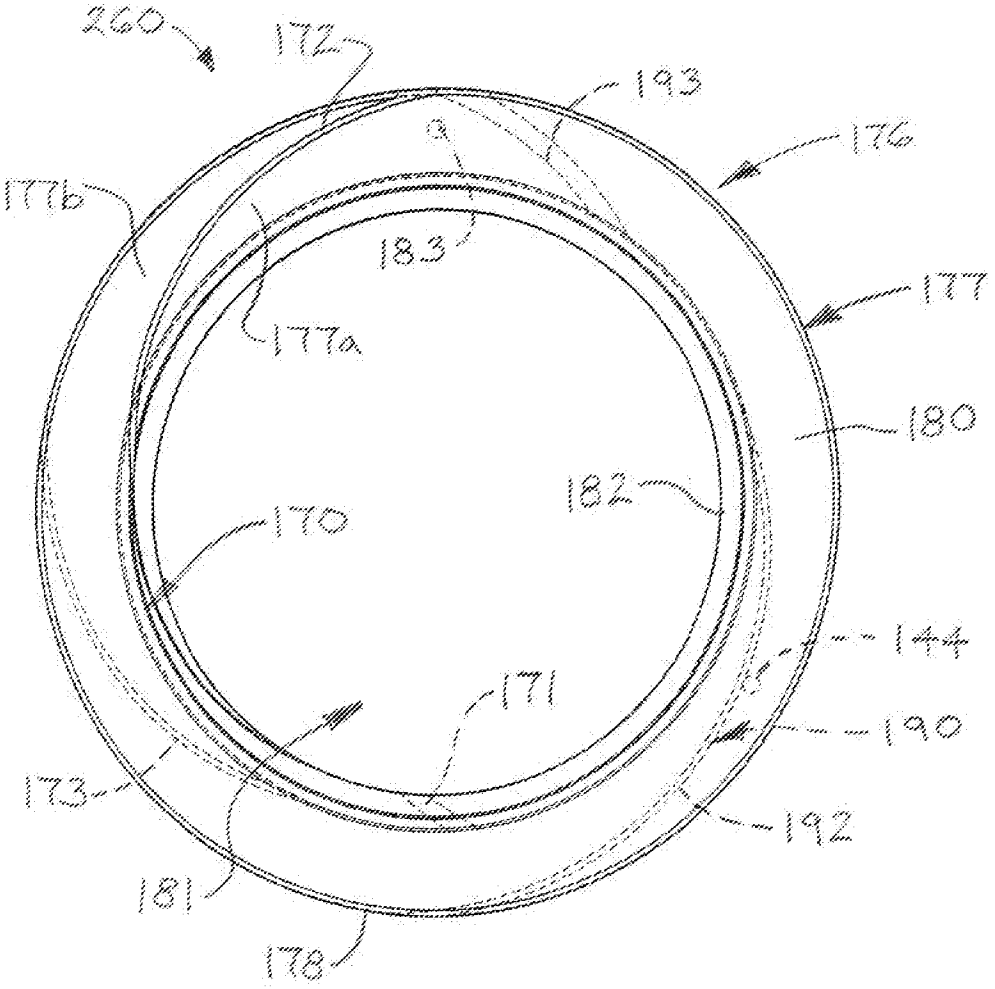
FIG. 34 is an inner view of the backup ring illustrated in FIG. 33.
Figure 36:
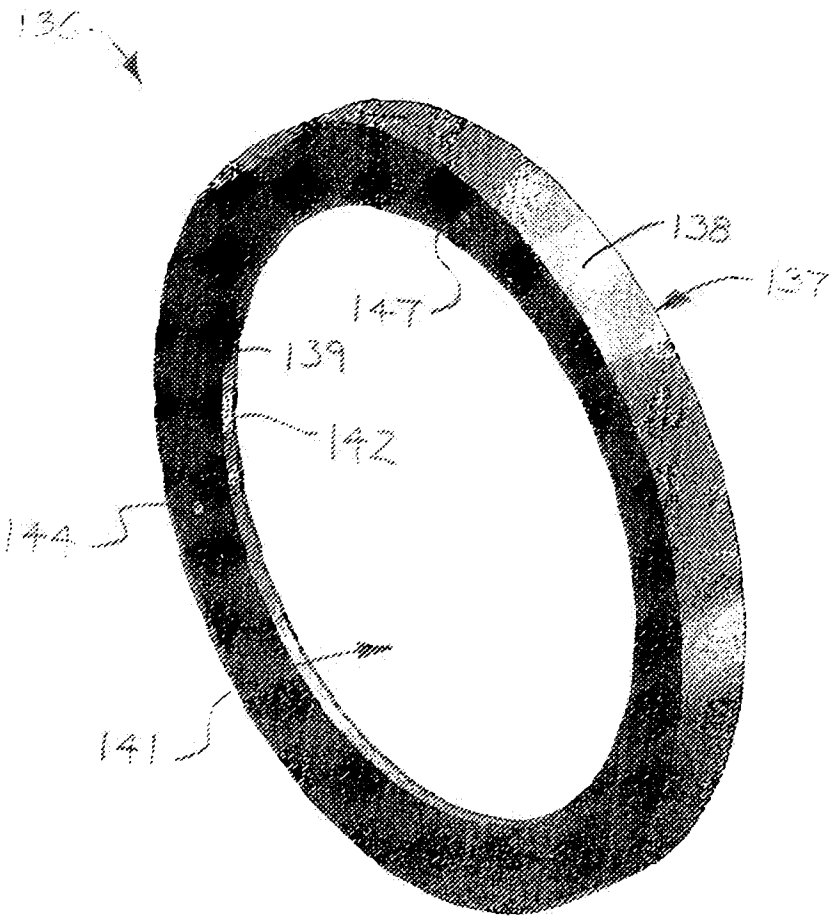
FIG. 36 is an outer perspective view of a typical outer backup ring portion of the backup ring illustrated in FIG. 33.

A non-limiting example of the lower backup ring 260*a* and the upper backup ring 260*b* is generally indicated by reference numeral 260 in FIGS. 33-35. The lower backup ring 260*a* and the upper backup ring 260*b* may each have a design which is the same as or similar to that of the lower backup ring 160*a* and the upper backup ring 160*b* which was heretofore described with respect to FIGS. 21-26. Accordingly, the lower backup ring 260*a* and the upper backup ring 260*b* may each include an outer backup ring portion 136 and an inner backup ring portion 176 (FIGS. 39-41) which engages the outer backup ring portion 136, as illustrated in FIGS. 33 and 35. As illustrated in FIG. 41, in some embodiments of the lower backup ring 260*a* and the upper backup ring 260*b*, the ring opening edge 182 may define an abrupt transition between the inner backup ring surface 180 and the ring opening surface 186 of the inner backup ring portion 176.

Figure 47:
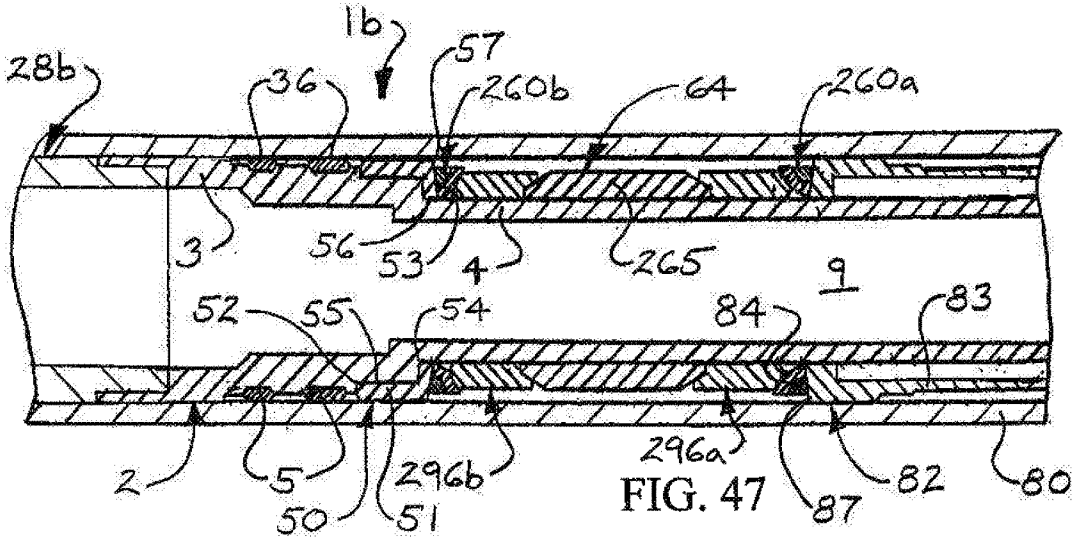
FIG. 47 is a longitudinal sectional view of the illustrative fluid-sealing downhole bridge plug illustrated in FIG. 42, deployed in a well casing, with the upper and lower backup rings, upper and lower sealing elements and middle sealing element disengaging the well casing in the pre-expanded configuration of the downhole bridge plug.
Figure 48:
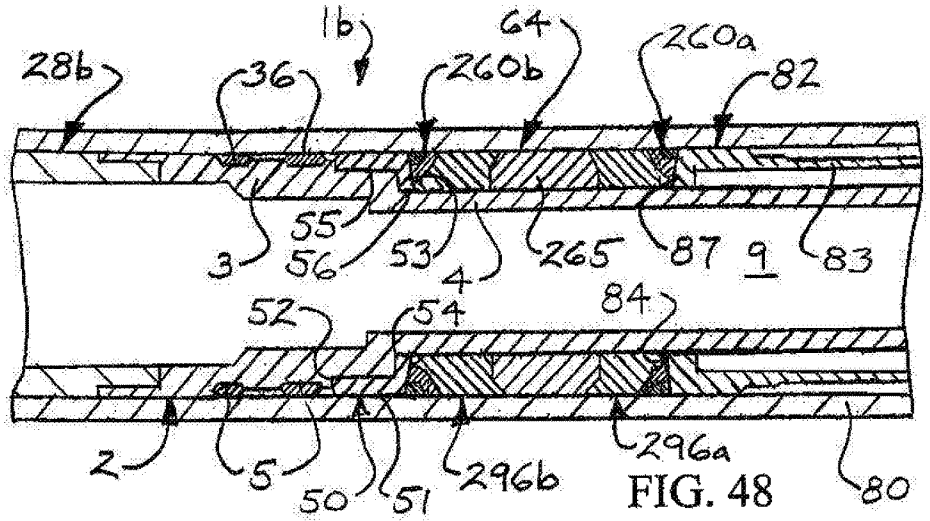
FIG. 48 is a longitudinal sectional view of the fluid-sealing downhole bridge plug illustrated in FIG. 42, deployed in the well casing, with the upper and lower backup rings, upper and lower sealing elements and middle sealing element engaging the well casing in the expanded configuration of the downhole bridge plug.
Figure 49:
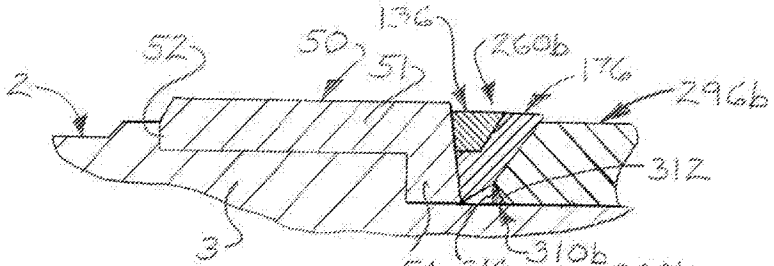
FIG. 49 is an enlarged sectional view of the mandrel, the upper gage ring, the upper backup ring and the upper sealing element, with a ring space there between and the upper backup ring and upper sealing element in the pre-expanded configuration, more particularly illustrating an upper seal ring deployed in an unseated position in the ring space.

As illustrated in FIG. 42, in some embodiments, at least one annular seal groove 5 may be provided circumferentially in the exterior surface of the mandrel base 3 of the mandrel 2. A circumferential ring retaining ridge 30 may protrude from the mandrel base 3 typically adjacent to the seal groove 5 which is proximate to the mandrel shaft 4. A circumferential sealing ring shoulder 32 may extend between the ring retaining ridge 30 and the end of the mandrel base 3 which is proximate to the mandrel shaft 4. As illustrated in FIGS. 47 and 48 and will be hereinafter described, at least one mandrel seal 36 may be disposed in each seal groove 5. Accordingly, in typical application of the downhole bridge plug 1*b*, the mandrel seals 36 may be disposed in fluid-tight engagement with the interior surface of the well casing 80 to prevent or minimize flow of well fluid between the mandrel base 3 and the well casing 80, as will be hereinafter further described.

The mandrel 2, upper gage ring 50, upper backup ring 260*b*, upper sealing element 296*b*, middle sealing element 64, lower sealing element 296*a*, lower backup ring 260*a*, lower gage ring 82 and mandrel 12 may be fabricated of any suitable type of rigid drillable material including but not limited to metal, composite material and/or engineering-grade plastic. In some embodiments, the upper backup ring 260*b* and the lower backup ring 260*a* may have a continuous unitary or one-piece construction and may include PEEK (polyether ether ketone), for example and without limitation.

In some embodiments of the downhole bridge plug 1*b*, a mandrel shaft groove 10 (FIG. 3A) may extend into the exterior surface and along at least a portion of the length of the mandrel shaft 4. A longitudinal sealing element ridge 68 (FIG. 6) may protrude from the sealing element interior surface 67 into the sealing element bore 66 of the middle sealing element 64. In like manner, a longitudinal sealing element ridge 297*c* (FIG. 29) may protrude from the sealing element bore surface 297*b* of each of the lower sealing element 296*a* and upper sealing element 296*b*. Accordingly, in assembly of the downhole bridge plug 1*b*, when the middle sealing element 64 is placed on the mandrel shaft 4, the sealing element ridge 68 may insert into the companion mandrel shaft groove 10 (FIGS. 3A and 3C) to prevent rotation of the middle sealing element 64 relative to the mandrel 2. The sealing element ridge 297*c* of each of the lower sealing element 296*a* and the upper sealing element 296*b* may likewise insert into the mandrel shaft groove 10 to prevent rotation of the lower sealing element 296*a* and the upper sealing element 296*b* relative to the mandrel 2, as was heretofore described with respect to the downhole bridge plug 1. Similarly, an upper sealing ring ridge (not illustrated) may protrude from the interior surface of the upper gage ring wall 51 into the ring bore 55 of the upper gage ring 50. A lower sealing ring ridge (not illustrated) may protrude from the interior surface of the lower gage ring wall 83 (FIG. 38) into the ring bore 86 of the lower gage ring 82. The upper sealing ring ridge of the upper gage ring 50 and the lower sealing ring ridge of the lower gage ring 82 may insert into the mandrel shaft groove 10 to prevent rotation of the upper gage ring 50 and the lower gage ring 82 with respect to the mandrel shaft 4.

Figure 50:
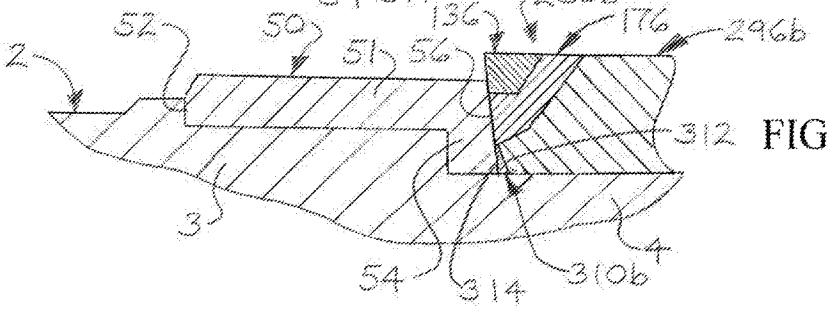
FIG. 50 is an enlarged sectional view of the mandrel, the upper gage ring, the upper backup ring and the upper sealing element, with the upper backup ring and the upper sealing element in the expanded configuration and the upper seal ring deployed in a seated position against the upper gage ring.
Figure 53:
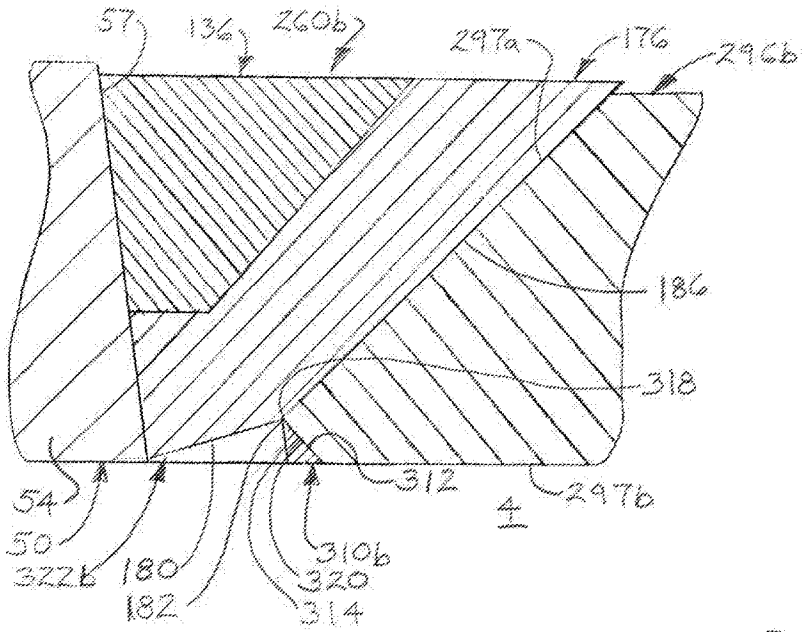
FIG. 53 is an enlarged sectional view of the upper seal ring in the unseated position.
Figure 54:
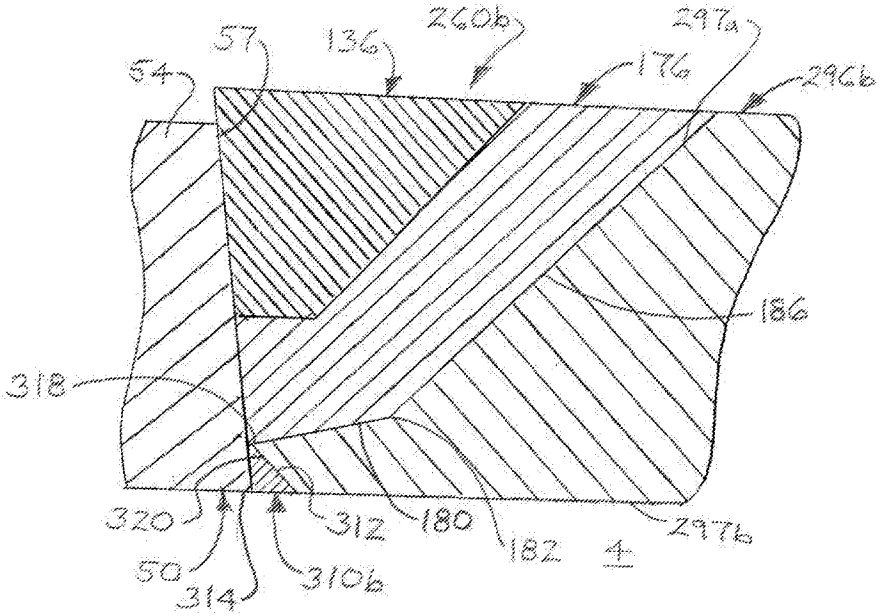
FIG. 54 is an enlarged sectional view of the upper seal ring in the seated position.

As illustrated in FIG. 53, in the pre-expanded configuration of the downhole bridge plug 1*b*, an upper ring space 322*b* may be defined between the inner sealing element bevel 320 of the upper sealing element 296*b*, the exterior surface of the mandrel shaft 4 and the ring opening surface 186 on the inner backup ring portion 176 of the upper backup ring 260*b*. An upper seal ring 310*b* may be disposed in the upper ring space 322*b*. As illustrated in FIGS. 43-46, the upper seal ring 310*b* may be generally triangular in cross-section with a beveled inner ring surface 312, a flat or planar outer ring surface 314, an annular ring edge 318 at the junction between the inner ring surface 312 and the outer ring surface 314, and a ring opening 315. As further illustrated in FIG. 53, the upper seal ring 310*b* may be oriented in the upper ring space 322*b* with the beveled inner ring surface 312 engaging the inner sealing element bevel 320 on the upper sealing element 296*b* and the outer ring surface 314 facing the upper ring space 322*b*. As illustrated in FIGS. 50 and 54, upon expansion of the downhole bridge plug 1*b*, the upper backup ring 260*b* and the upper sealing element 296*b* may expand outwardly to engage the interior surface of the well casing 80, as illustrated in FIG. 48. The upper sealing element 296*b* may simultaneously expand against and push the upper seal ring 310*b* along the mandrel shaft 4 until the outer ring surface 314 engages the beveled exterior lip surface 57 on the sealing ring lip 54 of the upper gage ring 50. Thus, the upper seal ring 310*b* may close the upper ring space 322*b*, creating a fluid-tight seal which seals the interface between the upper gage ring 50, the mandrel shaft 4, the upper backup ring 260*b* and the upper sealing element 296*b*. Thus, the upper seal ring 310*b* may prevent or minimize flow of well fluid between the mandrel shaft 4 and the upper backup ring 260*b*.

Figure 51:
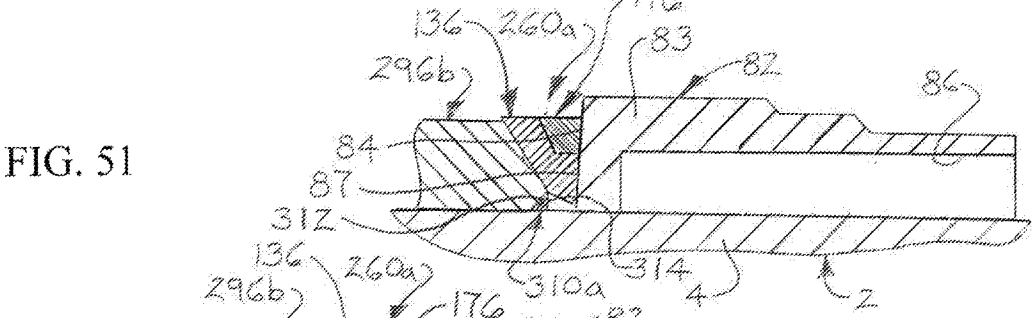
FIG. 51 is an enlarged sectional view of the mandrel, the lower gage ring, the lower backup ring and the lower sealing element, with a ring space there between and the lower backup ring and lower sealing element in the pre-expanded configuration, more particularly illustrating a lower seal ring deployed in an unseated position in the ring space.
Figure 52:
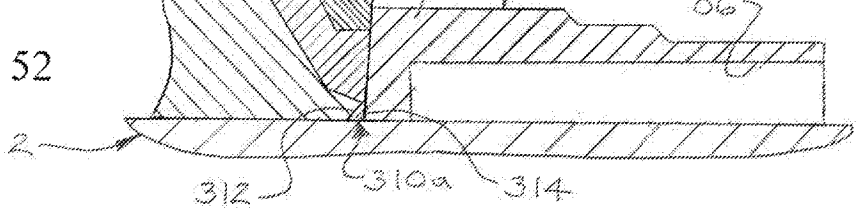
FIG. 52 is an enlarged sectional view of the mandrel, the lower gage ring, the lower backup ring and the lower sealing element, with the lower backup ring and the lower sealing element in the expanded configuration and the lower seal ring deployed in a seated position against the lower gage ring.
Figure 55:
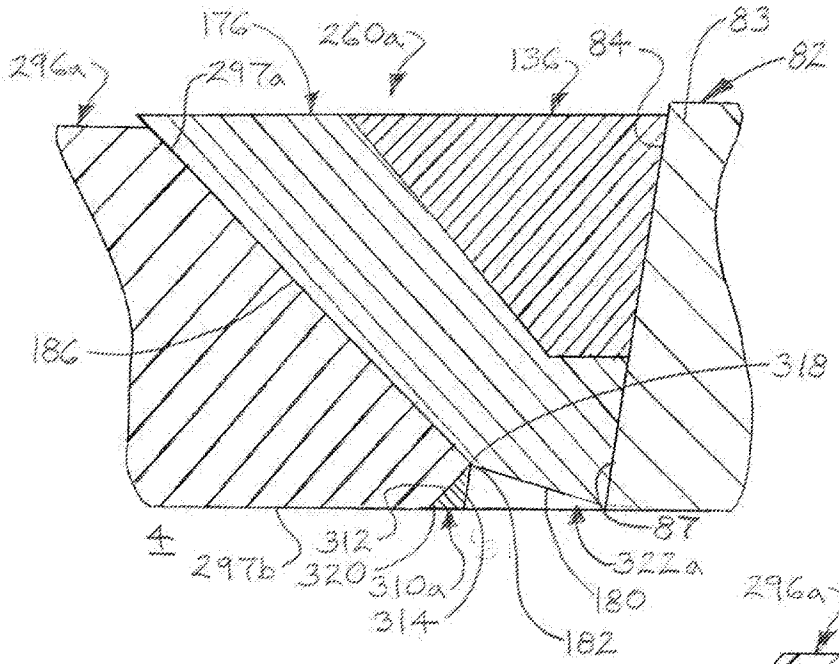
FIG. 55 is an enlarged sectional view of the lower seal ring in the unseated position.
Figure 56:
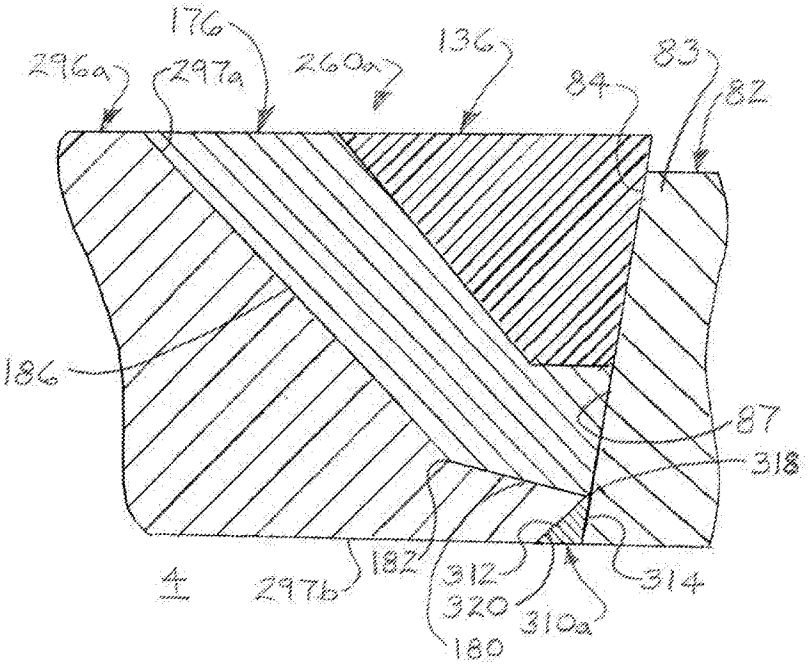
FIG. 56 is an enlarged sectional view of the lower seal ring in the seated position.
Figure 58:
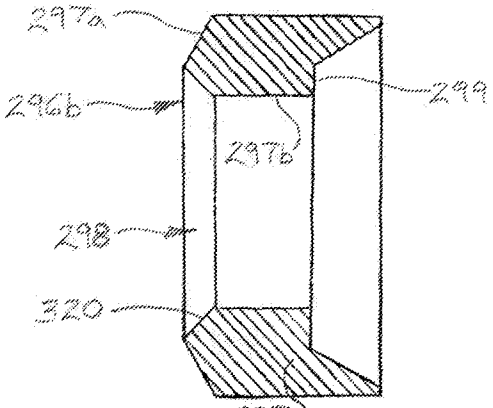
FIG. 58 is a cross-sectional view, taken along section lines 58-58, of the upper sealing element illustrated in FIG. 57.
Figure 60:
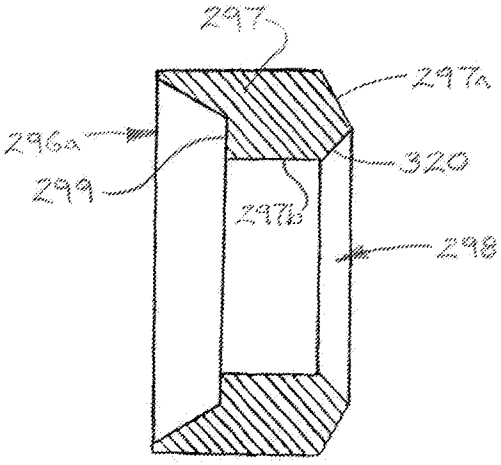
FIG. 60 is a cross-sectional view, taken along section lines 60-60, of the upper sealing element illustrated in FIG. 59.
Figure 57:
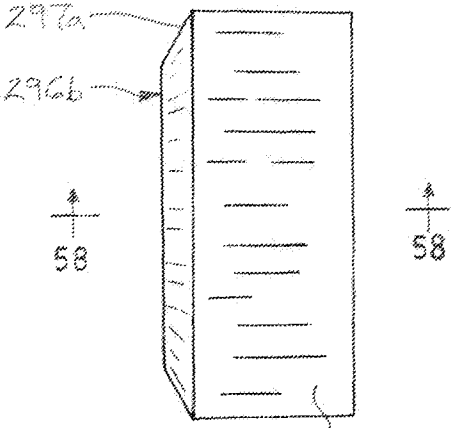
FIG. 57 is a side view of a typical upper sealing element of the fluid-sealing downhole bridge plug illustrated in FIG. 31.
Figure 59:
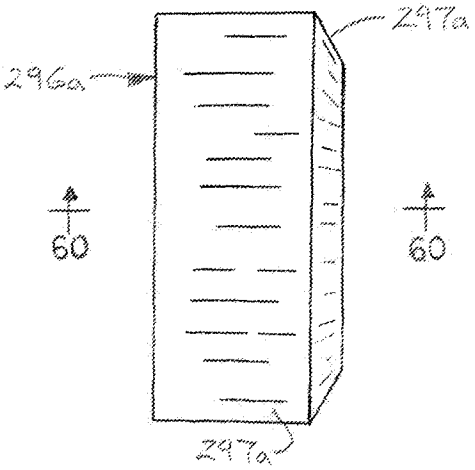
FIG. 59 side view of a typical upper sealing element of the fluid-sealing downhole bridge plug illustrated in FIG. 31.

As illustrated in FIGS. 51 and 55, in the pre-expanded configuration of the downhole bridge plug 1*b*, a lower ring space 322*a* may also be defined between the inner sealing element bevel 320 of the lower sealing element 296*a*, the exterior surface of the mandrel shaft 4 and the ring opening surface 186 on the inner backup ring portion 176 of the lower backup ring 260*a*. A lower seal ring 310*a* may be disposed in the lower ring space 322*a*. As was heretofore described with respect to the upper seal ring 310*b* illustrated in FIGS. 43-46, the lower seal ring 310*a* may be generally triangular in cross-section with a beveled inner ring surface 312, a flat or planar outer ring surface 314 and a ring opening 315. As further illustrated in FIG. 55, the lower seal ring 310*a* may be oriented in the lower ring space 322*a* with the beveled inner ring surface 312 engaging the inner sealing element bevel 320 on the lower sealing element 296*a* and the outer ring surface 314 facing the lower ring space 322*a*. As illustrated in FIGS. 52 and 56, upon expansion of the downhole bridge plug 1*b*, the lower backup ring 260*a* and the lower sealing element 296*a* may expand outwardly to engage the inner surface of the well casing 80, as illustrated in FIG. 48. The lower sealing element 296*a* may expand against and push the lower seal ring 310*a* along the mandrel shaft 4 until the outer ring surface 314 engages the beveled ring surface 87 on the lower gage ring wall 83 of the lower gage ring 82. Thus, the lower seal ring 310*a* may close the lower ring space 322*a*, creating a fluid-tight seal which seals the interface between the lower gage ring 82, the mandrel shaft 4, the lower backup ring 260*a* and the lower sealing element 296*a*. Thus, the lower seal ring 310*a* may prevent or minimize flow of well fluid between the mandrel shaft 4 and the lower backup ring 260*a*.

As illustrated in FIGS. 42 and 47-56, in typical application, the downhole bridge plug 1*b* may be used as a permanent packer, a retrievable packer or a drillable plug, for example and without limitation. The upper gage ring 50 may be placed on the mandrel shaft 4 of the mandrel 2 typically by extending the mandrel shaft 4 through the ring bore 55 and ring opening 56 (FIG. 42), respectively, of the upper gage ring 50 until the sealing ring lip 54 on the upper gage ring 50 engages the mandrel base 3 of the mandrel 2 with the upper gage ring wall 51 engaging the sealing ring shoulder 32, as illustrated in FIG. 42.

The outer backup ring portion 136 of the upper backup ring 260*b* may then be placed on and slid along the mandrel shaft 4 until the outer backup ring portion 136 engages the beveled lip surface 57 of the sealing ring lip 54 on the upper gage ring 50. In some embodiments, a ring retainer pin 145 (FIG. 25) may couple the outer backup ring portion 136 to the sealing ring lip 54 of the upper gage ring 50. The inner backup ring portion 176 of the upper backup ring 260*b* may be placed on and slid along the mandrel shaft 4 against the outer backup ring portion 136. In some embodiments, a coupling retainer pin 184 (FIG. 25) may couple the inner backup ring portion 176 to the outer backup ring portion 136 of the upper backup ring 260*b*. In some applications, the outer backup ring portion 136 and the inner backup ring portion 176 of the upper backup ring 260*b* may be coupled to each other before the upper backup ring 260*b* is deployed on the mandrel shaft 4.

The upper seal ring 310*b* (FIGS. 49 and 5) may be placed on the mandrel shaft 4 typically by extending the mandrel shaft 4 through the ring opening 315 (FIG. 43) of the upper seal ring 310*b*. The upper seal ring 310*b* may be slid along the mandrel shaft 4 until the ring edge 318 of the upper seal ring 310*b* may engage the ring opening edge 182 which may form the abrupt junction or transition between ring opening surface 186 and the inner backup ring surface 180 on the inner backup ring portion 176 of the upper backup ring 260*b*, as illustrated in FIG. 53. Accordingly, as further illustrated in FIG. 53, the upper ring space 322*b* may be defined by and between the outer surface of the mandrel shaft 4, the inner backup ring surface 180 on the inner backup ring portion 176 of the upper backup ring 260*b* and the outer ring surface 314 on the upper seal ring 310*b*.

Next, the upper sealing element 296*b* may be placed on the mandrel 2 by inserting the mandrel shaft 4 of the mandrel 2 through the sealing element bore 298 (FIG. 29) and sliding the upper sealing element 296*b* along the mandrel shaft 4 until the sealing element wall bevel 297*a* on the upper sealing element 296*b* engages the ring opening surface 186 on the inner backup ring portion 176 of the upper backup ring 260*b* and the inner sealing element bevel 320 on the upper sealing element 296*b* engages the inner ring surface 312 on the upper seal ring 310*b*. The middle sealing element 64 may then be placed on the mandrel 2 by inserting the mandrel shaft 4 of the mandrel 2 through the middle sealing element bore 66 of the middle sealing element 64 and sliding the middle sealing element 64 on the mandrel shaft 4 until the middle sealing element 64 engages the upper sealing element 296*b*. The lower sealing element 296*a* may next be placed on the mandrel 2 by inserting the mandrel shaft 4 through the sealing element bore 298 (FIG. 29) until the lower sealing element 296*a* engages the middle sealing element 64.

The lower seal ring 310*a* may be placed on the mandrel shaft 4 typically by extending the mandrel shaft 4 through the ring opening 315 (FIG. 43) of the lower seal ring 310*a*. The lower seal ring 310*a* may be slid along the mandrel shaft 4 until the inner ring surface 312 of the lower seal ring 310*a* engages the inner sealing element bevel 320 on the lower sealing element 296*a*, as illustrated in FIG. 55.

The inner backup ring portion 176 of the lower backup ring 260*a* may next be placed on and slid along the mandrel shaft 4 until the ring opening surface 186 on the inner backup ring portion 176 engages the sealing element wall bevel 297*a* on the lower sealing element 296*a*. Accordingly, as further illustrated in FIG. 55, the ring edge 318 of the lower seal ring 31*a* may engage the ring opening edge 182 which may form the abrupt junction or transition between ring opening surface 186 and the inner backup ring surface 180 on the inner backup ring portion 176 of the lower backup ring 260*a*, as further illustrated in FIG. 53. The outer backup ring portion 136 of the lower backup ring 260*a* may then be placed on and slid along the mandrel shaft 4 against the inner backup ring portion 176. In some embodiments, a coupling retainer pin 184 (FIG. 25) may couple the inner backup ring portion 176 to the outer backup ring portion 136 of the lower backup ring 260*a*. In some applications, the outer backup ring portion 136 and the inner backup ring portion 176 of the lower backup ring 260*a* may be coupled to each other before the lower backup ring 260*a* is deployed on the mandrel shaft 4. Accordingly, as further illustrated in FIG. 55, the lower ring space 322*a* may be defined by and between the outer surface of the mandrel shaft 4, the inner backup ring surface 180 on the inner backup ring portion 176 of the lower backup ring 260*a* and the outer ring surface 314 on the lower seal ring 310*a*.

The lower gage ring 82 may next be placed on the mandrel 2 by inserting the mandrel shaft 4 through the ring bore 86 (FIG. 38) of the lower gage ring 82 and sliding the lower gage ring 82 on the mandrel shaft 4 until the beveled ring surface 87 on the upper ring wall end 84 of the lower gage ring 82 engages the lower backup ring 260*a*, as illustrated in FIG. 55. In some embodiments, a ring retainer pin 145 (FIG. 25) may couple the outer backup ring portion 136 of the lower backup ring 260*a* to the lower gage ring 82.

As illustrated in FIGS. 31 and 32, a running tool 100 may be coupled to the mandrel base 3 of the mandrel 2. In like manner, a lower tubing string 94 may be coupled to the mandrel cap 12. An upper tubing string (not illustrated) may be coupled to the running tool 100 typically by threading, pinning and/or other suitable technique known by those skilled in the art.

As illustrated in FIGS. 47 and 48, the assembled downhole bridge plug 1*b* may be placed in a well casing 80 which extends into a subterranean fluid-producing well (not illustrated) such as an oil and/or gas well, for example and without limitation, between two adjacent production fractions in the well to seal the fractions from each other and prevent flow of fluid between the fractions. Accordingly, the upper tubing string may be inserted in the well casing 80 with the running tool 100 and the mandrel 2 coupled thereto, the mandrel cap 12 coupled to the mandrel shaft 4 of the mandrel 2 and the lower tubing string 94 coupled to the mandrel cap 12. In some applications, the well casing 80 may be oriented in a vertical position in the well in which case the lower gage ring 82 and the lower backup ring 260*a* may be oriented beneath the lower sealing element 296*a* and the middle sealing element 64 and the upper gage ring 50 and the upper backup ring 260*b* may be oriented above the upper sealing element 296*b* and the middle sealing element 64. In other applications, the well casing 80 may be oriented in a horizontal or diagonal position.

Deployment of the downhole bridge plug 1*b* from the pre-expanded configuration (FIG. 47) to the expanded configuration (FIG. 48) may be as was heretofore described with respect to the downhole bridge plug 1 in FIGS. 19A-19C. Accordingly, the lower slip assembly 28*a* and the upper slip assembly 28*b* (FIGS. 31 and 42) may expand circumferentially outwardly to engage the interior surface of the well casing 80, typically as was heretofore described with respect to the downhole bridge plug 1 in FIGS. 19A-19C. The lower gage ring 82 may push against the upper backup ring 260*a* as the upper gage ring 50 pushes in the opposite direction against the lower backup ring 260*b*. The beveled lip surface 57 (FIG. 43) on the scaling ring lip 54 of the upper gage ring 50 may wedge the upper backup ring 260*b*, movement of which is constrained by the lower sealing element 296*b*, outwardly toward and against the casing 80, whereas the beveled ring surface 87 (FIG. 44) on the lower gage ring 82 may wedge the lower backup ring 260*a*, movement of which is constrained by the upper sealing element 296*a*, outwardly toward and against the casing 80. The middle sealing element 64, the lower sealing element 296*a* and the upper sealing element 296*b* may be compressed between the lower backup ring 260*a* and the upper backup ring 260*b*. Accordingly, the middle sealing element 64, the lower scaling element 296*a*, the upper sealing element 296*b*, the lower backup ring 260*a* and the upper backup ring 260*b* may circumferentially expand outwardly and engage the interior surface of the well casing 80, forming a circumferential fluid-tight seal between the downhole bridge plug 1*b* and the well casing 80 and preventing movement of the downhole bridge plug 1*b* as pressure is subsequently placed on the downhole bridge plug 1*b* during well operations. The beveled ring surface 87 on the lower gage ring 82 may apply outward pressure against the beveled outer backup ring surface 139 (FIG. 25) on the outer backup ring portion 136 of the lower backup ring 260*a*, and the beveled lip surface 87 on the sealing ring lip 54 of the upper gage ring 50 may likewise apply outward pressure against the beveled outer backup ring surface 139 on the outer backup ring portion 136 of the upper backup ring 260*b*. Consequently, the inner ring section 137*a* (FIG. 22) and the outer ring section 137*b* of the outer backup ring portion 136 may expand partially circumferentially outwardly to engage the interior surface of the well casing 80, as illustrated in FIG. 42. In like manner, the lower sealing element 296*a* and the upper sealing element 296*b* may apply circumferentially outward pressure against the beveled inner backup ring surface 180 (FIG. 25) on the inner backup ring portion 176 of each of the lower backup ring 260*a* and the upper backup ring 260*b*, respectively. Consequently, the inner ring section 177*a* (FIG. 24) and the outer ring section 177*b* of the inner backup ring portion 176 may expand partially circumferentially outwardly to engage the interior surface of the well casing 80. A ball (not illustrated) may be dropped down the tubing string and onto a ball seat (not numbered) in the mandrel base 3 of the mandrel 2 to seal the portion of the well casing 80 below or distal to the downhole bridge plug 1*b*. Fracking and/or other operations may then be carried out on the reservoir sections which are above or proximal to the downhole bridge plug 1*b*.

As illustrated in FIGS. 53 and 54, as it expands outwardly to engage the well casing 80 (FIGS. 47 and 48), the upper backup ring 260*b* may travel away from the mandrel shaft 4 along the beveled exterior ring surface 57 of the sealing ring lip 54. Simultaneously, the upper sealing element 296*b* may expand against and push the upper seal ring 310*b* along the mandrel shaft 4, as the ring edge 318 of the upper seal ring 310*b* travels along the inner backup ring surface 180 of the inner backup ring portion 176, until the outer ring surface 314 engages the beveled exterior lip surface 57 on the sealing ring lip 54 of the upper gage ring 50. Thus, the upper seal ring 310*b* may close the upper ring space 322*b*, creating a fluid-tight seal which seals the interface between the upper gage ring 50, the mandrel shaft 4, the upper backup ring 260*b* and the upper sealing element 296*b*. Likewise, as illustrated in FIGS. 55 and 56, the lower backup ring 260*a* and the lower sealing element 296*a* may expand outwardly to engage the well casing 80 (FIGS. 47 and 48). Simultaneously, the lower sealing element 296*a* may expand against and push the lower seal ring 310*a* along the mandrel shaft 4, as the ring edge 318 of the upper seal ring 310*b* travels along the inner backup ring surface 180 of the inner backup ring portion 176, until the outer ring surface 314 engages the beveled ring surface 87 on the lower gage ring wall 83 of the lower gage ring 82. Thus, the lower seal ring 310*a* may close the lower ring space 322*a*, creating a fluid-tight seal which seals the interface between the lower gage ring 82, the mandrel shaft 4, the lower backup ring 260*a* and the lower sealing element 296*a*.

In some applications, when removal of the downhole bridge plug 1*b* from the well casing 80 is desired, a drill bit or milling cutter (not illustrated) may be inserted through the well casing 80 and operated to grind the downhole bridge plug 1*b* into fragments according to the knowledge of those skilled in the art. It will be appreciated by those skilled in the art that during drilling or cutting of the downhole bridge plug 1*b*, the mandrel 2 may be locked in place with the middle sealing element 64, the lower sealing element 296*a*, the upper sealing element 296*b*, the lower backup ring 260*a*, the upper backup ring 260*b*, the lower gage ring 82 and the upper gage ring 50, since the sealing element ridge 68 (FIG. 6) on the middle sealing element 64, the sealing element ridge 297*c* of each of the lower sealing element 296*a* and the upper sealing element 296*b* and the upper sealing ring ridge on the upper gage ring 50 and the lower base sealing ring ridge on the lower gage ring 82 may protrude into the mandrel shaft groove 10 (FIG. 3A) in the mandrel shaft 4 of the mandrel 2 in some embodiments. In some embodiments, an anti-rotation pin slot 8 may be provided in the distal or extending end of the mandrel shaft 4 to receive an anti-rotation pin 21 in an anti-rotation pin opening 17 of the mandrel cap wall 14, as was heretofore described with respect to the downhole bridge plug 1 in FIGS. 19*a*-19C. In the expanded configuration of the downhole bridge plug 1*b*, the anti-rotation pin slot 8 in the distal or extending end of the mandrel shaft 4 may receive the anti-rotation pin 21 in the anti-rotation pin opening 17 of the mandrel cap wall 14. This expedient may prevent rotation of the mandrel 2 and the mandrel cap 12 relative to each other during cutting of the downhole bridge plug 1*b*. Therefore, because the mandrel 2 does not spin with the milling cutter or drill bit, speed and efficiency in cutting and removal of the downhole bridge plug 1*b* from the well casing 80 may be enhanced. In some applications, the downhole bridge plug 1*b* may be used with a permanent packer or a retrievable packer.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A downhole bridge plug, comprising:

a mandrel;

at least one sealing element provided on the mandrel;

a first backup ring provided on the mandrel on a first side of the at least one sealing element;

a second backup ring provided on the mandrel on a second side of the at least one sealing element, the first backup ring and the second backup ring deployable between pre-expanded and expanded configurations;

a first gage ring provided on the mandrel and engaging the first backup ring;

a second gage ring provided on the mandrel and engaging the second backup ring;

a first ring space between the at least one sealing element and the first backup ring;

a first beveled seal ring in the first ring space;

a second ring space between the at least one sealing element and the second backup ring;

a second beveled seal ring in the second ring space;

the first beveled seal ring is configured to close the first ring space and create a fluid-tight seal between the first gage ring, the mandrel, the first backup ring and the at least one sealing element as the first backup ring engages the first beveled seal ring, the first backup ring travels away from the mandrel during compression of the at least one sealing element as the first backup ring is deployed from the pre-expanded configuration to the expanded configuration, the at least one sealing element is located between the first backup ring and the second backup ring; and the second beveled seal ring is configured to close the second ring space to create a fluid-tight seal between the second gage ring, the mandrel, the second backup ring and the at least one sealing element as the second backup ring engages the second beveled seal ring, the second backup ring travels away from the mandrel during compression of the at least one sealing element as the second backup ring is deployed from the pre-expanded configuration to the expanded configuration, the at least one sealing element is located between the first backup ring and the second backup ring.

2. The downhole bridge plug of claim 1 wherein each of the first beveled seal ring and the second beveled seal ring is generally triangular in cross-section and includes a beveled inner ring surface, a flat or planar outer ring surface, an annular ring edge at a junction between the inner ring surface and the outer ring surface, and a ring opening.

3. The downhole bridge plug of claim 2 wherein the first ring space is formed by and between the first backup ring, the first beveled seal ring and the mandrel, and the second ring space is formed by and between the second backup ring, the second beveled seal ring and the mandrel.

4. The downhole bridge plug of claim 1 wherein the first gage ring comprises a first gage ring wall and a beveled gage ring lip extending from the first gage ring wall, and the second gage ring comprises a second gage ring wall and a beveled ring surface on the second gage ring wall.

5. The downhole bridge plug of claim 1 wherein each of the first backup ring and the second backup ring comprises:

a first backup ring portion having a first backup ring portion body with a first outer ring section, a first inner ring section and a first spiraled ring groove separating the first outer ring section from the first inner ring section, the first inner ring section and the first outer ring section expandable partially circumferentially outwardly responsive to outward pressure applied to the first inner ring section; and a second backup ring portion disposed adjacent to the first backup ring portion, the second backup ring portion having a second backup ring portion body with a second outer ring section, a second inner ring section and a second spiraled ring groove separating the second outer ring section from the second inner ring section, the second inner ring section and the second outer ring section expandable partially circumferentially outwardly responsive to outward pressure applied to the second inner ring section.

6. The downhole bridge plug of claim 5 wherein the first ring space is formed by and between the second backup ring portion of the first backup ring, the first beveled seal ring and the mandrel, and the second ring space is formed by and between the second backup ring portion of the second backup ring, the second beveled seal ring and the mandrel.

7. A downhole bridge plug, comprising:

a mandrel;

at least one sealing element provided on the mandrel;

a first backup ring provided on the mandrel on a first side of the at least one sealing element;

a second backup ring provided on the mandrel on a second side of the at least one sealing element;

a first gage ring provided on the mandrel and engaging the first backup ring;

a second gage ring provided on the mandrel and engaging the second backup ring;

a first ring space between the at least one sealing element and the first backup ring;

a first seal ring in the first ring space;

a second ring space between the at least one sealing element and the second backup ring;

a second seal ring in the second ring space;

wherein each of the first backup ring and the second backup ring comprises:

a first backup ring portion having a first backup ring portion body with a first outer ring section, a first inner ring section and a first spiraled ring groove separating the first outer ring section from the first inner ring section, the first inner ring section and the first outer ring section expandable partially circumferentially outwardly responsive to outward pressure applied to the first inner ring section; and a second backup ring portion disposed adjacent to the first backup ring portion, the second backup ring portion having a second backup ring portion body with a second outer ring section, a second inner ring section and a second spiraled ring groove separating the second outer ring section from the second inner ring section, the second inner ring section and the second outer ring section expandable partially circumferentially outwardly responsive to outward pressure applied to the second inner ring section;

wherein the first ring space is formed by and between the second backup ring portion of the first backup ring, the first seal ring and the mandrel, and the second ring space is formed by and between the second backup ring portion of the second backup ring, the second seal ring and the mandrel; and wherein the first spiraled ring groove of the first backup ring portion is oriented about 180 degrees relative to the second spiraled ring groove of the second backup ring portion, with the first spiraled ring groove and the second spiraled ring groove in non-overlapping relationship to each other.

8. A downhole bridge plug, comprising:

a mandrel;

at least one sealing element provided on the mandrel;

a first backup ring provided on the mandrel on a first side of the at least one sealing element;

a second backup ring provided on the mandrel on a second side of the at least one sealing element;

a first gage ring provided on the mandrel and engaging the first backup ring;

a second gage ring provided on the mandrel and engaging the second backup ring;

a first ring space between the at least one sealing element and the first backup ring;

a first seal ring in the first ring space;

a second ring space between the at least one sealing element and the second backup ring;

a second seal ring in the second ring space;

wherein each of the first backup ring and the second backup ring comprises:

a first backup ring portion having a first backup ring portion body with a first outer ring section, a first inner ring section and a first spiraled ring groove separating the first outer ring section from the first inner ring section, the first inner ring section and the first outer ring section expandable partially circumferentially outwardly responsive to outward pressure applied to the first inner ring section; and a second backup ring portion disposed adjacent to the first backup ring portion, the second backup ring portion having a second backup ring portion body with a second outer ring section, a second inner ring section and a second spiraled ring groove separating the second outer ring section from the second inner ring section, the second inner ring section and the second outer ring section expandable partially circumferentially outwardly responsive to outward pressure applied to the second inner ring section; and the second backup ring portion body of the second backup ring portion of each of the first backup ring and the second backup ring comprises a ring opening, an annular exterior engaging ring surface, an annular interior ring opening edge facing the ring opening, a beveled inner backup ring surface tapering from the exterior engaging ring surface to the ring opening edge, a beveled annular outer ring surface tapering from the engaging ring surface, an annular ring lip protruding from the outer ring surface and a beveled annular ring opening surface extending from the ring opening edge through the ring lip and facing the ring opening;

the first ring space is formed by and between the beveled inner backup ring surface of the second backup ring portion body of the second backup ring portion of the first backup ring, the first seal ring and the mandrel; and the second ring space is formed by and between the beveled inner backup ring surface of the second backup ring portion body of the second backup ring portion of the second backup ring, the second seal ring and the mandrel.

9. The downhole bridge plug of claim 8 wherein the first backup ring portion body of the first backup ring comprises a ring opening, an annular exterior engaging ring surface, an annular ring opening edge encircling and facing the ring opening, and a beveled outer backup ring surface and a beveled inner ring surface tapering inwardly toward each other from the exterior engaging ring surface to the ring opening edge, and wherein the first ring space is formed by and between the beveled inner ring surface of the first backup ring portion body, the first seal ring and the mandrel.

10. The downhole bridge plug of claim 9 wherein the first spiraled ring groove comprises an elongated main groove segment generally straight or axial in side view of the first backup ring body and extending along a portion of the circumference of the engaging ring surface, a generally curved inner surface groove segment extending from the main groove segment along the inner ring surface to the ring opening edge and a generally curved or straight outer surface groove segment extending from the main groove segment along a portion of the outer ring surface to the ring opening edge.

11. The downhole bridge plug of claim 10 wherein the second spiraled ring groove comprises a main groove segment extending along the engaging ring surface, an inner surface groove segment extending from the main groove segment along the inner backup ring surface, an interior groove segment extending from the inner surface groove segment along the ring opening surface and an outer surface groove segment extending along the outer ring surface from the interior groove segment back to the main groove segment.

12. A downhole bridge plug, comprising:

a mandrel;

at least one sealing element provided on the mandrel;

a first backup ring provided on the mandrel on a first side of the at least one sealing element;

a second backup ring provided on the mandrel on a second side of the at least one sealing element;

a first gage ring provided on the mandrel and engaging the first backup ring;

a second gage ring provided on the mandrel and engaging the second backup ring;

a first ring space between the at least one sealing element and the first backup ring;

a first seal ring in the first ring space;

a second ring space between the at least one sealing element and the second backup ring;

a second seal ring in the second ring space; and wherein each of the first backup ring and the second backup ring comprises:

a first backup ring portion having a first backup ring portion body with a first outer ring section, a first inner ring section and a first spiraled ring groove separating the first outer ring section from the first inner ring section, the first inner ring section and the first outer ring section expandable partially circumferentially outwardly responsive to outward pressure applied to the first inner ring section; and a second backup ring portion disposed adjacent to the first backup ring portion, the second backup ring portion having a second backup ring portion body with a second outer ring section, a second inner ring section and a second spiraled ring groove separating the second outer ring section from the second inner ring section, the second inner ring section and the second outer ring section expandable partially circumferentially outwardly responsive to outward pressure applied to the second inner ring section; and wherein the second backup ring portion is coupled to the first backup ring portion.

13. The downhole bridge plug of claim 12 further comprising at least one coupling retainer pin coupling the second backup ring portion to the first backup ring portion.

14. The downhole bridge plug of claim 13 further comprising at least one ring retainer pin normally retaining the at least one backup ring in a pre-expanded configuration.

15. A downhole bridge plug, comprising:

a mandrel;

at least one sealing element provided on the mandrel;

a first backup ring provided on the mandrel on a first side of the at least one sealing element;

a second backup ring provided on the mandrel on a second side of the at least one sealing element, the first backup ring and the second backup ring deployable between pre-expanded and expanded configurations;

a first gage ring provided on the mandrel and engaging the first backup ring;

a second gage ring provided on the mandrel and engaging the second backup ring;

a first ring space defined between the at least one sealing element, the first backup ring and the mandrel in the pre-expanded configuration of the first backup ring;

a first beveled seal ring in the first ring space;

a second ring space defined between the at least one sealing element, the second backup ring and the mandrel in the pre-expanded configuration of the second backup ring;

a second beveled seal ring in the second ring space;

the first beveled seal ring closes the first ring space and seals an interface between the first gage ring, the at least one sealing element, the first backup ring and the mandrel as the first backup ring engages the first beveled seal ring and travels away from the mandrel in compression of the at least one sealing element between the first backup ring and the second backup ring as the first backup ring is deployed from the pre-expanded configuration to the expanded configuration; and the second beveled seal ring closes the second ring space and seals an interface between the second gage ring, the at least one sealing element, the second backup ring and the mandrel as the second backup ring engages the second beveled seal ring and travels away from the mandrel in compression of the at least one sealing element between the first backup ring and the second backup ring as the second backup ring is deployed from the pre-expanded configuration to the expanded configuration.

16. The downhole bridge plug of claim 15 wherein each of the first backup ring and the second backup ring comprises:

a first backup ring portion having a first backup ring portion body with a first outer ring section, a first inner ring section and a first spiraled ring groove separating the first outer ring section from the first inner ring section, the first inner ring section and the first outer ring section expandable partially circumferentially outwardly responsive to outward pressure applied to the first inner ring section; and a second backup ring portion disposed adjacent to the first backup ring portion, the second backup ring portion having a second backup ring portion body with a second outer ring section, a second inner ring section and a second spiraled ring groove separating the second outer ring section from the second inner ring section, the second inner ring section and the second outer ring section expandable partially circumferentially outwardly responsive to outward pressure applied to the second inner ring section.

17. The downhole bridge plug of claim 16 wherein the first ring space is formed by and between the second backup ring portion of the first backup ring, the first beveled seal ring and the mandrel, and the second ring space is formed by and between the second backup ring portion of the second backup ring, the second beveled seal ring and the mandrel.

18. A downhole bridge plug, comprising:

a mandrel;

at least one sealing element provided on the mandrel;

a first backup ring provided on the mandrel on a first side of the at least one sealing element;

a second backup ring provided on the mandrel on a second side of the at least one sealing element, the first backup ring and the second backup ring deployable between pre-expanded and expanded configurations;

a first gage ring provided on the mandrel and engaging the first backup ring;

a second gage ring provided on the mandrel and engaging the second backup ring;

a first ring space defined between the at least one sealing element, the first backup ring and the mandrel in the pre-expanded configuration of the first backup ring;

a first seal ring in the first ring space;

a second ring space defined between the at least one sealing element, the second backup ring and the mandrel in the pre-expanded configuration of the second backup ring;

a second seal ring in the second ring space;

the first seal ring closes the first ring space and seals an interface between the at least one sealing element, the first backup ring and the mandrel as the first backup ring is deployed from the pre-expanded configuration to the expanded configuration;

the second seal ring closes the second ring space and seals an interface between the at least one sealing element, the second backup ring and the mandrel as the second backup ring is deployed from the pre-expanded configuration to the expanded configuration;

wherein each of the first backup ring and the second backup ring comprises:

a first backup ring portion having a first backup ring portion body with a first outer ring section, a first inner ring section and a first spiraled ring groove separating the first outer ring section from the first inner ring section, the first inner ring section and the first outer ring section expandable partially circumferentially outwardly responsive to outward pressure applied to the first inner ring section; and a second backup ring portion disposed adjacent to the first backup ring portion, the second backup ring portion having a second backup ring portion body with a second outer ring section, a second inner ring section and a second spiraled ring groove separating the second outer ring section from the second inner ring section, the second inner ring section and the second outer ring section expandable partially circumferentially outwardly responsive to outward pressure applied to the second inner ring section;

wherein the first ring space is formed by and between the second backup ring portion of the first backup ring, the first seal ring and the mandrel, and the second ring space is formed by and between the second backup ring portion of the second backup ring, the second seal ring and the mandrel; and wherein the first spiraled ring groove of the first backup ring portion is oriented about 180 degrees relative to the second spiraled ring groove of the second backup ring portion, with the first spiraled ring groove and the second spiraled ring groove in non-overlapping relationship to each other.

19. A downhole bridge plug, comprising:

a mandrel;

at least one sealing element provided on the mandrel, the at least one sealing element deployable between pre-expanded and expanded configurations;

a first backup ring provided on the mandrel on a first side of the at least one sealing element;

a second backup ring provided on the mandrel on a second side of the at least one sealing element, the first backup ring and the second backup ring deployable between the pre-expanded and expanded configurations;

a first gage ring provided on the mandrel and engaging the first backup ring;

a second gage ring provided on the mandrel and engaging the second backup ring;

a first ring space defined between the at least one sealing element, the first backup ring and the mandrel in the pre-expanded configuration of the first backup ring;

a first beveled seal ring in the first ring space;

a second ring space defined between the at least one sealing element, the second backup ring and the mandrel in the pre-expanded configuration of the second backup ring;

a second beveled seal ring in the second ring space;

the at least one sealing element expands against and pushes the first beveled seal ring along the mandrel until the first beveled seal ring engages the first gage ring and closes the first ring space and seals an interface between the first gage ring, the mandrel, the first backup ring and the at least one sealing element as the first backup ring engages the first beveled seal ring and travels away from the mandrel in compression of the at least one sealing element between the first backup ring and the second backup ring as the first backup ring and the at least one sealing element are deployed from the pre-expanded configuration to the expanded configuration; and the at least one sealing element expands against and pushes the second beveled seal ring along the mandrel until the second beveled seal ring engages the second gage ring and closes the second ring space and seals an interface between the second gage ring, the mandrel, the second backup ring and the at least one sealing element as the second backup ring engages the second beveled seal ring and travels away from the mandrel in compression of the at least one sealing element between the first backup ring and the second backup ring as the second backup ring and the at least one sealing element are deployed from the pre-expanded configuration to the expanded configuration.

20. The downhole bridge plug of claim 19 wherein each of the first backup ring and the second backup ring comprises:

a first backup ring portion having a first backup ring portion body with a first outer ring section, a first inner ring section and a first spiraled ring groove separating the first outer ring section from the first inner ring section, the first inner ring section and the first outer ring section expandable partially circumferentially outwardly responsive to outward pressure applied to the first inner ring section; and a second backup ring portion disposed adjacent to the first backup ring portion, the second backup ring portion having a second backup ring portion body with a second outer ring section, a second inner ring section and a second spiraled ring groove separating the second outer ring section from the second inner ring section, the second inner ring section and the second outer ring section expandable partially circumferentially outwardly responsive to outward pressure applied to the second inner ring section;

the first ring space is formed by and between the second backup ring portion of the first backup ring, the first beveled seal ring and the mandrel; and the second ring space is formed by and between the second backup ring portion of the second backup ring, the second beveled seal ring and the mandrel.

* * * * *